US006705715B2

(12) United States Patent
Morita et al.

(10) Patent No.: US 6,705,715 B2
(45) Date of Patent: Mar. 16, 2004

(54) LIQUID CONTAINER, CARTRIDGE INCLUDING LIQUID CONTAINER, PRINTING APPARATUS USING CARTRIDGE AND LIQUID-DISCHARGE PRINTING APPARATUS

(75) Inventors: Osamu Morita, Kanagawa (JP); Hiroshi Koshikawa, Kanagawa (JP); Kenji Kitabatake, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 10/191,475

(22) Filed: Jul. 10, 2002

(65) Prior Publication Data

US 2002/0175979 A1 Nov. 28, 2002

Related U.S. Application Data

(62) Division of application No. 09/386,359, filed on Aug. 31, 1999.

(30) Foreign Application Priority Data

Sep. 1, 1998 (JP) ..... 10-247510
Oct. 27, 1998 (JP) ..... 10-306145
Oct. 27, 1998 (JP) ..... 10-306159

(51) Int. Cl.[7] ..... B41J 2/175; B41J 2/195
(52) U.S. Cl. ..... 347/87; 347/7; 347/86
(58) Field of Search ..... 347/7, 19, 85–87; 73/293, 323, 327; 222/64–66; 250/573, 574, 577

(56) References Cited

U.S. PATENT DOCUMENTS

| | | | | |
|---|---|---|---|---|
| 4,246,489 A | | 1/1981 | Yoshida et al. | 250/577 |
| 5,512,926 A | | 4/1996 | Uchikata et al. | 347/86 |
| 5,552,816 A | | 9/1996 | Oda et al. | 347/86 |
| 5,616,929 A | | 4/1997 | Hara | 250/573 |
| 5,997,121 A | | 12/1999 | Altfather et al. | 347/7 |
| 6,012,795 A | | 1/2000 | Saito et al. | 347/7 |
| 6,012,808 A | | 1/2000 | Koitabashi et al. | 347/86 |
| 6,024,428 A | | 2/2000 | Uchikata | 347/7 |
| 6,053,605 A | * | 4/2000 | Sasaki | 347/85 |
| 6,137,503 A | | 10/2000 | Hashimoto et al. | 347/19 |
| 6,203,148 B1 | * | 3/2001 | Kishida | 347/86 |
| 6,293,660 B1 | * | 9/2001 | Kishida et al. | 347/86 |
| 6,361,136 B1 | | 3/2002 | Watanabe et al. | 347/7 |

FOREIGN PATENT DOCUMENTS

| | | | |
|---|---|---|---|
| EP | 860286 A2 | 2/1998 | B41J/2/175 |
| EP | 860284 | 8/1998 | |
| JP | 7-89090 | 4/1995 | |
| JP | 7-218321 | 8/1995 | |
| JP | 8-112907 | 4/1996 | |
| JP | 9-29989 | 2/1997 | |
| JP | 9-174877 | 7/1997 | |
| JP | 10-230616 | 9/1998 | |

* cited by examiner

*Primary Examiner*—Juanita Stephens
(74) *Attorney, Agent, or Firm*—Fitzpatrick, Cella, Harper & Scinto

(57) ABSTRACT

A liquid container which can precisely detects existence/absence of residual liquid at a low cost, a cartridge including the liquid container, and a printing apparatus using the cartridge. The lengthwise direction of a triangular prism provided on the bottom of the ink tank is along a direction of print medium conveyance in the printing apparatus, such that when an ink-jet head cartridge holding the ink tank is attached to the printing apparatus for performing printing, light emitted from an optical unit of the printing apparatus is precisely captured by the prism. Further, if two ink-jet head cartridges are mounted on the printing apparatus, the first and second ink-jet head cartridges are set in positions shifted from each other by a length shorter than the length in the lengthwise direction of the prism, such that the light emitted from the optical unit reaches the prisms provided in the ink tanks of the first and second ink-jet head cartridges.

6 Claims, 51 Drawing Sheets

LIQUID CONTAINER, CARTRIDGE INCLUDING LIQUID CONTAINER, PRINTING APPARATUS USING CARTRIDGE AND LIQUID-DISCHARGE PRINTING APPARATUS

This application is a division of application Ser. No. 09/386,359, filed Aug. 31, 1999, allowed.

BACKGROUND OF THE INVENTION

This invention relates to a liquid container and a cartridge including the liquid container, a printing apparatus using the cartridge and a liquid-discharge printing apparatus, and more particularly, to a liquid container to supply ink to a printhead which performs printing in accordance with an ink-jet method, a cartridge including the liquid container, a printing apparatus using the cartridge and a liquid-discharge printing apparatus.

According to the conventionally known devices for detecting existence/absence of residual ink in an ink tank containing ink, electrodes are provided in the ink tank and electric conductivity between the electrodes is measured, or a discharged ink droplet is optically detected. Generally, as a method of using electrodes complicates the structure of the ink tank, means for optically detecting existence/absence of residual ink is usually employed.

Particularly, an ink-jet printing apparatus for performing printing by discharging ink contained in an ink tank generally comprises a printhead which discharges ink to a print medium, an ink tank containing ink to be supplied to the printhead, conveyance means for conveying the print medium and control means for controlling printing operation, scanning operation and the like of the printhead. In this apparatus, if the amount of residual ink in the ink tank is less than a predetermined amount, ink supplied to the printhead becomes insufficient and may cause discharge failure. For this reason, the apparatus further comprises a device and a mechanism for detecting a residual ink amount or existence/absence of ink in the ink tank.

As an example of printing apparatus having an ink-existence detection apparatus of this type, Japanese Patent Publication Laid Open No. 8-112907 discloses an ink-jet printing apparatus which detects existence/absence of residual ink in an ink tank having a negative-pressure generating member of, e.g., absorbent material, foaming material and the like, by transmitting light through a part of light-transmitting wall surface of the ink tank and detecting changes in optical reflectivity in the boundary portion between the wall surface of the ink tank and the negative-pressure generating member.

Further, Japanese Patent Publication Laid Open No. 7-218321 discloses an ink tank integrating an optical ink detection portion, formed with a light-transmitting member being the same material as that of the ink tank, where the surface contacting ink has a predetermined angle with respect to a detection light path.

Further, Japanese Patent Publication Laid Open No. 9-174877 discloses a detection system which detects existence of ink tank and the level of ink in the ink tank.

Further, Japanese Patent Publication Laid Open No. 9-29989 discloses an ink-jet printing apparatus which detects existence/absence of ink and existence/absence of ink tank by using a single photosensor having a light-emitting device and a photoreception device.

Further, Japanese Patent Publication Laid Open No. 7-89090 discloses an apparatus for detecting existence/absence of liquid contained in a liquid container comprising: a negative-pressure generating member accommodating chamber accommodating a negative-pressure generating member and having a liquid supply orifice and an atmospheric-air communicating portion; and a liquid containing chamber having a communication portion to communicate with the negative-pressure generating member accommodating chamber, and forming substantially closed space.

Next, a conventional ink existence/absence detection mechanism using a light-transmitting prism will be described with reference to FIG. 36. FIG. 36 shows the positional relation among a light-transmitting type prism provided on the bottom surface of an ink tank, a light emitting device which irradiates the prism with light, and a photoreception device which receives the light.

As shown in FIG. 36, a prism 1060 is integrally molded with a bottom surface 1061 of the ink tank. Light from a light emitting device 1062 in an external lower position with respect to the ink tank enters the prism 1060.

If there is sufficient ink in the ink tank, the incident light from the light emitting device 1062 passes through an optical path ①→ an optical path ②', then is absorbed in the ink and never returns to the photoreception device 1063. On the other hand, if the ink in the ink tank is consumed and is exhausted, the light from the light emitting device 1062 is reflected by a slope of the prism 1060, and through the optical path ①→ the optical path ②→ an optical path ③, returns to the photoreception device 1063, as shown in FIG. 36.

In this manner, the existence/absence of ink is determined based on whether or not the light emitted from the light emitting device 1062 returns to the photoreception device 1063. Note that the light emitting device 1062 and the photoreception device 1063 are provided on the printing apparatus main body side.

The above-described ink existence/absence detection mechanism provides a rational method to detect the level of ink or existence/absence of ink in the ink tank at a low cost.

Next, the outline of the structure of the conventional ink-jet printing apparatus, the ink tank and a tank holder holding the ink tank will be described.

FIG. 37 is a perspective view showing a conventional general ink-jet printing apparatus.

In the ink-jet printing apparatus in FIG. 37, a lead screw 2104 and a guide shaft 2105 parallel to each other are provided in a casing. A carriage 2101 is attached to the lead screw 2104 and the guide shaft 2105 such that the carriage is movable in parallel to the lead screw 2104 and the guide shaft 2105. The carriage 2101 moves parallel with the lead screw and the guide shaft by rotation of the lead screw 2104 by a carriage motor (not shown).

The carriage 2101 holds an ink-jet head cartridge having an ink-jet printhead 2102 (hereinafter referred to as "printhead") to be described with reference to FIGS. 38A and 38B. A paper-pressing plate 2109 is provided along the moving direction of the printhead 2102.

Further, the ink-jet printing apparatus comprises a paper feed roller 2107 to convey a print sheet 2106 as a print medium toward a printing area of the printhead 2102, and a paper discharge roller 2108 to discharge the print sheet 2106 on which printing has been performed by the printhead 2102. The paper feed roller 2107 and the paper discharge roller 2108 are rotated by a conveyance motor (not shown).

As ink discharged from the printhead 2102 is attached to the print sheet 2106 opposite to a discharge orifice surface of the printhead 2102, a print image is formed on the surface of the print sheet 2106. In connection with the printing by the printhead 2102 on the print sheet 2106, the print sheet 2106 is discharged to the outside the ink-jet printing apparatus by the paper feed roller 2107 and the paper discharge roller 2108 rotated by a conveyance motor, and the paper pressing plate 2109.

FIGS. 38A and 38B are diagrams for explaining an ink-jet head cartridge mounted on the carriage 2101 as shown in FIG. 37. FIG. 38A is a perspective view showing the ink-jet head cartridge mounted on the carriage 2101. FIG. 38B is a perspective view showing a state where the ink tank is removed from a tank holder in the ink-jet head cartridge in FIG. 38A.

As shown in FIGS. 38A and 38B, an ink-jet head cartridge 2301 mounted on the carriage 2101 comprises a tank holder 2103 having the printhead 2102 and ink tanks 2111 to 2114 detachably provided on the tank holder 2103. The ink tank 2111 contains black ink; the ink tank 2112, yellow ink; the ink tank 2113, magenta ink; and the ink tank 2114, cyan ink. As the ink tanks 2111 to 2114 are respectively detachable with respect to the tank holder 2103, and respectively exchangeable with a new ink tank, the running cost in printing by the ink-jet printing apparatus can be reduced.

The ink tanks 2111 to 2114, respectively containing corresponding color ink, respectively have an ink supply orifice to supply the ink to the printhead 2102. For example, the ink tank 2111 has an ink supply orifice 2211. In a state where the ink tank 2111 is attached to the tank holder 2103, the black ink in the ink tank 2111 is supplied via the ink supply orifice 2211 to the printhead 2102.

FIG. 39 is a cross-sectional view of the tank holder 2103 and the printhead 2102 as shown in FIGS. 38A and 38B. As shown in FIG. 39, the upper surface of a box-shaped tank holder 2103 is opened, and the printhead 2102 is provided on one side surface of the tank holder 2103. In the printhead 2102, a silicon substrate 2201 is supported by a base plate 2205. Heaters as electrothermal transducers or the like to generate thermal energy utilized for ink discharge are formed on the silicon substrate 2201.

Further, the printhead 2102 has a joint 2204 to be connected to the ink supply orifice of an ink tank when the ink tank is attached to the tank holder 2103. The joint 2204 has an ink channel 2206 extending toward the silicon substrate 2201.

The flow of ink in the ink-jet head cartridge having the above construction will be described with reference to the ink tank 2111 for black ink. The ink in the ink tank 2111 is supplied via the ink supply orifice 2211 of the ink tank 2111 and the joint 2204 into the printhead 2102. The ink supplied to the printhead 2102 is supplied through the ink channel 2206 to the silicon substrate 2201, and the supplied ink is discharged toward a print sheet as a print medium by thermal energy generated by the heaters on the silicon substrate 2201.

FIGS. 40A to 40C are diagrams for explaining the ink tank 2111 as shown in FIGS. 38A and 38B. FIG. 40A is a perspective view showing the ink tank 2111 and a second latch 2132. FIG. 40B is a perspective view showing the ink tank 2111 and a movable lever 2130. FIG. 40C is a cross-sectional view of the ink tank 2111.

As shown in FIGS. 40A and 40B, the movable lever 2130 having a first latch 2131 is provided on one side surface of the ink tank 2111, and the second latch 2132 is provided on another side surface of t in tank 2111 When the ink tank 2111 is attached to the tank holder 2103, the first latch 2131 and the second latch 2132 engage with a first hole 2241 and a second hole 2242 (See FIG. 39) formed in the tank holder 2103. By this arrangement, the ink tank 2111 is fixed on the tank holder 2103. The ink tank 2111 has the ink supply orifice 2211 having a projecting cylindrical shape on its lower surface.

Further, as shown in FIG. 40C, a joint member 2137 to be in contact with liquid is filled in the ink supply orifice 2211. When the ink tank 2111 is attached to the tank holder 2103, the ink in the ink tank is supplied from the ink supply orifice 2211 through the joint member 2137 to the printhead 2102. Further, a prism 1060 used for detecting residual ink in the ink tank is provided on the inner bottom surface of the ink tank 2111.

Next, a procedure of setting the ink tank 2111 to the tank holder 2103 of the ink-jet head cartridge 2301 will be described with reference to FIGS. 41A to 41C.

First, as shown in FIG. 41A, the surface having the ink supply orifice 2211 of the ink tank 2111 is faced to the upper surface of the tank holder 2103, and the second latch 2132 of the ink tank 2111 is tilted downward while the ink tank 2111 is inserted into the tank holder 2103.

Next, as shown in FIG. 41B, as the ink tank is inserted along a slope of the tank holder 2103 on the right side in FIG. 41B, the second latch 2132 of the ink tank 2111 engages with the second hole 2242 of the tank holder 2103.

Further, as shown in FIG. 41C, as the ink tank 2111 is pushed into the tank holder 2103, the movable lever 2103 is distorted inwardly, then the first latch 2131 engages with the first hole 2341 of the tank holder 2103, thus the ink tank 2111 is fixed to the tank holder 2103.

In this state, the ink contained in the ink tank is introduced via the joint member 2137 of the ink supply orifice 2211 to the printhead 2102, and discharged from a discharge orifice (not shown) by energy generated by the electrothermal transducer.

Note that when the ink tank 2111 is removed, the movable lever 2130 is distorted inwardly and the first latch 2131 is pulled out of the first hole 2241 of the tank holder 2103. Thus, the ink tank 2111 can be easily removed from the tank holder 2103.

Further, as shown in FIGS. 42A and 42B, a sensor 2302 is provided for each color ink tank under the ink-jet head cartridge 2301 having the above-described construction. When the ink tank 2111, for example, is attached to the tank holder 2103, the sensor in cooperation with the prism 1060 on the inner bottom surface of the ink tank, detects residual ink within the tank.

However, the above-described conventional art has the following problems.

(1) To improve the detection precision of the ink existence/absence detecting mechanism by precisely obtaining the positional relation between the prism in the ink tank and the optical unit having the light emitting device and the photoreception device, it is necessary to greatly improve the precision of attachment of respective parts and units, such as the precision of attachment of ink tank to the tank holder or carriage, the precision of attachment of printhead to the carriage, the precision of attachment of the carriage to the printing apparatus main body, the precision of the attachment of the optical unit to the printing apparatus main body. Accordingly, it is necessary to improve machining precision with respect to the parts and to improve the precision of assembly line. This increases the production cost.

(2) In a case where two printheads to discharge different types of ink are set in positions shifted from each other in a print-medium conveyance direction within one printing apparatus, to print a higher quality image and/or perform color printing, two ink tanks to supply ink to the respective printheads are provided in different positions. When existence/absence of ink is detected in the position-shifted ink tanks, two optical units must be provided in the printing apparatus. This also increases the production cost.

(3) In a case where a single type of ink tank is commonly used by plural types of printing apparatuses, as the position of the prism in the ink tank is fixed, the positions of the light emitting device and the photoreception devices provided on the printing apparatus side are uniquely determined. This greatly limits freedom in design of the printing apparatus.

Further, in the above-described conventional art, if the ink viscosity has increased in a low-temperature environment or the like or if the ink tank is exposed in a severe environment such as a high-temperature environment or a low-temperature environment where the ink is easily attached to the inner wall surface of the tank, even if the ink in the ink tank is almost used, a small amount of ink 1067 may remain on the surface of the prism, as shown in FIG. 43.

In this case, it is assumed that there is no ink, light emitted from the light emitting device 1062 must be reflected by a slope of the prism 1060, and must be returned through optical path ①→②→③ to the photoreception device 1063. However, as the ink 1067 remains on the surface of the prism, the light emitted from the light emitting device 1062 enters the ink tank through optical paths ①→②' and as a result, the amount of light returned to the photoreception device 1063 is less than an expected amount.

Accordingly, although the ink is exhausted in the ink tank, it is determined that the ink still remains in the ink tank.

Further, in the above conventional art, as shown in FIG. 42B, since the ink tank is attached and fixed to the tank holder 2103 only by engaging the first latch 2131 and the second latch 2132 of the ink tank 2111 with the first hole 2241 and the second hole 2242 of the tank holder 2103, the positional precision of the ink tank in the tank holder 2103 is lowered. Accordingly, in detection of residual ink in the tank, the detection precision might be degraded depending on the construction of the sensor and that of the prism. In this case, before the ink within the tank is not fully used, a user is advised to exchange the ink tank for new one.

SUMMARY OF THE INVENTION

Accordingly, an object of the present invention is to provide a liquid container which precisely detects existence/absence of residual liquid at a low cost, a cartridge including the liquid container, a printing apparatus using the cartridge, and a liquid-discharge printing apparatus.

It is another object of the present invention to provide a liquid container which precisely detects existence/absence of residual liquid even if the liquid or a container containing the liquid is exposed in a severe environment, a cartridge including the liquid container, and a printing apparatus using the cartridge.

It is still another object of the present invention to provide an ink tank, a tank holder and a head cartridge arranged such that the ink tank can be attached to a tank holder with high positional precision.

According to one aspect of the present invention the foregoing object is attained by providing a liquid container comprising: a liquid containing portion in which liquid is contained; a liquid supply orifice which supplies the liquid contained in the liquid containing portion to outside; an approximately-polygonal prism made of light-transmitting material, having a surface integrated with an external wall surface of the liquid containing portion and a plurality of reflection surfaces, different from the external wall surface, which serve as an interface with respect to the liquid, having a predetermined angle with respect to an optical path of light emitted from a light source in a predetermined position outside the liquid containing portion, wherein the liquid container has a flat shape, and a lengthwise direction of the flat shape is in the same direction as a lengthwise direction of the prism.

Preferably, the prism is integrally molded with the liquid container.

In this case, it may be arranged such that the prism is divided into a plurality of prisms in the lengthwise direction of the prism, or the prism is integrally molded with the liquid container such that the prism has space concaved inwardly from the outside of the liquid container.

Preferably, the prism has a isosceles triangular cross section vertical to the lengthwise direction. Further, it is preferable that the length of the prism in the lengthwise direction is longer than the length of a base of the isosceles triangular cross section.

Further, it is preferable to arranged such that the liquid container further comprises a liquid-holding material containing unit containing liquid-holding material, and the liquid containing portion and the liquid-holding material containing unit communicate with each other by a communicating path.

Preferably, the liquid is ink, or processed liquid discharged to a print medium so as to improve fixability or water repellency of an image printed with ink on the print medium or to improve quality of the image.

According to another aspect of the present invention, the foregoing object is attained by providing a cartridge including the liquid container having the construction as above, comprising: a printhead which discharges ink contained in the liquid container; and a holder which holds a plurality of the liquid containers.

Preferably, the liquid container is detachable from the holder.

Preferably, the printhead is an ink-jet printhead which performs printing by discharging ink, and the ink-jet printhead which discharges ink by utilizing thermal energy comprises a thermal energy transducer to generate the thermal energy to be applied to the ink.

In accordance with the present invention as described above, as the triangular prism provided on the bottom of the liquid container is long along its lengthwise direction, i.e., a conveyance direction of the print medium in the printing apparatus, when the cartridge carrying the printhead and the liquid container is attached to the printing apparatus to perform printing, even if an error occurs in attachment therebetween, the light emitted from the optical means of the printing apparatus can be precisely captured in the prism.

Further, in a case where a plurality of cartridges each carrying the printhead and the liquid container are mounted on the printing apparatus, by attaching the first cartridge and the second cartridge in positions shifted from each other by a length shorter than the lengthwise directional length of the triangular prism, the light emitted from the optical means of the printing apparatus reaches the prism provided in the liquid container mounted on the first cartridge and also reaches the prism provided in the liquid container mounted on the second cartridge.

According to still another aspect of the present invention, the foregoing object is attained by providing a liquid container comprising: a container containing liquid; a prism made of light-transmitting material, having a first surface to receive light emitted from an external device and a second surface to receive light reflected by the first surface and change an optical path to direct the light toward the external device, provided on a bottom of the container, projecting toward the inside the container from the bottom; and a groove or projection, provided around the prism or on the first and second surfaces of the prism, which absorbs the liquid by capillarity.

Preferably, the prism and the groove or projection is integrally molded with the liquid container.

Preferably, the groove is provided on the bottom of the container so as to surround the prism. Further, it is preferable to arrange such that the container has a first space containing only the liquid and a second space containing absorbent material which absorbs and holds the liquid, and has an outlet for discharging the liquid to the outside on a bottom of the second space, and the prism is provided in the first space, and wherein another groove is further provided to introduce the liquid from the groove to the second space.

Further, it may be arranged such that the groove or projection is provided along end portions of the first and second surfaces.

According to still another aspect of the present invention, the foregoing object is attained by providing a cartridge including the liquid container having the construction as described above, comprising: a printhead which discharges ink contained in the liquid container; and a holder which holds the liquid container.

In accordance with the present invention as described above, when the residual liquid in the liquid container is exhausted, the liquid is quickly removed from the surface of the prism.

According to still another aspect of the present invention, the foregoing object is attained by providing a printing apparatus using the cartridge having the construction as above, which prints an image on a print medium, comprising: optical means for emitting light to the prism and receiving reflection light from the prism; detection means for detecting existence/absence of the liquid contained in the liquid container based on the reflection light received by the optical means; and control means for controlling printing operation by the printhead based on the result of detection obtained by the detection means.

Further, it is preferable that the printing apparatus further comprises: scan means, holding a plurality of the cartridges, for scan-moving; and conveyance means for conveying the print medium, wherein among the plurality of the cartridges, the first cartridge and the second cartridge are mounted on the scan means in positions shifted from each other in a print-medium conveyance direction by the conveyance means, and wherein by movement of the first and second cartridges by the scan means, the light is emitted from the optical means onto the prism of the liquid container mounted on the first cartridge and the prism of the liquid container mounted on the second cartridge.

Preferably, the amount of shift between the first cartridge and the second cartridge is less than the length of the prism in the lengthwise direction. Further, it is preferable that a light emitting device to emit light, and a photoreception device to receive light included in the optical means are arrayed along a scan direction of the scan means.

According to still another aspect of the present invention, the foregoing object is attained by providing a liquid-discharge printing apparatus comprising: a printhead which performs printing by discharging ink; a liquid container which contains the liquid discharged from the printhead; scan means, holding the printhead and the liquid container, for scan-moving; optical means, provided near the scan means, having a light emitter to emit light onto the liquid container and a photoreceptor to receive reflection light of the light; and detection means for detecting existence/absence of the liquid contained in the liquid container, based on the reflection light of the light emitted onto the liquid container, received by the photoreceptor, wherein the liquid container includes an approximately-polygonal prism made of light-transmitting material, having a surface integrated with an external wall surface of the liquid container and a plurality of reflection surfaces, different from the external wall surface, which serve as an interface with respect to the liquid, having a predetermined angle with respect to an optical path of light emitted from the light emitter, and wherein the scan means holds the liquid container such that a lengthwise direction of the prism is diagonal to a scan direction of the scan means.

According to still another aspect of the present invention, the foregoing object is attained by providing an ink tank detachably held on a tank holder, having a movable lever with a first engagement latch to engage with a first engagement hole provided on a side wall of the tank holder and a second engagement latch to engage with a second engagement hole provided on another side wall of the tank holder opposite to the side wall having the first engagement hole, wherein the ink tank has a positioning pin on its bottom surface, and the tank holder has a positioning hole to receive the positioning pin upon attachment of the ink tank to the tank holder, and wherein a prism is provided on an inner bottom of the ink tank such that the prism is positioned opposite to the position of an optical sensor for residual ink detection provided outside of the ink tank when the ink tank is attached to the tank holder, further wherein the prism is provided in a position between the second engagement latch and the positioning pin, further wherein the positioning pin and the positioning hole have thrust portions to thrust upon each other, and the thrust portion of the positioning pin has a flat surface.

In the ink tank, the first engagement latch of the movable lever is engaged with the first engagement hole of the tank holder by utilizing resilience of the movable lever, and wherein the ink tank is attached and fixed to the tank holder by pressing the ink tank, with the second engagement latch engaged with the second engagement hole of the tank holder, against the side wall on which the second engagement hole is provided.

Further, it is preferable that the flat surface is diagonal to a direction in which the ink tank is pressed upon the side wall.

Further, the prism has a first surface to reflect light, from the light emitting unit of the optical sensor, incident on the bottom of the ink tank, and a second surface to further reflect the light reflected by the first surface, to introduce the reflected light into the photoreception unit of the optical sensor outside the ink tank. Preferably, the prism is integrally molded with the ink tank.

According to still another aspect of the present invention, the foregoing object is attained by providing a tank holder which detachably holds an ink tank, having a first engagement hole to engage with a first engagement latch of a movable lever provided on one side surface of the ink tank and a second engagement hole to engage with a second engagement latch provided on another side surface of the ink tank opposite to the side surface having the movable lever, wherein the ink tank has a positioning pin on its bottom surface, and said tank holder has a positioning hole to receive the positioning pin upon attachment of the ink tank to the tank holder, and wherein a prism is provided on an inner bottom of the ink tank such that the prism is positioned opposite to the position of an optical sensor for residual ink detection provided outside of the ink tank when the ink tank is attached to the tank holder, further wherein the prism is provided in a position between the second engagement latch and the positioning pin, further wherein the positioning pin and the positioning hole have thrust portions to thrust upon each other, and the thrust portion of the positioning hole has a flat surface.

In the tank holder, the first engagement latch of the movable lever is engaged with the first engagement hole of the tank holder by utilizing resilience of the movable lever, and wherein the ink tank is attached and fixed to the tank holder by pressing the ink tank, with the second engagement latch engaged with the second engagement hole of the tank holder, against the side surface on which the second engagement hole is provided.

Preferably, in the tank holder, a side surface of the positioning pin is thrusted upon a side surface of the positioning hole of the tank holder by a resilience of the movable lever upon attachment of the ink tank to the tank holder. Further, it is preferable that the thrust portion of the positioning pin and that of the positioning hole have flat surfaces.

Preferably, the flat surface is diagonal to a direction in which the ink tank is pressed upon the side surface.

In accordance with the present invention as described above, the positioning pin is provided on the bottom surface of the ink tank such that when the ink tank is attached to the tank holder, the positioning pin on the bottom surface of the ink tank is received in the positioning hole of the tank holder, thus the position of the ink tank is determined with high precision.

Especially, in the construction for residual ink detection by using the prism on the inner bottom of the ink tank and the sensor provided outside the ink tank, as the ink tank can be positioned with high precision with the above positioning pin, the precision of the residual ink detection can be improved. At this time, by providing the positioning pin near the prism, or thrusting the positioning pin of the ink tank against the positioning hole of the tank holder with plane to plane, the precision of detection can be further improved. As a result, the state where the ink in the ink tank is fully exhausted can be notified to a user with a high precision.

The invention is particularly advantageous since when the cartridge holding the printhead and the liquid container is attached to the printing apparatus to perform printing, even if an error occurs in the attachment therebetween, residual ink detection can be performed with high precision.

Accordingly, even parts and members, manufactured with low precision and assembly precision to cause such error in attachment, can be used for residual ink detection. As a result, precise residual ink detection can be performed at a low cost.

Further, even in a case where a plurality of cartridges each having the printhead and the liquid container are mounted on the printing apparatus, residual ink detection can be performed with respect to two cartridges by using a single optical means.

By this arrangement, the optical means necessary for residual ink detection can be commonly used. Thus, precise residual ink detection can be performed at a low cost.

Further, according to the present invention, when the residual liquid in the liquid container is exhausted, the liquid is quickly removed from the surface of the prism. This arrangement avoids the inconvenience that the viscosity of the liquid changes due to various environmental conditions, is attached to the surface of the prism and remains there. Thus, existence/absence of the liquid can be precisely detected.

Further, as the prism and container as the constituents of the present invention are integrally molded, existence/absence of the liquid can be precisely detected by a simple structure at a low cost.

Further, according to the present invention, as the positioning pin is provided on the bottom surface of the ink tank, and the positioning hole is provided in the tank holder so as to receive the positioning pin on the bottom surface of the ink tank when the ink tank is attached to the tank holder, the positional precision of the ink tank upon attachment can be improved, and further, the detection precision in the residual ink detection construction can be improved.

Further, in the construction for performing residual ink detection, the positioning pin is provided near the prism so as to ensure positional precision of the prism. Further, by providing the prism in a position between the second engagement latch as an engaging support upon attachment of the ink tank and the positioning pin, the distance between the second engagement latch and the prism is shortened, thus the positional precision of the prism can be improved in a horizontal rotational direction with respect to the second engagement latch as the rotational center.

Further, by thrusting the positioning pin of the ink tank against the positioning hole of the tank holder with plane to plane, the precision of residual ink detection is further improved. As a result, a state where the ink in the ink tank is fully exhausted can be notified to the user with high precision.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Common Embodiment>

First, a printing apparatus commonly used in the following embodiments and a controller of the printing apparatus will be described.

Figure 1A:
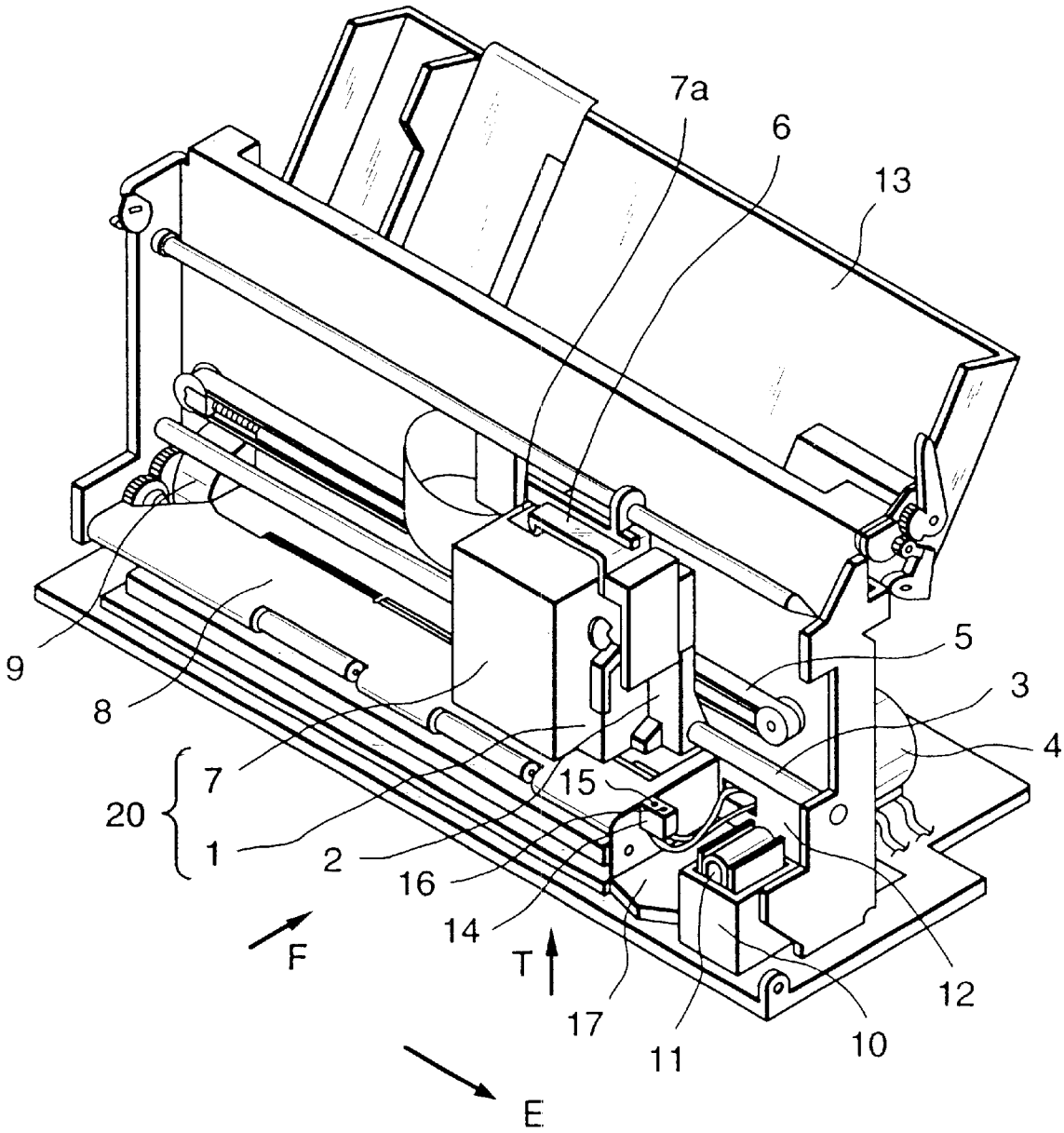
FIGS. 1A and 1B are perspective views schematically showing the structure of a printing apparatus, as a typical embodiment of the present invention, having a printhead which performs printing in accordance with an ink-jet method.
Figure 1B:
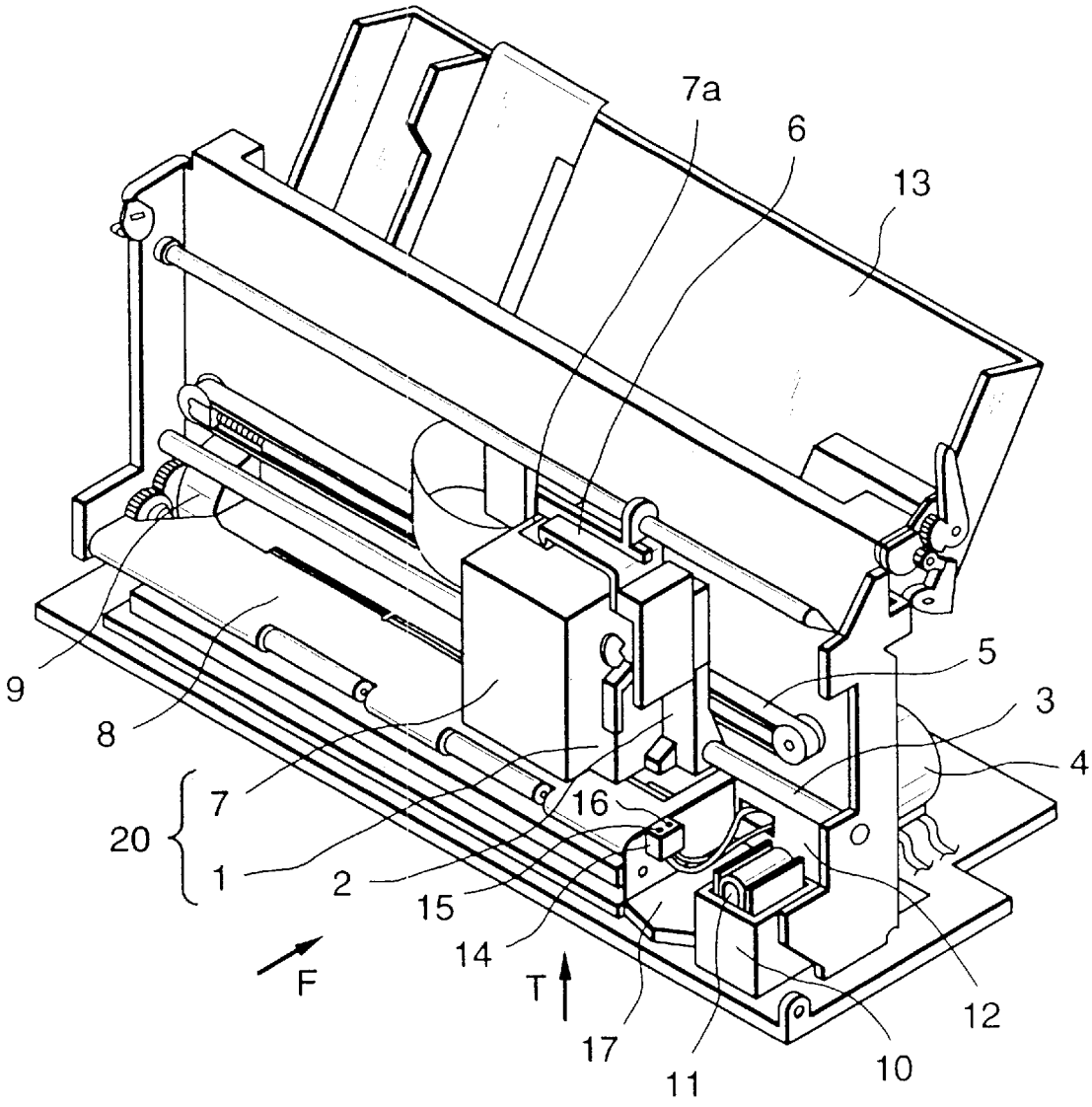

FIGS. 1A and 1B are perspective views schematically showing the structure of a printing apparatus, as a typical embodiment of the present invention, which includes a printhead for performing printing in accordance with an ink-jet printing method. In the present embodiment, a printhead 1 connected to an ink tank 7 which supplies ink thereto, constructs an ink cartridge 20 as shown in FIGS. 1A and 1B. Note that in the present embodiment, although the ink cartridge 20 is configured such that the printhead 1 and the ink tank 7 can be separated as will be described later, an ink cartridge where a printhead and an ink tank are integrated may be used.

Further, an optical prism for residual ink detection is provided on the bottom surface of the ink tank 7. The construction thereof will be described later.

Furthermore, among ink-jet head printing methods, the printhead of this method particularly comprises means for generating thermal energy (e.g., electrothermal transducer or laser) to be used for ink discharge. High density and high precision printing is attained by using the method to cause change in ink state by the thermal energy.

In FIGS. 1A and 1B, the printhead 1 is mounted on a carriage 2 in the manner such that the printhead discharges ink downward in these figures. While the carriage 2 moves along a guide shaft 3, the printhead 1 discharges ink droplets to form an image on a print medium (not shown) such as a print sheet. Note that the lateral movement (reciprocating movement) of the carriage 2 is realized by rotation of a carriage motor 4 via a timing belt 5. The carriage 2 has an engagement latch 6 which engages with an engagement slot 7*a* of the ink tank, fixing the ink tank 7 to the carriage 2.

Upon completion of printing for one scan by the printhead, the printing operation is suspended, then a print medium positioned on a platen 8 is conveyed by a predetermined amount by driving a feed motor 9, and image forming for the subsequent scan is performed by moving the carriage 2 along the guide shaft 3.

On the right side of the printing apparatus main body, a recovery device 10 which performs recovery operation for maintaining a good ink discharge condition is provided. The recovery device 10 includes a cap 11 for capping the printhead 1, a wiper 12 for wiping the ink discharge surface of the printhead 1, and a suction pump (not shown) for sucking ink from the ink discharge nozzle of the printhead 1.

The driving force of the feed motor 9 for conveying the print medium is transmitted not only to the print medium conveyance mechanism, but also to an automatic sheet feeder (ASF) 13.

Further, on the side of the recovery device 10, an optical unit 14, consisting of an infrared LED (light emitting device) 15 and phototransistor (photoreception device) 16, is provided for residual ink detection. In FIG. 1A, these light emitting device 15 and photoreception device 16 are arrayed in the moving direction of the carriage 2 (arrow E direction), but in FIG. 1B, arrayed in the conveyance direction of the print sheet (arrow F direction). In these arrangements, the optical unit 14 is attached to a chassis 17 of the printing apparatus main body. One of the arrangements in FIG. 1A and FIG. 1B is selected in accordance with the structure of a prism described in the following embodiments. When the ink cartridge 20 is mounted on the carriage 2 and the carriage 2 moves to the right from the position shown in FIGS. 1A and 1B, the ink cartridge 20 comes to a position above the optical unit 14. In this position, existence/absence of ink can be detected from the bottom of the ink tank 7 by the optical unit 14 (details will be described later).

Next, the construction for executing print control of the above-described apparatus will be described.

Figure 2:
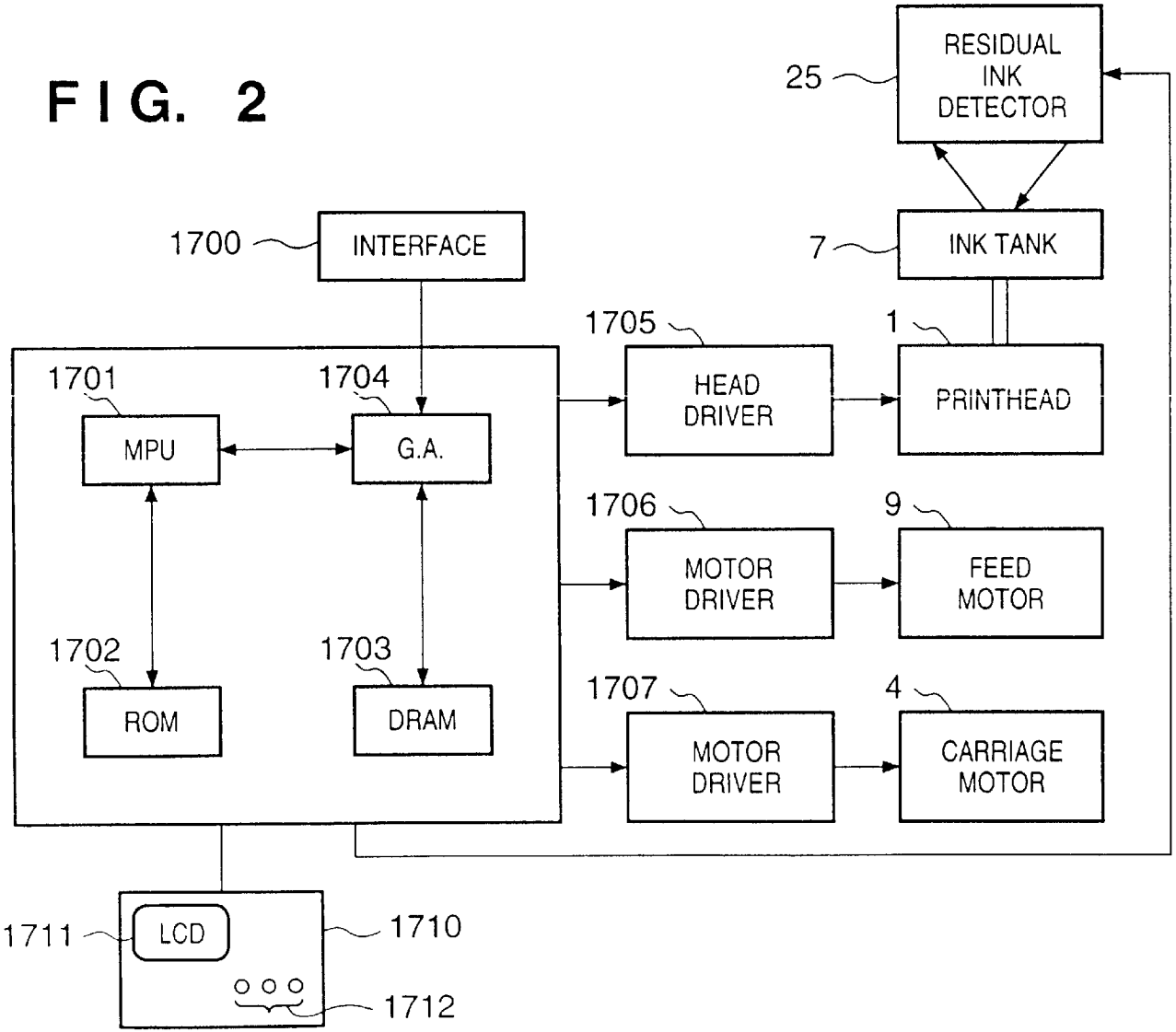
FIG. 2 is a block diagram showing the construction of a controller of the printing apparatus.

FIG. 2 is a block diagram showing the structure of a controller of the printing apparatus.

In FIG. 2, reference numeral 1700 denotes an interface for inputting a print signal; 1701, an MPU; 1702, a ROM for storing control programs to be executed by the MPU 1701; and 1703, a DRAM for storing various data (aforementioned print signal, print data supplied to the printhead 1 and the like). Reference numeral 1704 denotes a gate array (G.A.) which controls print data supply to the printhead 1, and also control data transfer among the interface 1700, MPU 1701 and RAM 1703. Reference numeral 1705 denotes a head driver for driving the printhead 1; 1706 and 1707, motor drivers for driving the feed motor 9 and carriage motor 4 respectively.

The operation of the foregoing control structure will now be described. When the interface 1700 receives a print signal, the print signal is converted to print data for printing between the gate array 1704 and the MPU 1701. Then, as the motor drivers 1706 and 1707 are driven, and the printhead 1 is driven in accordance with the print data transmitted by the head driver 1705, thus performing printing.

Note that reference numeral 1710 denotes a display unit comprising an LCD 1711 which displays various messages related to conditions of printing operation and the printing apparatus, and an LED lamp 1712 of various colors for informing the conditions of printing operation and the printing apparatus.

Further, the MPU 1701 controls the operation of an residual ink detector 25 which detects existence/absence of ink in the ink tank 7 integrated with the printhead 1. The residual ink detector 25 will be described later in detail.

Figure 3B:
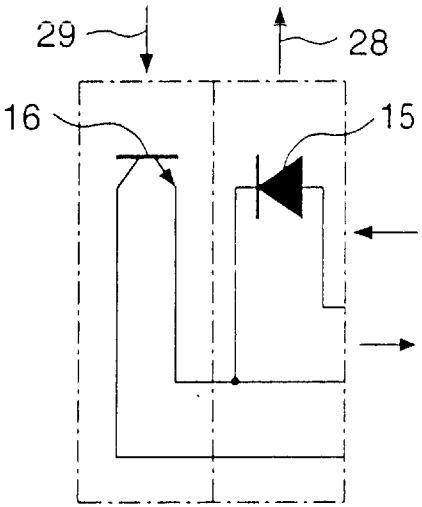
FIGS. 3A and 3B are block diagrams showing the detailed construction of a residual-ink detector 25.
Figure 3A:
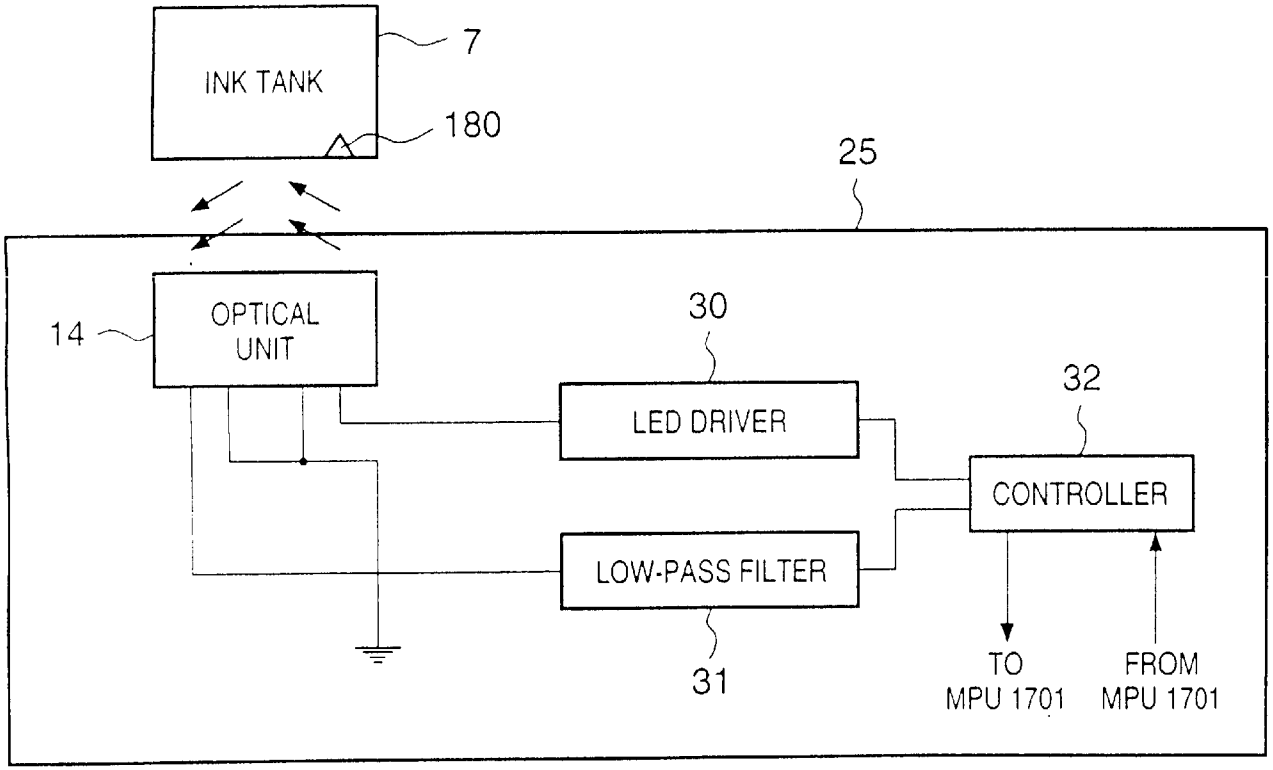

FIGS. 3A and 3B are block diagrams showing the detailed construction of the residual ink detector 25.

In the construction in FIG. 3A, a controller 32 outputs a pulse signal in a predetermined duty ratio (%) to an LED driver 30 based on a control signal from the MPU 1701, to drive the light emitting device 15 of the optical unit 14 in accordance with the duty ratio, to emit infrared light to the bottom of the ink tank 7.

The infrared light is reflected by an optical prism (hereinbelow, referred to as "prism") 180 on the bottom, of the ink tank 7, and returned to the photoreception device 16 of the optical unit 14. The photoreception device 16, which is a photo transistor, converts the received light into an electric signal, and outputs the electric signal to a low-pass filter (LPF) 31. The low-pass filter (LPF) 31 cuts high-frequency noise in the electric signal inputted from the photoreception device 16, and sends only a low frequency signal to the controller 32. The controller 32 A/D-converts the signal from the low-pass filter (LPF) 31 into a digital signal. The converted value is transferred to the MPU 1701.

Note that as shown in FIG. 3B, the light emitting device 15 is an LED which emits infrared light 29. The photoreception device 16 is a photo transistor which receives the infrared light 29 and outputs an electric signal in accordance with the intensity of received light. The LED and the photo transistor are arrayed along the moving direction of the carriage 2 or the conveyance direction of the print sheet, as shown in FIGS. 1A and 1B.

Next, the respective embodiments will be described in detail.

<First Embodiment>

Next, the outline of the ink tank, to which the present invention is preferably applicable, will be described with reference to FIGS. 4A and 4B and FIG. 5.

Figure 4A:
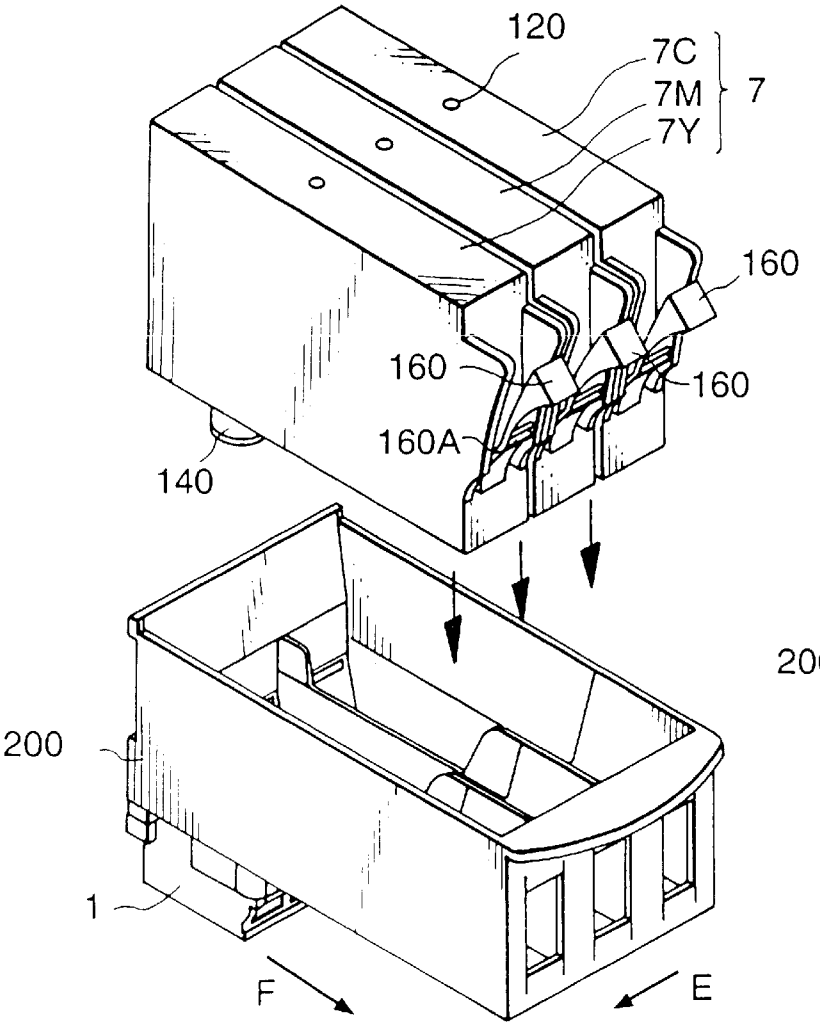
FIGS. 4A and 4B are perspective views showing a tank holder 200 having an ink tank 7 and a printhead 1.
Figure 4B:
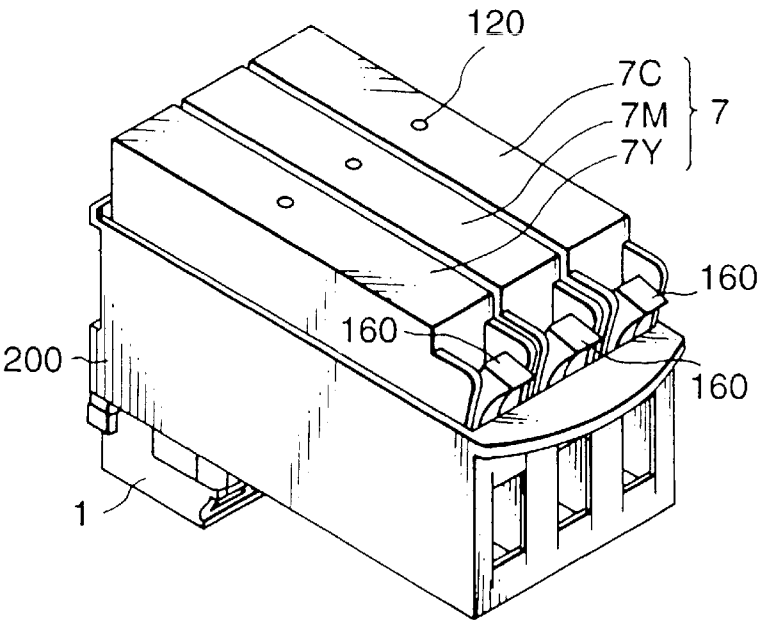

FIGS. 4A and 4B are perspective views showing an external appearance of a tank holder 200 holding the ink tank 7 and the printhead 1. FIG. 4A shows a state where the ink tank 7 is detached from the tank holder 205, while FIG. 4B shows a state where the ink tank 7 is attached to the tank holder 200. Note that the head holder having the ink tank and the printhead may be generally called a head cartridge.

Figure 5:
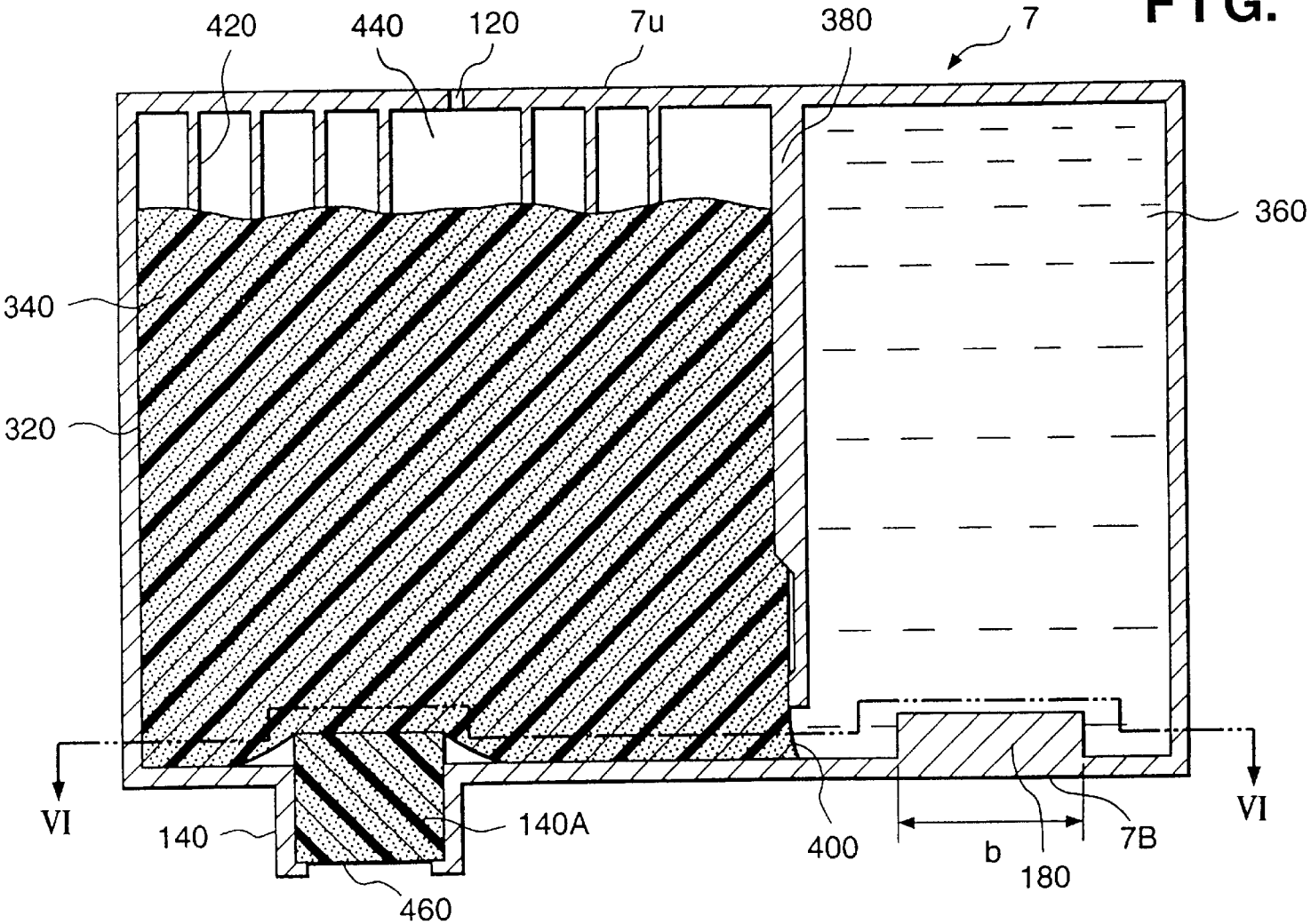
FIG. 5 is a cross-sectional view showing the internal structure of the ink tank 7.

FIG. 5 is a side cross-sectional view showing the internal structure of the ink tank 7.

The ink tank 7 according to the present embodiment has an approximately rectangular parallelepiped shape, and has an atmospheric-air communicating hole 120, which communicates with the inside of the ink tank 7, on an upper wall 7U.

Further, an ink supply pipe 140 having an ink supply orifice 140A of a projecting cylindrical shape is formed on a bottom wall 7B of the ink tank 7. In the shipping process, the atmospheric-air communicating hole 120 is sealed with a film or the like, and the ink supply pipe 140 is sealed with a cap which is an ink-supply opening sealing material.

Reference numeral 160 denotes a resilient lever formed integrally on the outer portion of the ink tank 7, and an engagement latch 160A is provided in the middle of the lever.

Reference numeral 200 denotes a tank holder integrating a printhead, where the aforementioned ink tank 7 is to be attached. In the present embodiment, ink tanks 7 (7C, 7M and 7Y), each having ink of cyan (C), magenta (M) and yellow (Y) colors, are held in the tank holder 200. On the bottom of the tank holder 200, the printhead 1 which discharges the respective color ink is integrally formed. A window is provided on the bottom of the tank holder 200 such that an existence/absence detection unit to be described later, in cooperation with the optical unit 14 and the residual ink detector 25, can detect existence/absence of residual ink.

The printhead 1 is formed such that its plural discharge orifices face downward (hereinafter the surface of the printhead having the plural discharge orifices will be referred to as "discharge-orifice surface").

From the state shown in FIG. 4A, the ink tank 7 is pressed into the tank holder 200 such that the ink supply pipe 140 is engaged with an ink supply pipe receptor (not shown) provided in the printhead 1 and an ink passage pipe of the printhead 1 is inserted into the ink supply pipe 140. Then, the engagement latch 160A of the lever 160 engages with an engagement hole (not shown) formed in a predetermined portion of the tank holder 200, and the ink tank 7 is properly inserted in the tank holder 200 as shown in FIG. 4B. The head-integrated tank holder 200 holding the ink tank 7 is mounted on the carriage 2 of the printing apparatus as shown in FIG. 1A, for example, and become ready for printing. In this state, there is a liquid level difference (H) between the level of liquid on the bottom portion of the ink tank 7 and the level of liquid on the discharge-orifice surface of the printhead 1.

Next, the internal structure of the ink tank 7 will be described with reference to FIG. 5. The ink tank 7 according to the present embodiment lets air in through the atmospheric-air communicating hole 120 provided on the ceiling portion of the ink tank, and the bottom portion of the ink tank 7 is connected to the ink supply orifice 140A. In the ink tank 7, an absorbent material accommodating chamber 340 including an absorbent material 320 serving as a negative-pressure generating member, and a substantially airtight-closed ink chamber 360 containing liquid ink are separated by a partition wall 380. The absorbent material accommodating chamber 340 and ink chamber 360 are connected only through a communicating path 400 of the partition wall 380 formed near the bottom of the ink tank 7.

On the upper wall 7U of the ink tank 7 which forms the absorbent material accommodating chamber 340, a plurality of ribs 420 projected into the ink tank 7 are integrally formed, and the ribs are in contact with the absorbent material 320 compressed and housed in the absorbent material accommodating chamber 340. Thus an air buffer chamber 440 is formed between the upper wall 7U and the top surface of the absorbent material 320. The absorbent material 320 is formed with heat-compressed urethane foam, and compressed and housed in the absorbent material accommodating chamber 340, so as to produce a predetermined capillarity, as will be described later. An absolute value of the pore size of the absorbent material 320 for producing the predetermined capillarity differs depending on the type of ink, dimension of the ink tank 7, position of the discharge-orifice surface of the printhead 1 (liquid level difference H) and the like.

In the ink supply pipe 140 forming the ink supply orifice 140A, a cylindrical-shape ink inducing element (ink inducing element) 460 is provided. The ink inducing element 460 is formed with a felt of e.g. polypropylene, and is not deformed easily by an external force. In the state shown in FIG. 4A where the ink tank is not attached to the tank holder 200, the ink inducing element 460 is press-inserted in the absorbent material 320 so as to locally compress the absorbent material 320. Therefore, at the upper end portion of the ink supply pipe 140 a flange in contact with the peripheral portion of the ink inducing element 460 is formed.

In the ink tank having the above-described construction, when ink absorbed by the absorbent material 320 is consumed by the printhead 1 (not shown), ink is supplied to the absorbent material 320 in the absorbent material accommodating chamber 340 from the ink chamber 360 through the communicating path 400 of the partition wall 380. At this time, although the pressure inside of the ink chamber 360 is reduced, air from the atmospheric-air communicating hole 120, coming through the absorbent material accommodating chamber 340, is supplied to the ink chamber 360 through the communicating path 400 provided on the partition wall 380, and the reduced pressure in the ink chamber 360 is compensated. Therefore, even if ink is consumed by the printhead 1, ink is provided to the absorbent material 320 in accordance with the consumed amount, enabling the absorbent material 320 to keep a constant amount of ink and maintain a substantially constant negative pressure to the printhead 1. Accordingly, stable ink supply to the printhead is maintained. As the ink absorbed by the absorbent material 320 is consumed, the ink in the ink chamber 360 is consumed.

Accordingly, as the prism 180 as a part of the residual ink detection mechanism is provided in the ink chamber 360 of the ink tank, and the shortage of ink in the ink chamber 360 is notified to a user and let the user to exchange the tank for new one, the printing apparatus can be used without concern of ink shortage.

As shown in FIG. 4A, the tank holder 200 having the above construction is attached to the carriage 2 such that the lengthwise direction of the tank holder corresponds to the arrow F direction in FIG. 1A (the print-medium conveyance direction) and the widthwise direction of the tank holder corresponds to the arrow E direction in FIG. 1A (the carriage moving direction). As it is apparent from these figures, the ink tank has a flat shape, and is attached to the tank holder 200 such that a flat shaped surface of the ink tank is diagonal to the scanning direction of the carriage 2.

Next, a characteristic feature of the prism for residual ink detection using the ink tank and the printing apparatus having the above construction will be described in detail.

Figure 6:
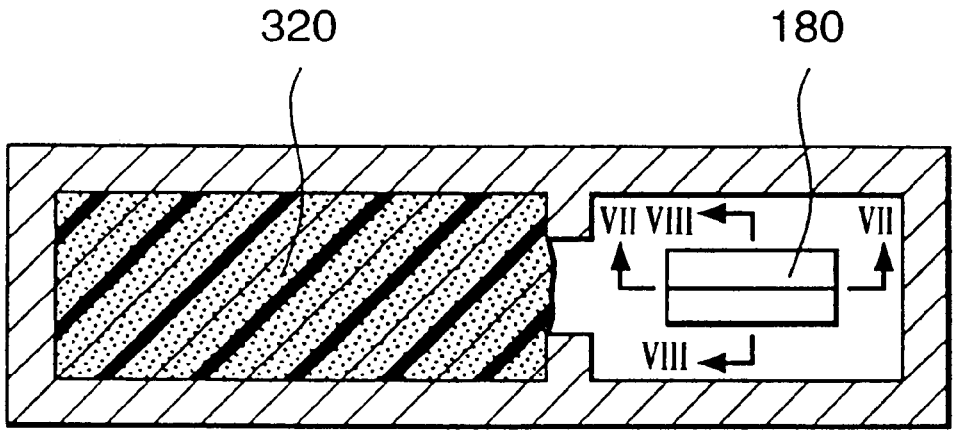
FIG. 6 is a cross-sectional view showing the bottom of the ink tank 7 cut along a line VI—VI in FIG. 5.
Figure 7:
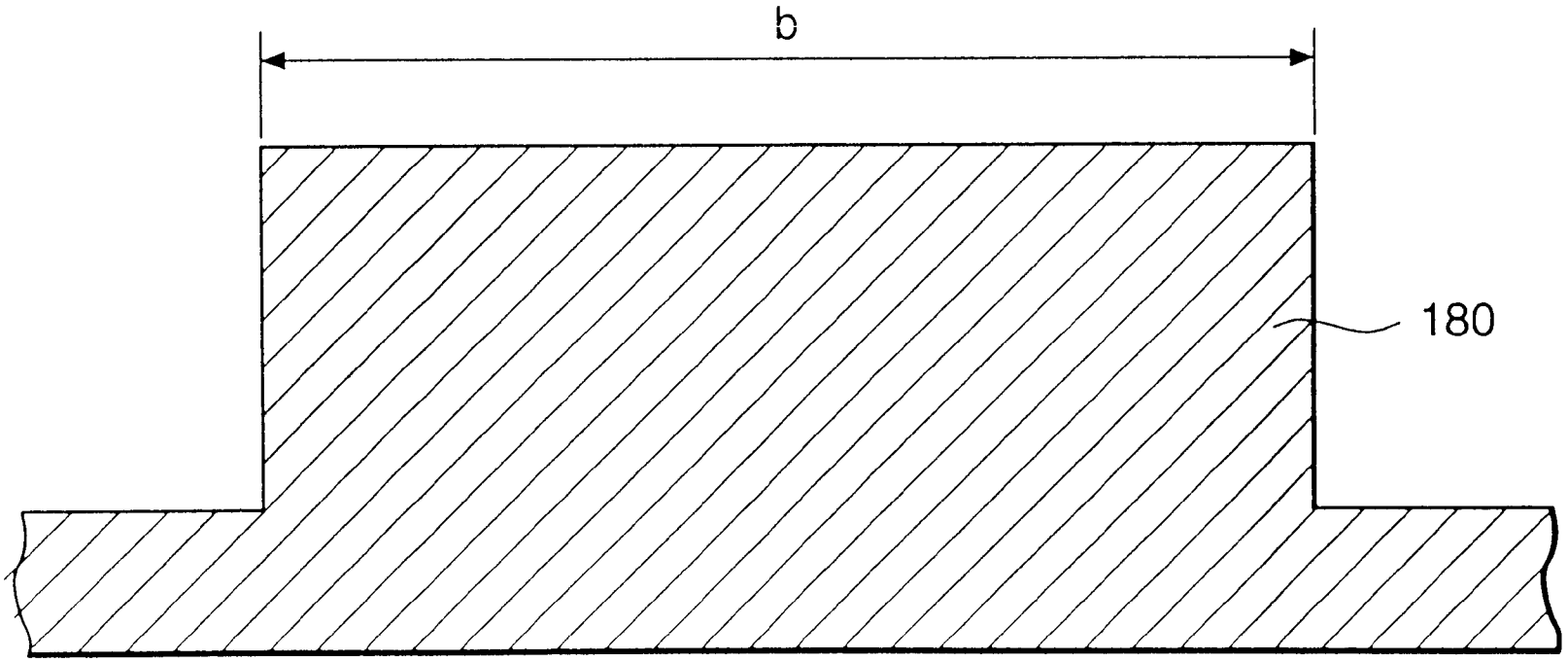
FIG. 7 is a cross-sectional view of a prism 180 cut along a line VII—VII in FIG. 6.
Figure 8:
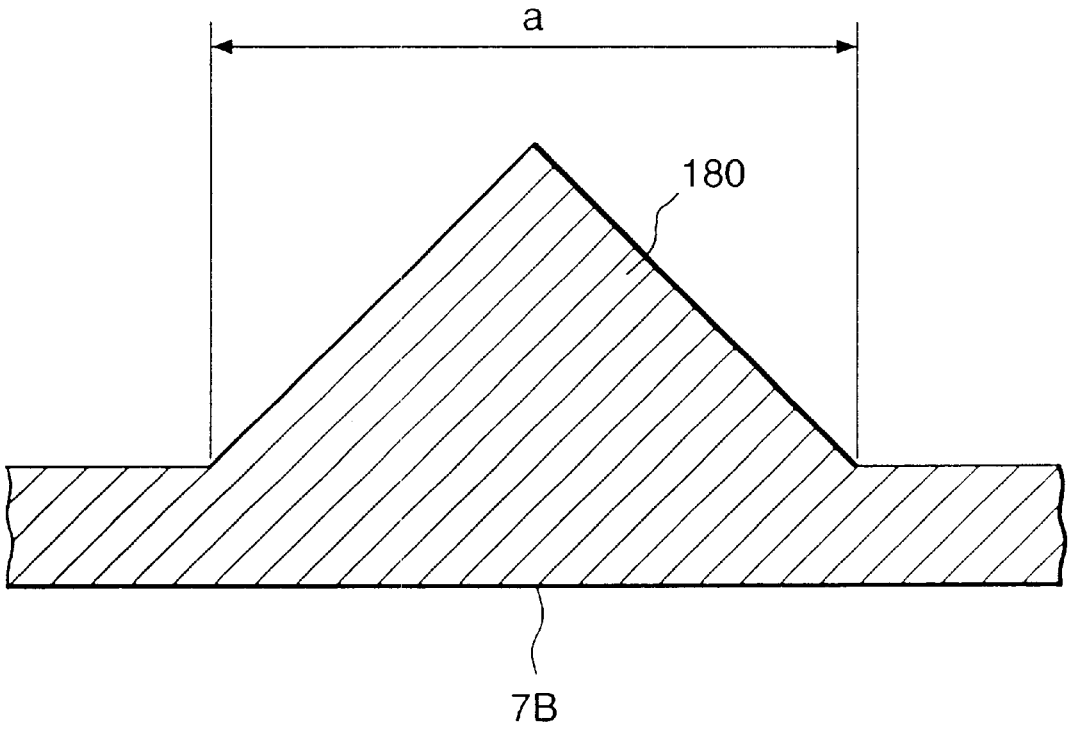
FIG. 8 is a cross-sectional view of the prism 180 cut along a line VIII—VIII in FIG. 6.

FIG. 6 is a cross-sectional view showing the bottom of the ink tank 7 cut along a line VI—VI in FIG. 5. FIG. 7 is a cross-sectional view of the prism 180 cut along a line VII—VII in FIG. 6. FIG. 8 is a cross-sectional view of the prism 180 cut along a line VIII—VIII in FIG. 6.

As it is understood from these figures, the prism 180 cut along the line VI—VI in FIG. 6 has a rectangular cross section, and the prism 180 cut along the line VIII—VIII in FIG. 6 has a right isosceles triangle cross section. Further, as it is understood from FIGS. 7 and 8, the bottom of the prism 180 is integrally molded with the bottom surface of the ink tank. Further, the prism 180 has slopes mirror-processed for excellently reflecting light incident from the light emitting device 15.

Further, as it is understood from FIGS. 7 and 8, the length of the bottom of the prism 180 integrated with the bottom surface 7B of the ink tank, i.e., the base of the isosceles triangle is denoted by a, and the depth of the prism 180 is denoted by b.

Figure 9:
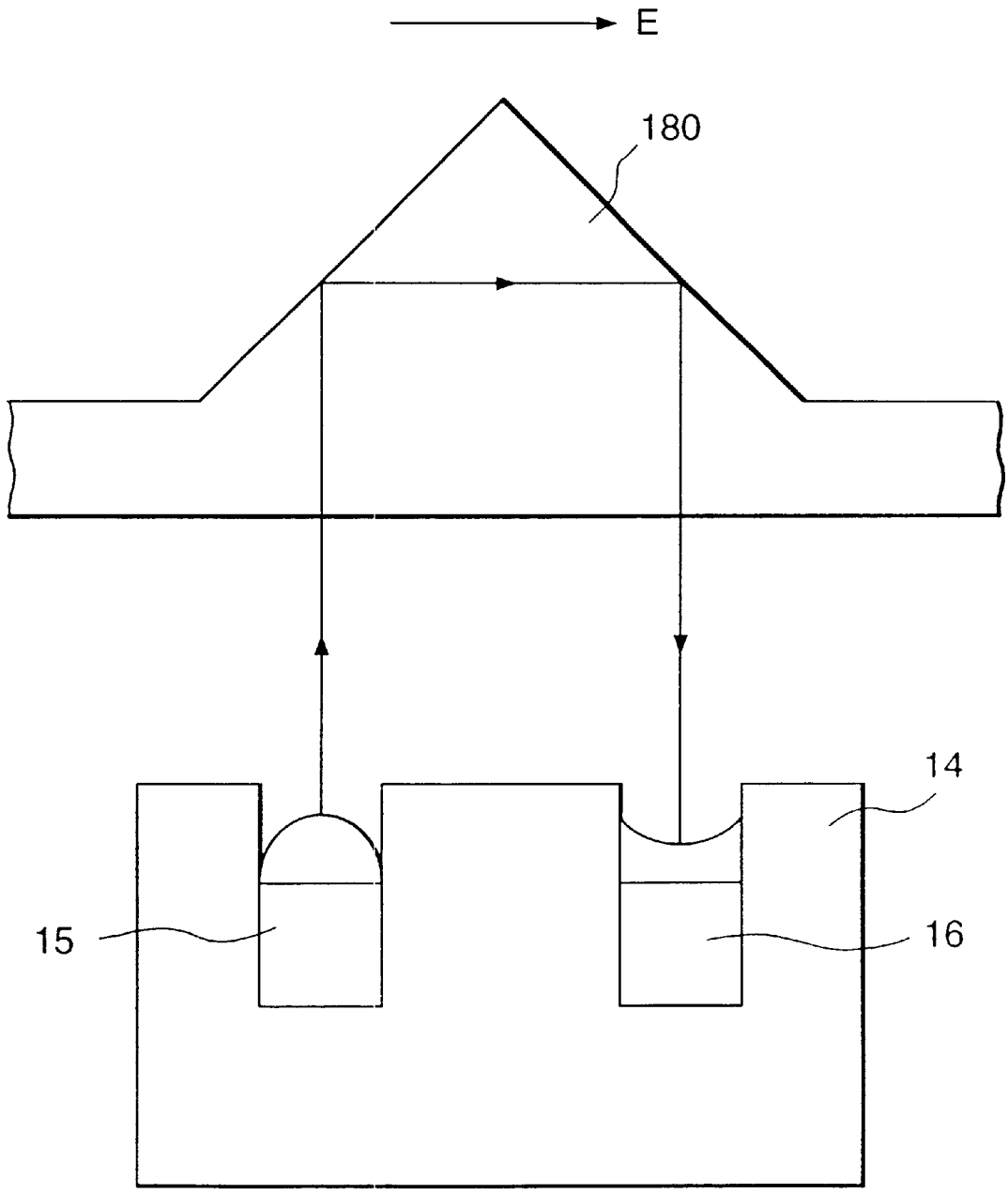
FIG. 9 is an explanatory view showing the positional relation between a cross-sectional view of the prism 180 cut along the line VIII—VIII in FIG. 6 and an optical unit 14.

FIG. 9 is an explanatory view showing the positional relation between~a cross-sectional view of the prism cut along the line VIII—VIII in FIG. 6 and the optical unit 14.

When the carriage 2 moves in the scanning direction (the arrow E direction) on the guide shaft 3, the optical unit 14 is positioned immediately below the prism 180 as shown in FIG. 9. As the ink tank 7 moves in the carriage moving direction, the ink tanks 7C, 7M and 7Y arranged as shown in FIGS. 4A and 4B sequentially pass around immediately above the optical unit 14, in the positional relation with the optical unit 14 as shown in FIG. 9.

In this positional relation as above, if ink in the ink tank is exhausted, light emitted from the light emitting device 15 is reflected by the slope of the prism 180 and returned to the photoreception device 16. The MPU 1701 inputs a detection signal at this time and determines existence/absence of ink.

Figure 10:
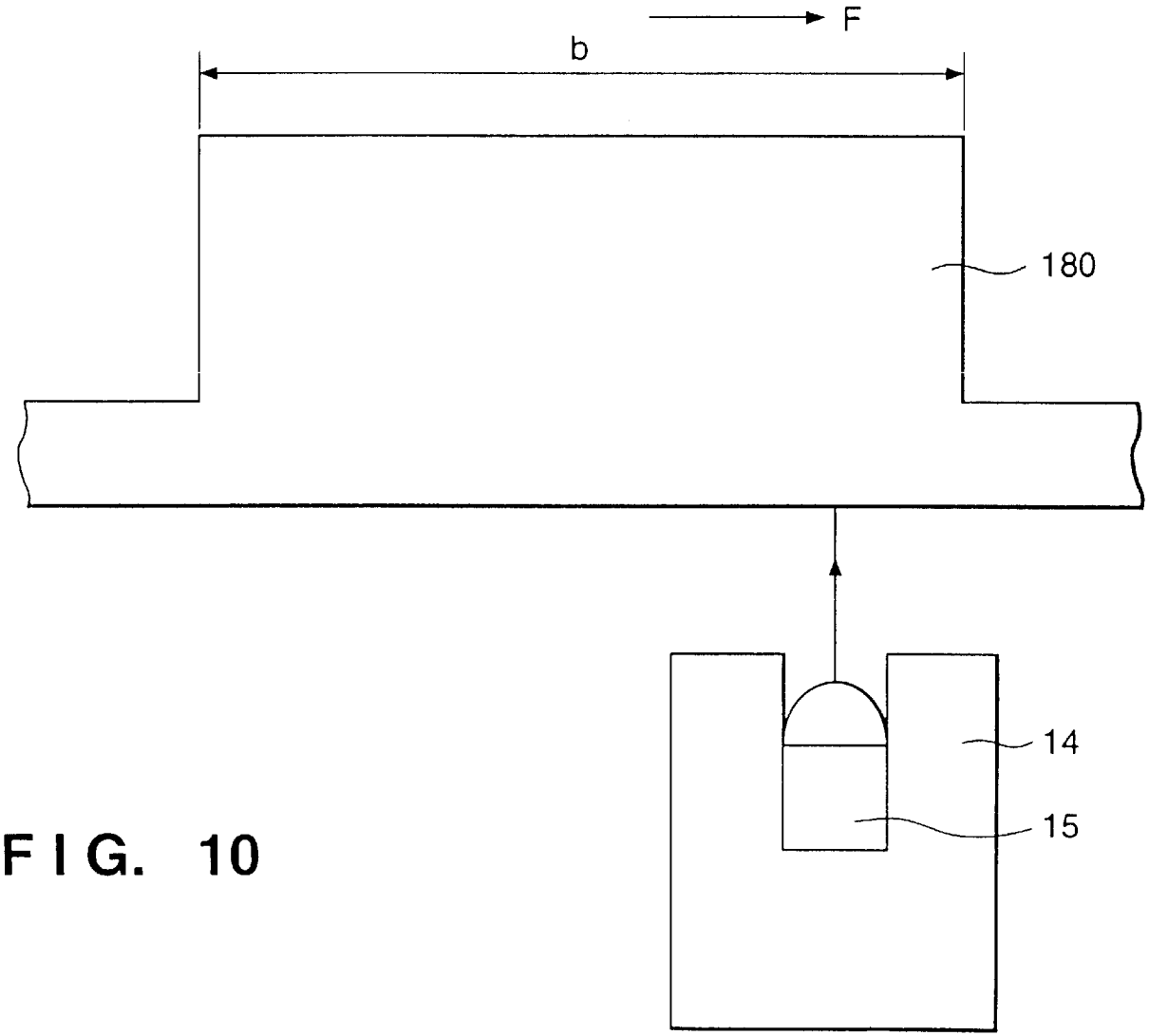
FIG. 10 is an explanatory view showing the positional relation between a cross-sectional view of the prism 180 cut along the line VII—VII in FIG. 6 and a light emitting device 15 of the optical unit 14.
Figure 11:
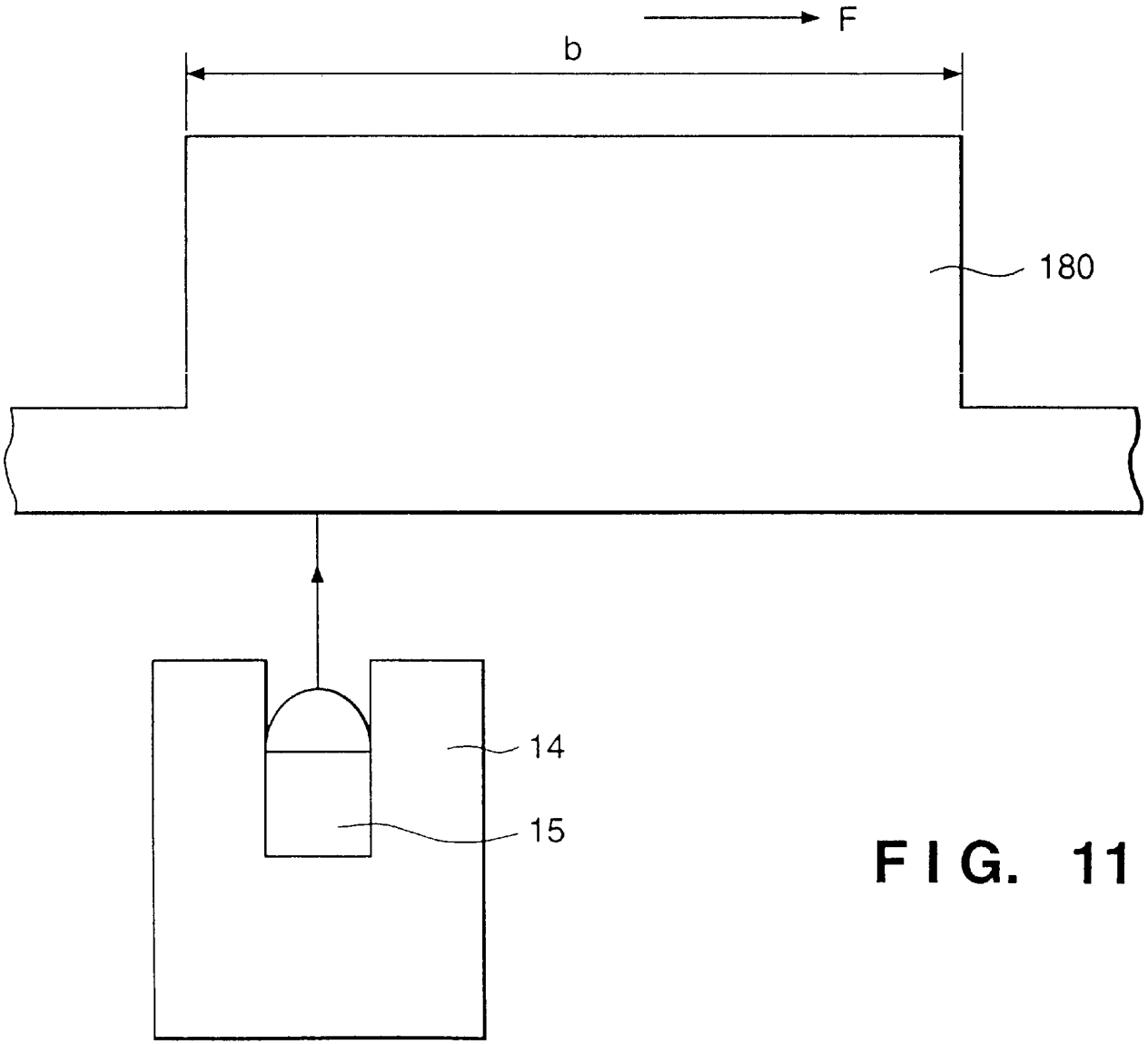
FIG. 11 is an explanatory view showing the positional relation between a cross-sectional view of the prism 180 cut along the line B–B' in FIG. 6 and the light emitting device 15 of the optical unit 14.

FIGS. 10 and 11 are explanatory views showing the positional relation between a cross-sectional view of the prism 180 cut along the line VII—VII in FIG. 6 and the light emitting device 15 of the optical unit 14.

As it is understood from FIGS. 10 and 11, the lengthwise direction of the prism 180 and the lengthwise direction of the ink tank are parallel to each other. Further, as the wide surface of the ink tank is diagonal to the scanning direction of the carriage 2 as shown in FIG. 4, the lengthwise direction of the prism 180 is diagonal to the reciprocating moving direction of the carriage 2. Accordingly, as the prism 180 has the length "b" in the recording medium conveyance direction (the arrow F direction), even when the ink tank 7 with the prism 180 is attached to the tank holder 200 with a certain error or the tank holder 200 is attached to the carriage 2 with a certain error, as long as the attachment error is within the lengthwise direction "b" of the prism 180, light emitted from the light emitting device 15 of the optical unit 14 is captured by the prism 180, and reflection light can be returned to the In the present embodiment, as the dimensions of the prism 180, the length (a) of the base of the right isosceles triangular cross section cut along the line VII—VII is 6.4 mm, and the length (b) of the rectangular cross section cut along the line VI—VI is 7.0 mm.

It may be arranged such that two tank holders as shown in FIGS. 4A and 4B can be mounted on the carriage 2. In this case, these two tank holders are attached to positions a little shifted from each other in the recording medium conveyance direction (the arrow F direction in FIG. 1A).

Figure 12:
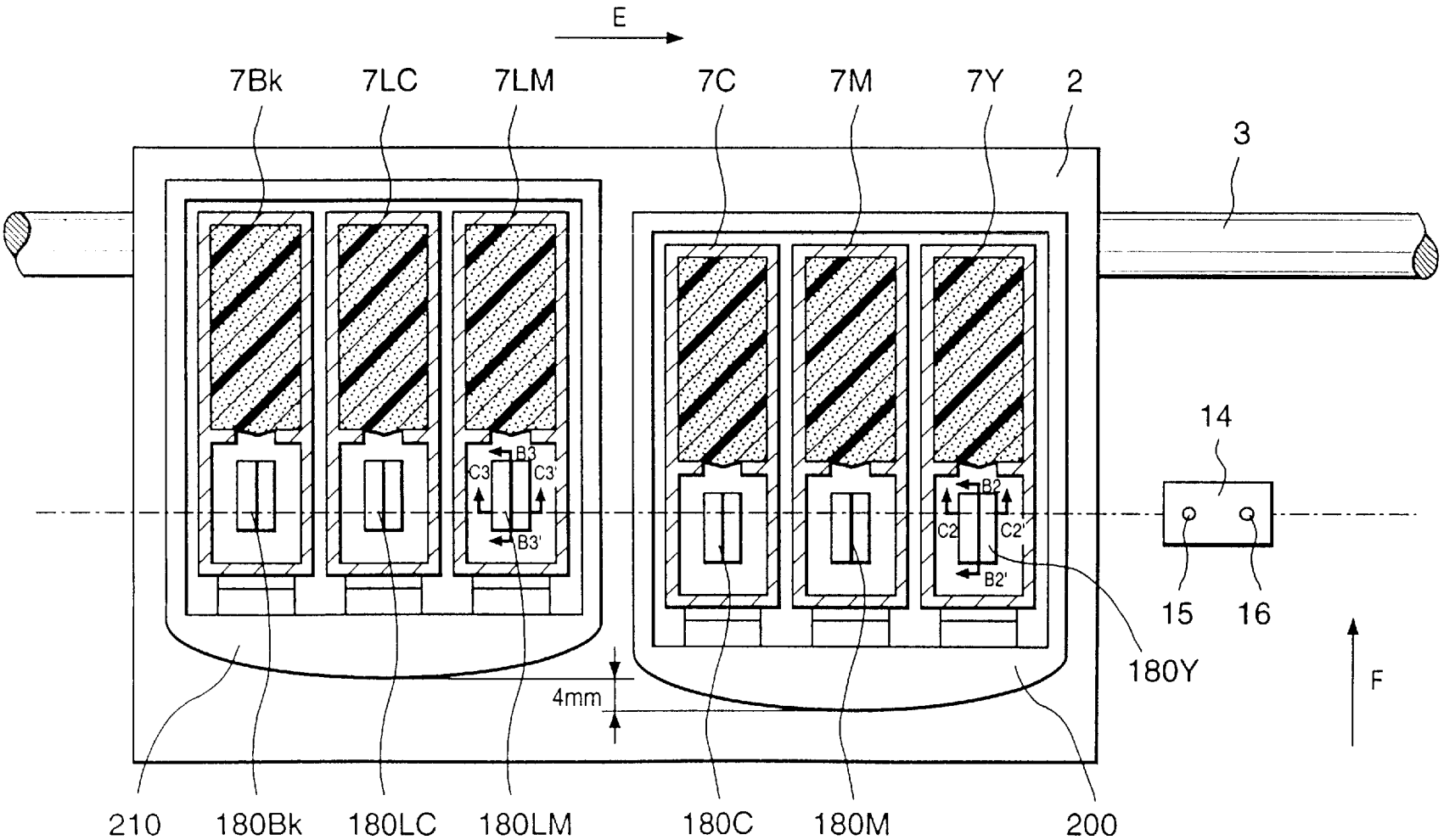
FIG. 12 is a top plan view of a carriage 2 to which two tank holders 200 and 210 are attached.

FIG. 12 is a top plan view of a carriage 2 to which two tank holders 200 and 210 are attached. Note that in FIG. 12, the tank holders 200 and 210 have the same structure. Further, FIG. 12 shows the ink tanks (7C, 7M, 7Y, 7LC, 7LM and 7Bk) attached to the respective tank holders as cross-sections as shown in FIG. 6, for clearly indicating positions of the prisms. The prism provided in each ink tank has the structure as shown in FIGS. 6 to 8.

Further, in FIG. 12, the tank holders 200 and 210 are attached in positions shifted from each other by about 4 mm in the print sheet conveyance direction (the arrow F direction). The tank holders 200 and 210 are shifted from each other since the positions of printheads are shifted from each other so as to avoid ink mixture on a print medium by simultaneous discharge of 6-color ink (C (cyan), M (magenta), Y (yellow), LC (light cyan), LM (light magenta) and Bk (black)) contained in the ink tanks 7C, 7M, 7Y, 7LC, 7LM and 7Bk onto the print medium, by shifting discharge timing of three color ink (C, M and Y) and that of another three color ink (LC, LM and Bk) from each other.

Accordingly, in accordance with the above discharge timing shift, the position of the tank holder holding the ink tanks 7C, 7M and 7Y and that of the tank holder holding the ink tanks 7LC, 7LM and 7Bk are shifted from each other.

However, as shown in FIG. 12, when the carriage 2 moves on the guide shaft 3 in the scanning direction (the arrow E direction), on both tank holders, the prisms (180C, 180M, 180Y, 180LM, 180LC and 18OBk) provided in the respective ink tanks sequentially pass around immediately above the optical unit 14, thus existence/absence of ink can be detected with respect to the respective ink tanks.

For example, when the ink tank 7Y is positioned immediately above the optical unit 14, the cross section of the prism 180Y cut along a line B2–B2' is in positional relation with the optical unit 14 as shown in FIG. 10. Further, when the ink tank 7LM is positioned immediately above the optical unit 14; the cross section of the prism 180LM cut along a line B3–B3' is in positional relation with the optical unit 14 as shown in FIG. 11. Further, when the ink tank 7Y or the ink tank 7LM is positioned immediately above the optical unit 14, the cross section of the prism 180Y or the prism 180LM cut along a line C2–C2' or a line C3–C3' is in positional relation with the optical unit 14 as shown in FIG. 9.

Accordingly, when the carriage 2 moves in its scanning direction (the arrow E direction) along the guide shaft 3, the optical unit 14 is positioned right-hand below the ink tanks 7C, 7M and 7Y as shown in FIG. 10, while the optical unit 14 is positioned left-hand below the ink tanks 7LC, 7LM and 7Bk as shown in FIG. 11. Each of the ink tanks 7C, 7M, 7Y, 7LC, 7LM and 7Bk enters the positional relation as shown in FIG. 9 when it passes about immediately above the optical unit 14.

Accordingly, if ink in the ink tank is exhausted, as light emitted from the light emitting device 15 is reflected by the slope of the prism and returned to the photoreception device 16, the MPU 1701 read a detection signal at this time and determines existence/absence of ink.

As described above, in the present embodiment, as the length of the prism with regard to the print-medium conveyance direction (the arrow F direction) is 7.0 mm, and this value is longer than the shift amount (4 mm) between the tank holders 200 and 210 in the conveyance direction (the arrow F direction), light reflected from the prisms in the ink tanks respectively mounted on two tank holders can be detected by using a single optical unit 14.

According to the present embodiment, by forming the prism used for residual ink detection so as to have a sufficient length in the print-medium conveyance direction, even if there is a certain error in attachment of the ink tank having the prism to the tank holder or attachment of the tank holder to the carriage, or even if there is variation in manufacturing errors of respective parts, light emitted from the optical unit can be captured by the prism. Thus, even if the precision of processing/manufacturing and the precision of assembling of the parts and the precision of attachment are not so high, residual ink detection can be precisely performed.

By this construction, as very high precision is not required in the respective parts, the cost of manufacturing the parts can be reduced while precise residual ink detection is performed.

Further, in a case where two tank holders holding ink tanks each having the above prism are mounted on the carriage shifted from each other by a small distance by setting the distance to be shorter than the length of the prism in the print-medium conveyance direction, the optical unit to emit light for residual ink detection can be commonly used with respect to the respective ink tanks held by the two tank holders.

This reduces the manufacturing cost of the apparatus.

Further, as the above advantage can be attained only by forming the prism used for residual ink detection to have a sufficient length in the print-medium conveyance direction, the construction is very simple, and therefore ensures high reliability.

Note that in the above-described embodiment, the length of the prism used for residual ink detection has a sufficient length in the print-medium conveyance direction, however, to form this prism, it is necessary to carefully select material of the prism and manufacture a mold with sufficiently high precision.

Accordingly, to increase freedom of selection of material of the prism, or to further reduce the production cost by reducing the precision of the mold, it may be arranged as a modification of the embodiment such that the prism is divided in the print-medium conveyance direction.

[First Modification (FIGS. 13 and 14)]

Figure 13:
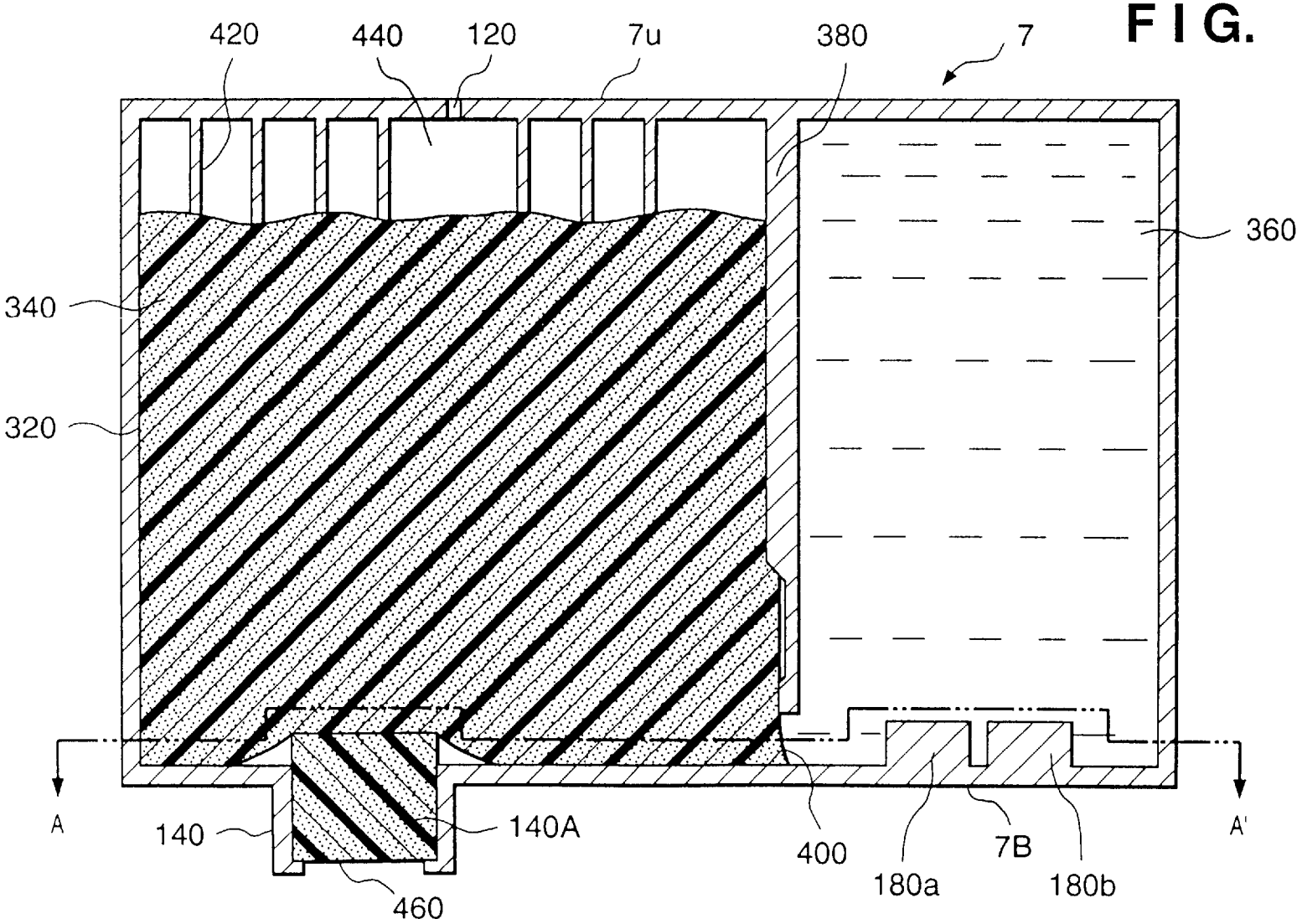
FIG. 13 is a cross-sectional view showing the internal structure of the ink tank 7 according to a first modification of the first embodiment.

FIG. 13 is a cross-sectional view showing the internal structure of the ink tank 7 according to a first modification. As it is understood from this figure, the prism is divided into two prisms 180*a* and 180*b*.

Figure 14:
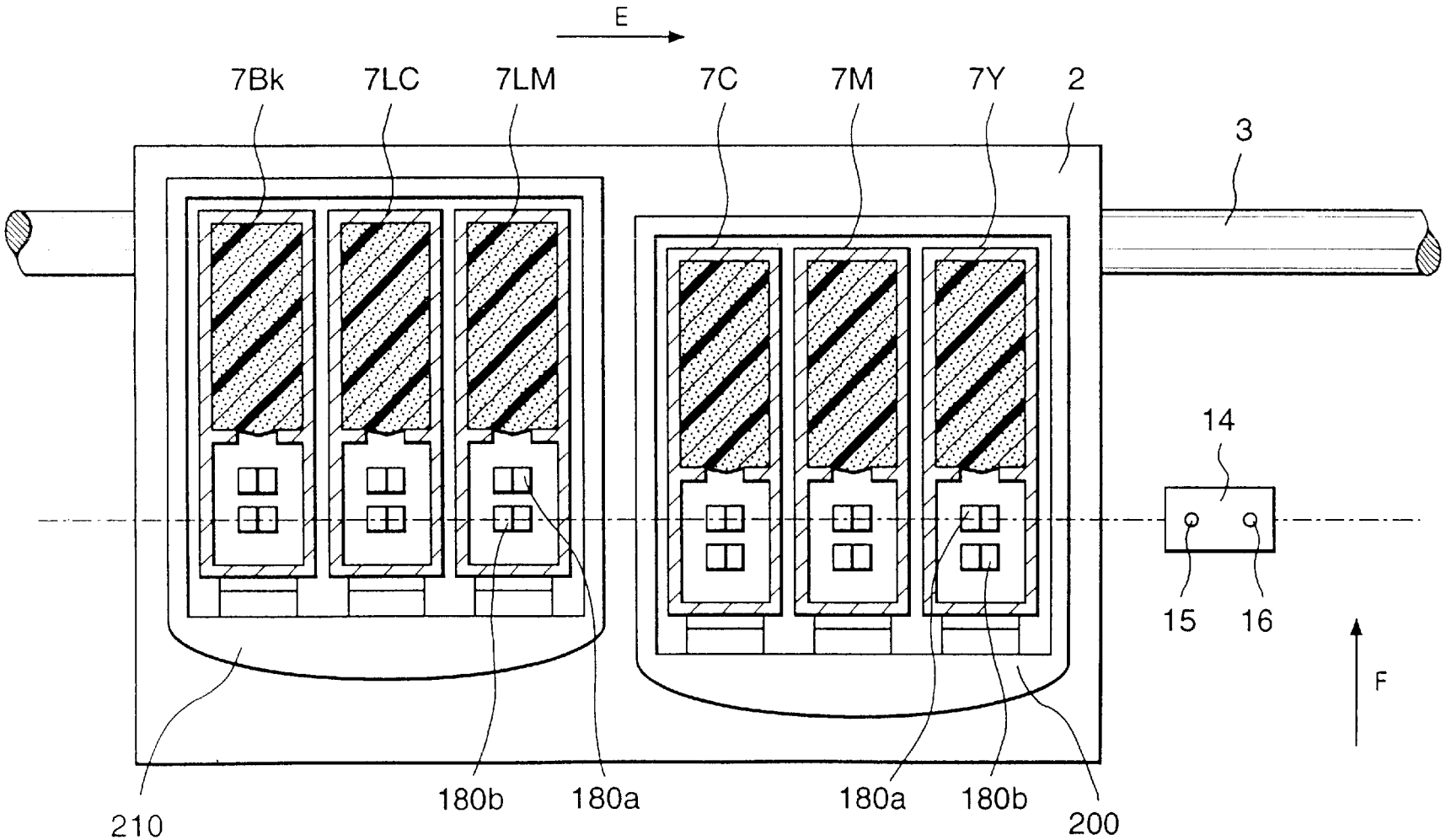
FIG. 14 is a top plan view, of the carriage 2 carrying six ink tanks 7C, 7M, 7Y, 7LC, 7LM and 7Bk having the same structure of the ink tank 7 in FIG. 13, and showing the positional relation between these ink tanks and the optical unit 14.

FIG. 14 is a top plan view of the carriage carrying six ink tanks 7C, 7M, 7Y, 7LC, 7LM and 7Bk having the same structure of the ink tank 7 in FIG. 13, showing the positional relation between these ink tanks and the optical unit 14.

[Second Modification (FIGS. 15 and 16)]

Figure 15:
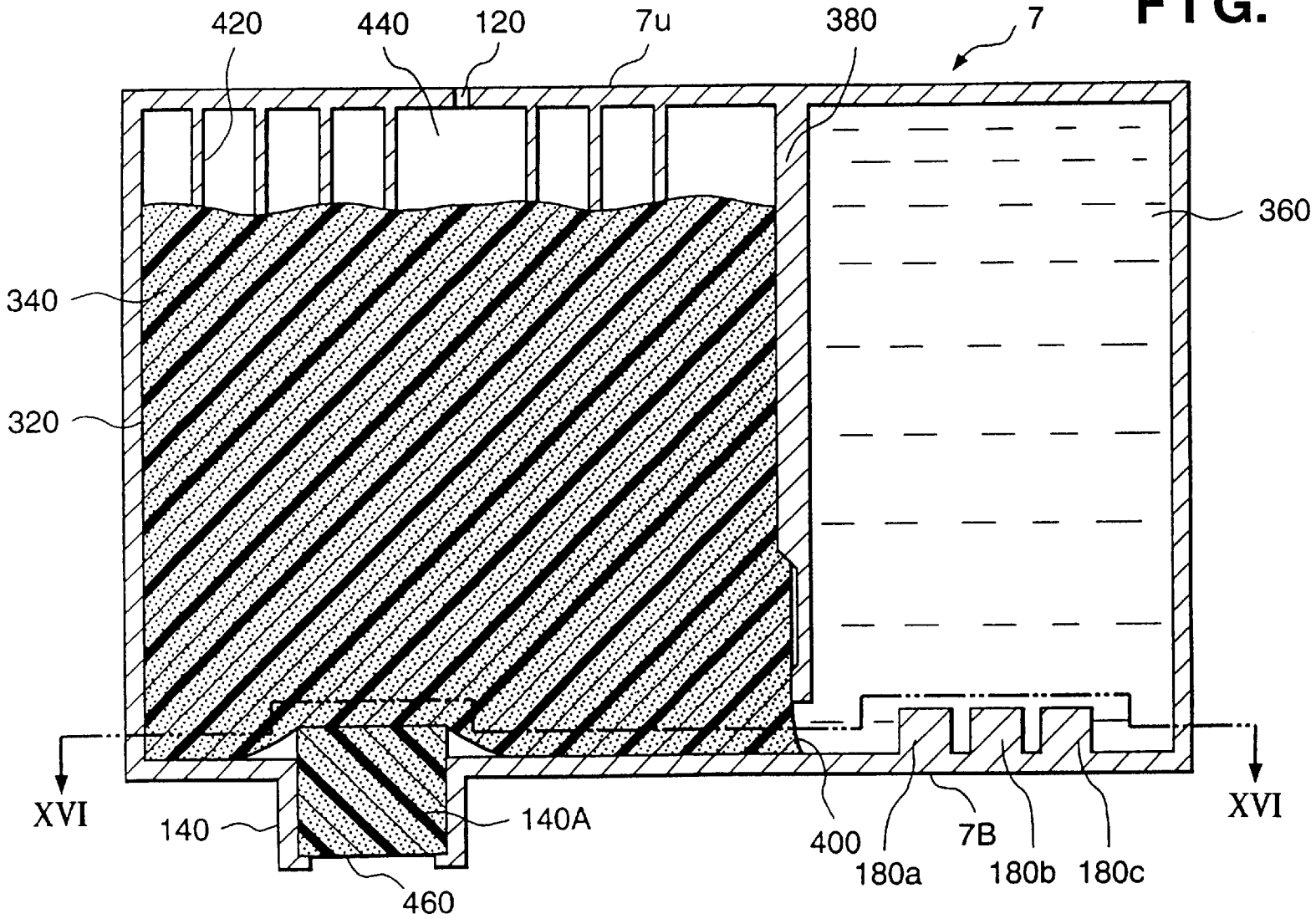
FIG. 15 is a cross-sectional view showing the internal structure of the ink tank 7 according to a second modification of the first embodiment.

FIG. 15 is a cross-sectional view showing the internal structure of the ink tank 7 according to a second modification. As it is understood from this figure, the prism is divided into three prisms 180*a*, 180*b* and 180*c*.

Figure 16:
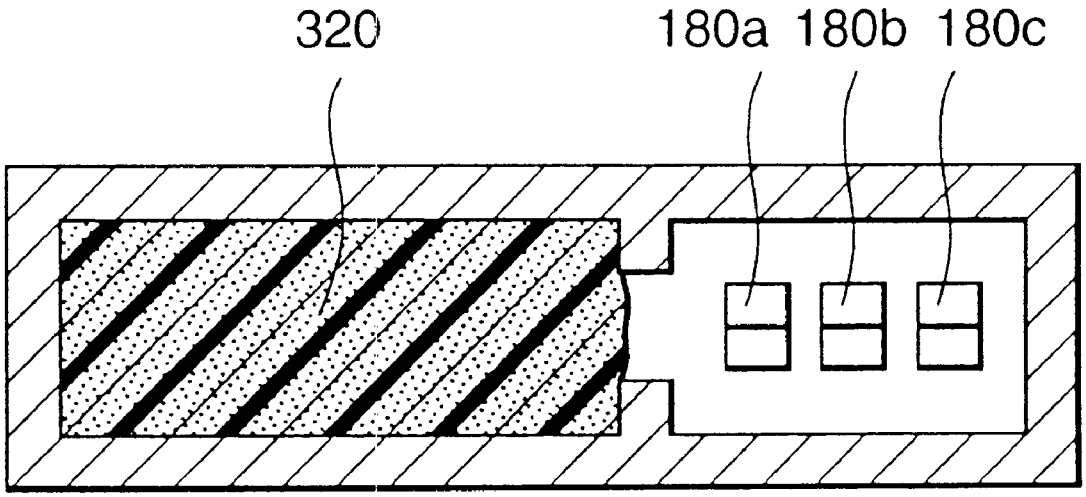
FIG. 16 is a cross-sectional view showing the bottom of the ink tank 7 cut along a line XVI—XVI in FIG. 15.

FIG. 16 is a cross-sectional view showing the bottom of the ink tank 7 cut along a line XVI—XVI in FIG. 15.

In this manner, the prism may be divided into two prisms or three prisms in the lengthwise direction of the ink tank. As shown in FIG. 14, if the tank holders holding the ink tanks having the above construction are mounted on the carriage 2 in positions shifted from each other in the print-medium conveyance direction, existence 'absence of ink can be detected by a single optical unit 14.

Beside the above modifications, the prism provided on the bottom surface of the ink tank may be divided into four or more prisms.

[Third Modification (FIGS. 17 and 18)]

In the above-described first and second modifications, the thickness of the portions where the prisms are formed in the ink tank is thicker than other parts of the ink tank. Such partially thick portion disturbs linear formation of prism slopes, and the slopes have partial distortion. This results in lowering reflectivity with respect to light emitted from the optical unit 14.

Figure 17:
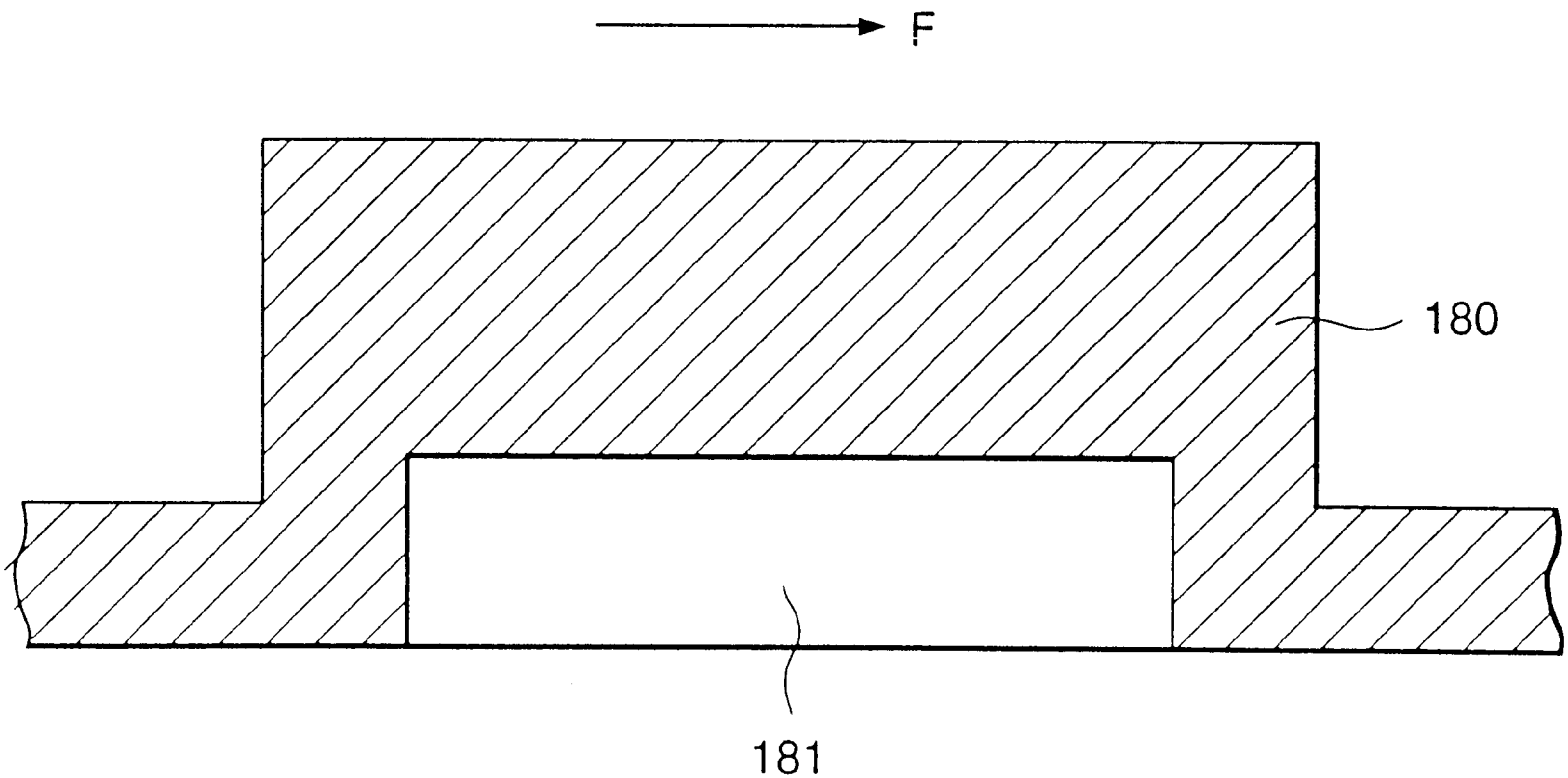
FIG. 17 is a cross-sectional view of the prism 180 cut along the line VII—VII in FIG. 6.
Figure 18:
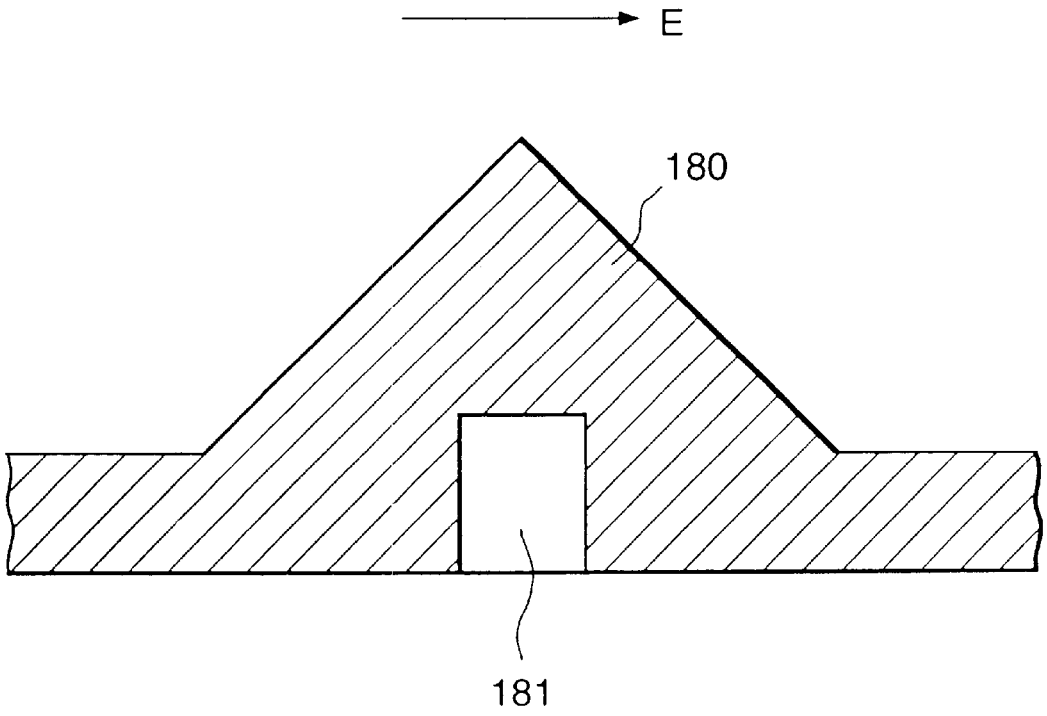
FIG. 18 is a cross-sectional view of the prism 180 cut along the line VIII—VIII in FIG. 6.

Accordingly, in the present modification, as shown in FIGS. 17 and 18, the shape of the bottom of the prism is partially changed to have an concave portion 181, such that the formation of partial thick portion in the prism formation portion can be avoided and the slopes of the prism can be more linearly formed by integral molding with the ink tank, to improve light reflectivity.

Note that FIG. 17 is a cross-sectional view of the prism 180 cut along the line VII—VII in FIG. 6. FIG. 18 is a cross-sectional view of the prism 180 cut along the line VIII—VIII in FIG. 6.

[Fourth Modification (FIGS. 19 and 20)]

In the above-described embodiment and modifications, the light emitting device 15 and the photoreception device 16 of the optical unit 14 are arrayed in the carriage moving direction as shown in FIG. 1A. This arrangement may be rotated 90°, such that the light emitting device 15 and the photoreception device 16 are arrayed in the print-medium conveyance direction as shown in FIG. 1B.

In this case where the light emitting device and the photoreception device are arrayed in the print-medium conveyance direction, two prisms are formed on the bottom of each ink tank in positions shifted from each other in the print-medium conveyance direction and the prisms are rotated 90° regarding the positions in the above-described embodiment and modifications, such that even if there is an error in attachment of tank holder to the ink tank or attachment of tank holder to the carriage, the error can be absorbed, or even if the tank holder is mounted on two carriages, residual ink detection can be performed by a single optical unit.

Figure 19:
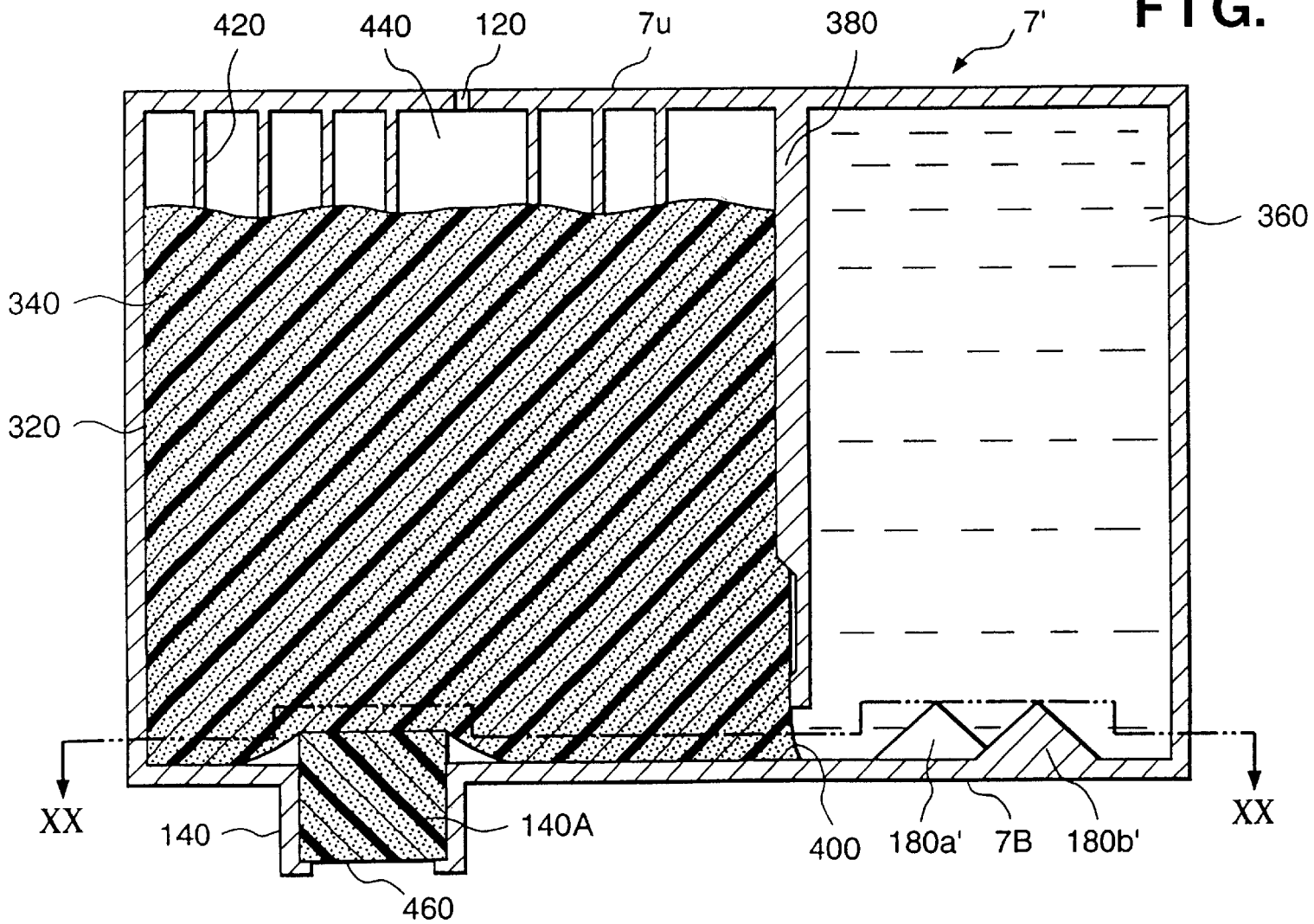
FIG. 19 is a cross-sectional view showing the internal structure of an ink tank 7' according to a fourth modification of the first embodiment.

FIG. 19 is a cross-sectional view showing the internal structure of an ink tank 7' according to the fourth modification. As it is understood from FIG. 19, two prisms 180*a*', and 180*b*' having a right isosceles triangular cross section, are formed in positions shifted from each other.

Figure 20:
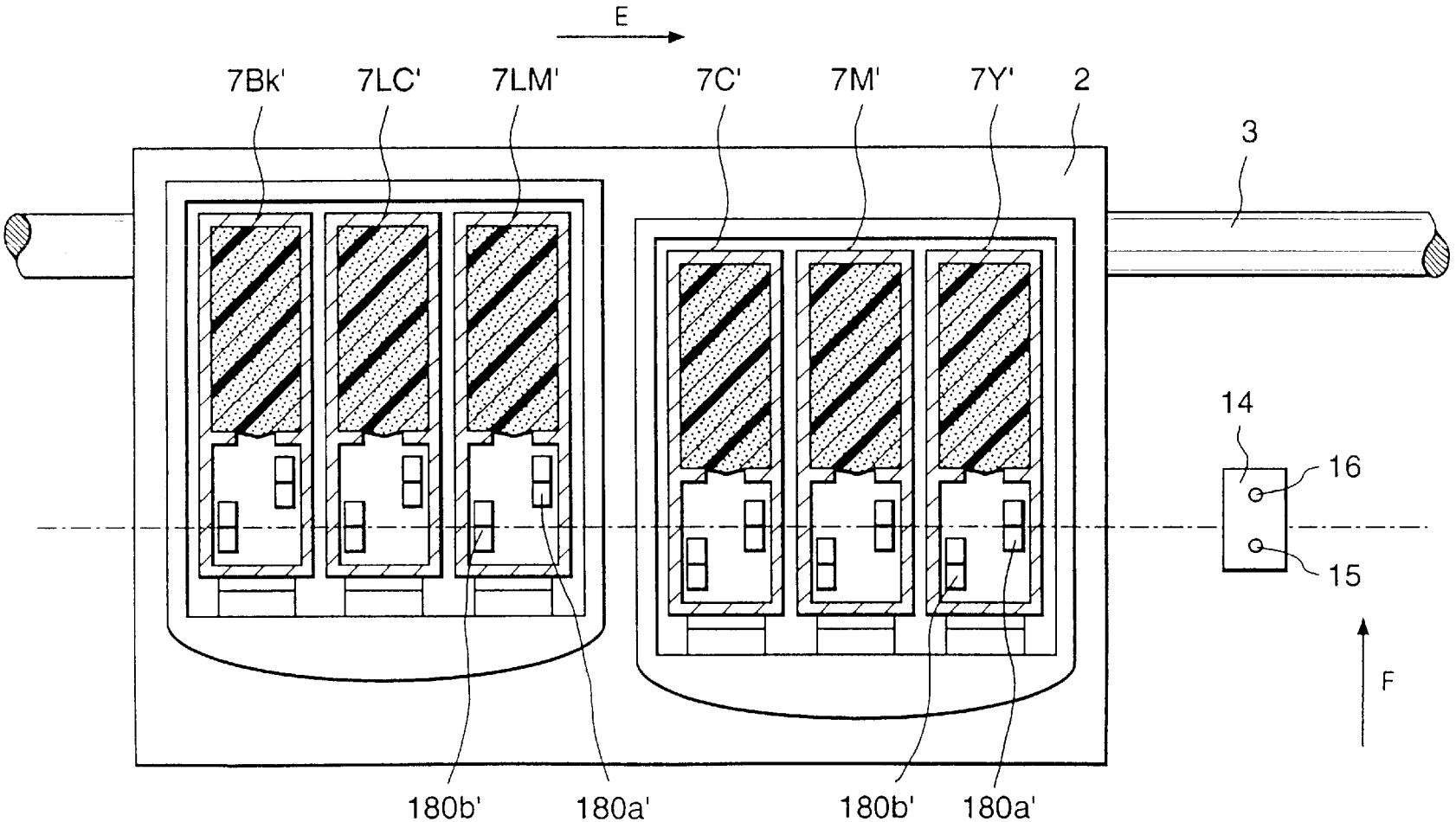
FIG. 20 is a top cross-sectional view along line XX—XX in FIG. 19, of the carriage 2 carrying six ink tanks 7C', 7M', 7Y', 7LC', 7LM' and 7Bk' having the same structure of the ink tank 7' in FIG. 19, and showing the positional relation between these ink tanks and the optical unit 14.

FIG. 20 is a top cross-sectional view along the line XX—XX in FIG. 19, of the carriage carrying six ink tanks 7C', 7M', 7Y', 7LC', 7LM' and 7Bk' having the same structure of the ink tank 7' in FIG. 19, showing the positional relation between these ink tanks and the optical unit 14.

As shown in FIG. 20, the optical unit 14 is positioned immediately above the prisms 180*a*' of the ink tanks 7C', 7M' and 7Y', while the optical unit 14 is positioned immediately above the prisms 180*b*' of the ink tanks 7LC', 7LM, and 7Bk'.

In this manner, in a case where the light emitting device and the photoreception device of the optical unit are attached in positions rotated 90°, i.e., the light emitting device and the photoreception device are arrayed in the print-medium conveyance direction, existence/absence of ink in the ink tank can be detected.

<Second Embodiment>

In the present embodiment, the printing apparatus having the structure as shown in FIG. 1B is employed.

The outline of the structure of the ink tank used in the second embodiment will be described with reference to FIGS. 21 to 25. Note that in this embodiment, the tank holder 200 described with reference to FIGS. 4A and 4B of the first embodiment is employed.

Figure 21:
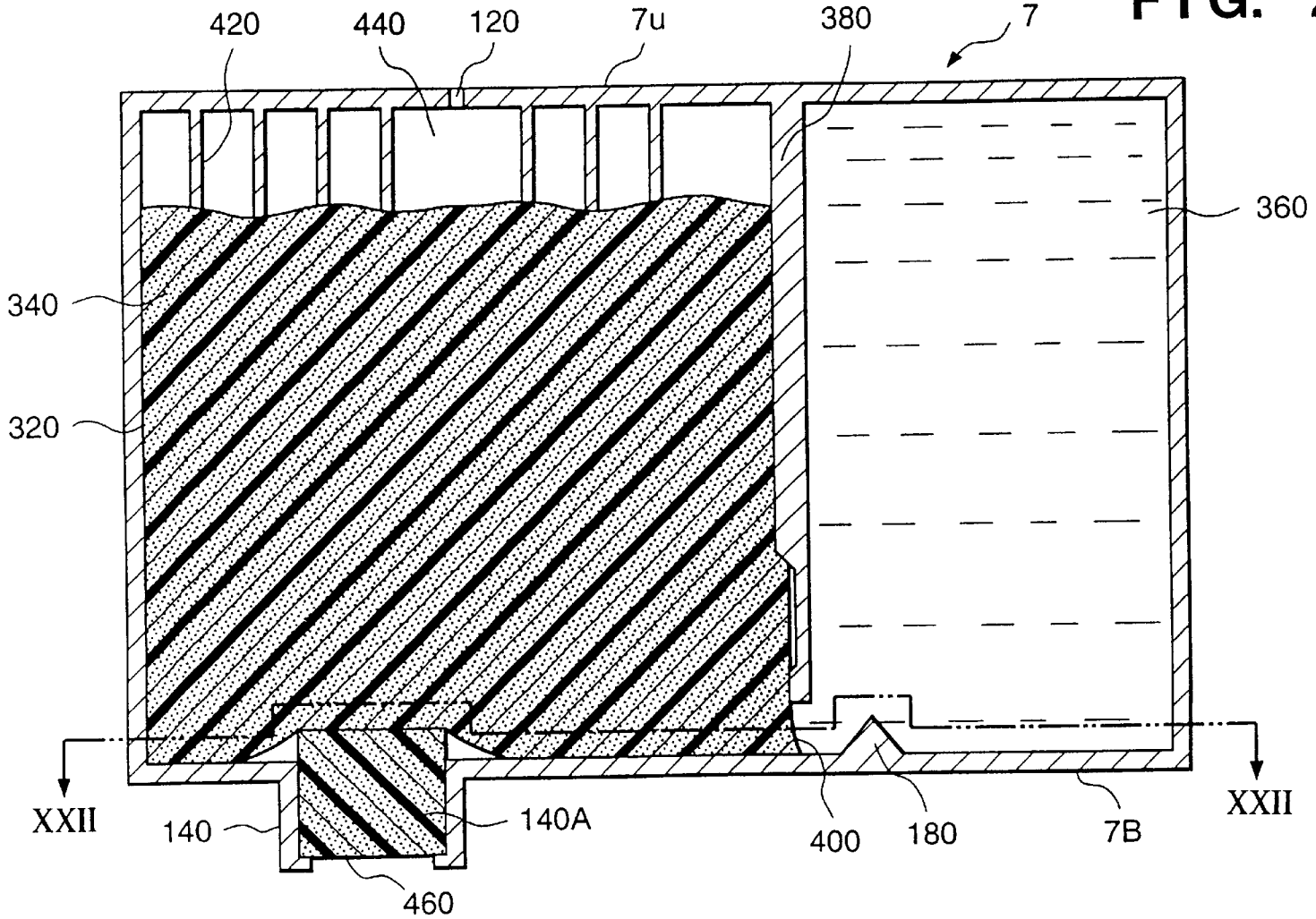
FIG. 21 is a cross-sectional view showing the internal structure of the ink tank 7 according to a second embodiment.

FIG. 21 is a cross-sectional view showing the internal structure of the ink tank 7.

As it is apparent from comparison between FIGS. 21 and 5, FIG. 21 has almost the same structure as that in FIG. 5. Accordingly, explanations of corresponding elements will be omitted, and only an element characteristic of the present embodiment will be described.

The characteristic structure of the present embodiment is the orientation in which the prism 180 is provided.

Figure 22:
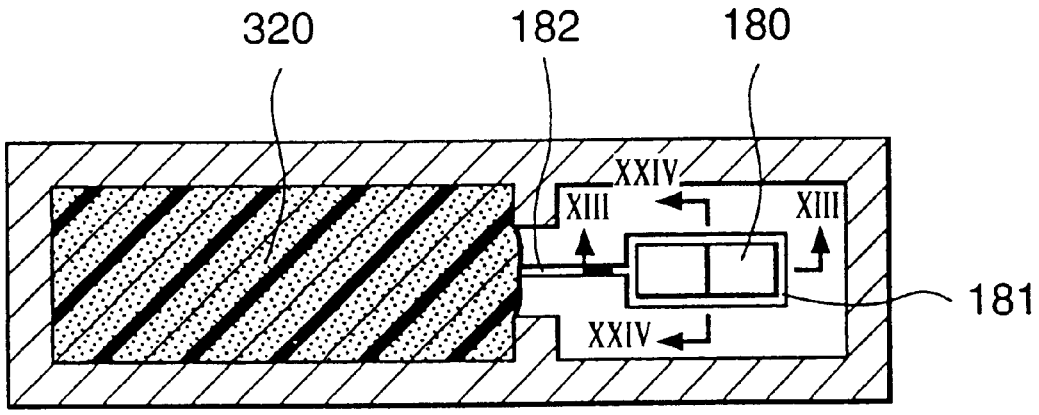
FIG. 22 is a cross-sectional view of the bottom of the ink tank 7 cut along a line XXII—XXII in FIG. 21.

FIG. 22 is a cross-sectional view showing the bottom of the ink tank 7 cut along a line XXII—XXII in FIG. 21.

In FIG. 22, numeral 181 denotes an ink introduction groove provided around the prism 180; and 182, an ink introduction groove communicating with the ink introduction groove 181 and the absorbent material 320.

Figure 23:
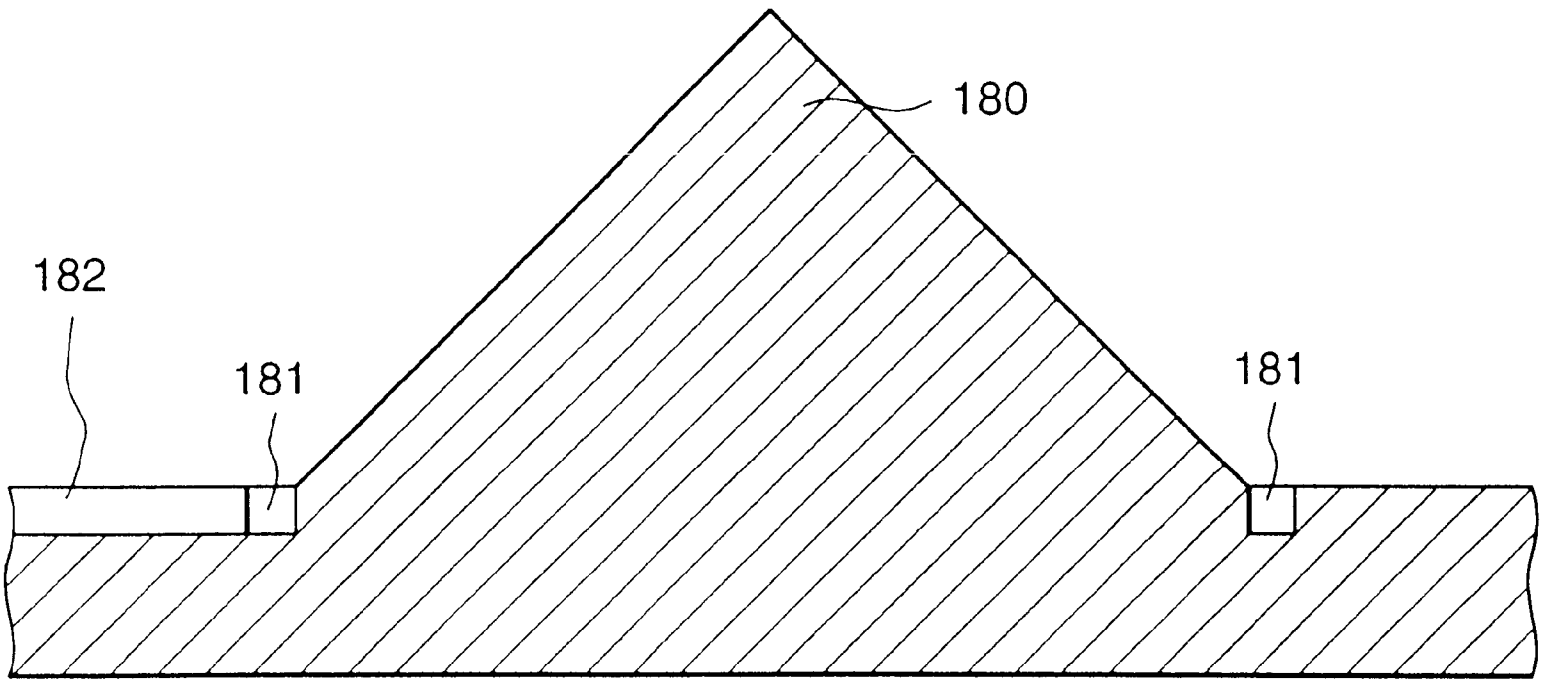
FIG. 23 is a cross-sectional view of the prism 180 cut along a line XXIII—XXIII in FIG. 22 and its peripheral portion.
Figure 24:
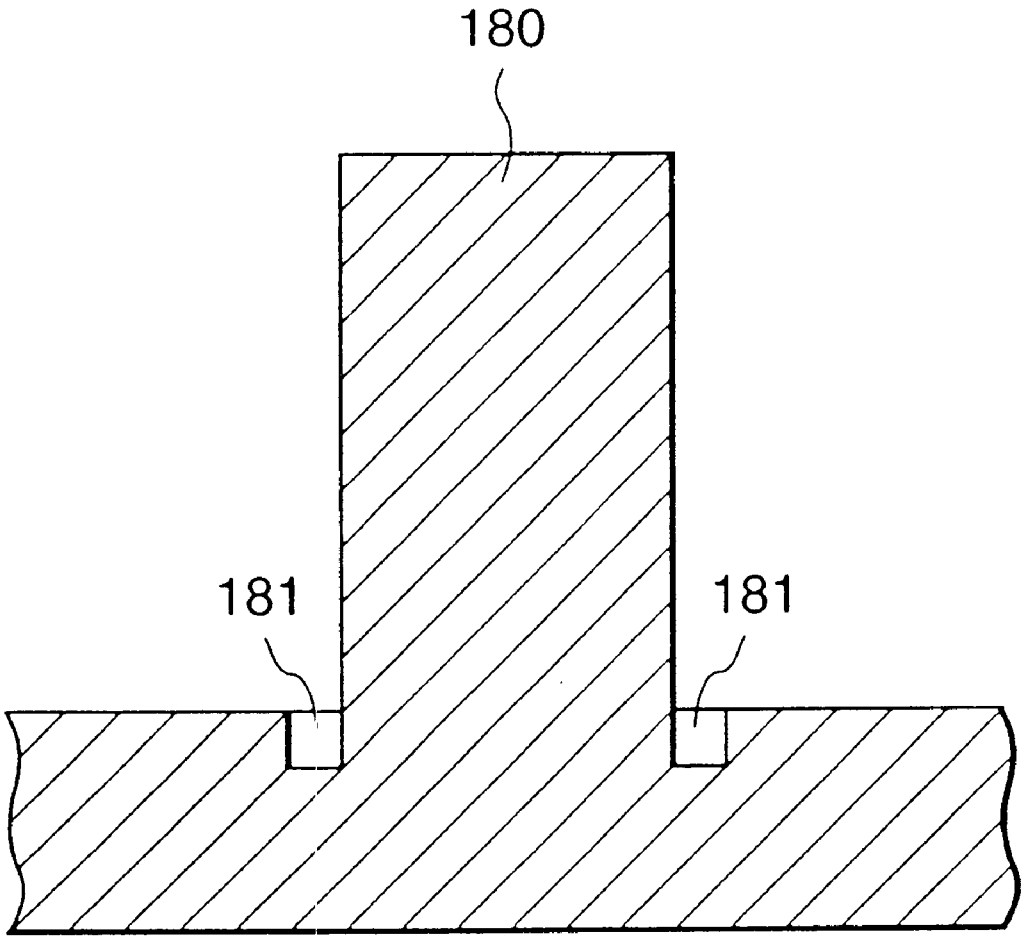
FIG. 24 is a cross-sectional view of the prism 180 cut along a line XXIV—XXIV in FIG. 22 and its peripheral portion.

FIG. 23 is a cross-sectional view of the prism 180 cut along a line XXIII—XXIII in FIG. 22 and its peripheral portion. FIG. 24 is a cross-sectional view of the prism 180 cut along a line XXIV—XXIV in FIG. 22 and its peripheral portion.

As it is understood from FIGS. 23 and 24, the ink introduction grooves 181 and 182, a little deeper than the internal bottom surface of the ink tank 7, are provided around the prism 180.

In the present embodiment, the prism 180, the ink introduction grooves 181 and 182 are integrally molded with the ink tank 7. Polypropylene having excellent ink proof characteristic, gas resistance and transparency, and further, which is low cost material, is employed as the material of the part.

Accordingly, by providing the ink introduction grooves around the prism 180, ink which remains on the slope of the prism 180 is absorbed by capillarity of the ink introduction groove 181 and introduced into the ink introduction groove 181, and further absorbed via the ink introduction groove 182 into the absorbent material 320. Thus, ink left on the surface of the prism 180 can be extremely reduced.

Note that the capillarity of the ink introduction grooves 181 and 182 is lower than that of the absorbent material 320 for smooth ink absorption.

In this manner, the water repellency on the slope of the prism is improved, so that when ink is exhausted in the ink tank, the ink quickly disappears from the slope of the prism. This avoids the inconvenience that high-viscous ink remains on the slope and badly influences ink existence/absence detection, and enables precise detection of existence/absence of residual ink.

Figure 25:
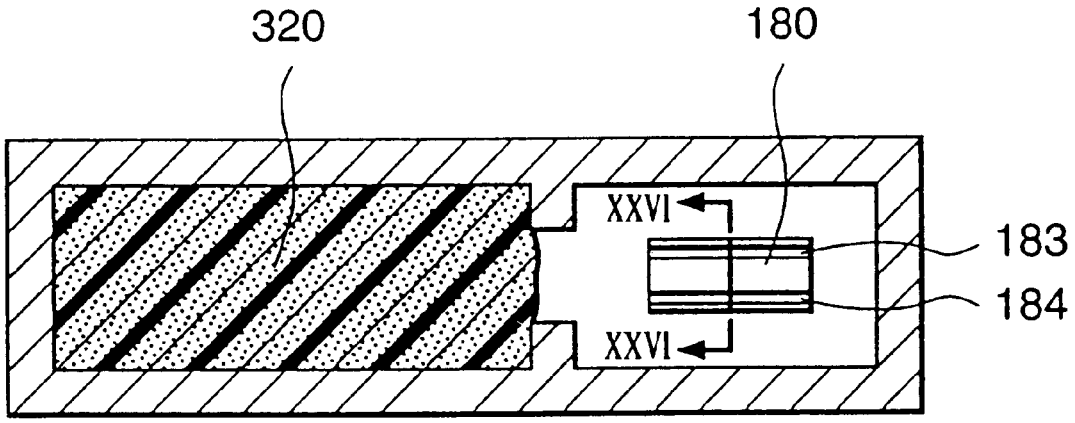
FIG. 25 is a cross-sectional view showing the bottom of the ink tank 7, having the prism according to a modification of the second embodiment, cut along the line XXII—XXII in FIG. 21.
Figure 26:
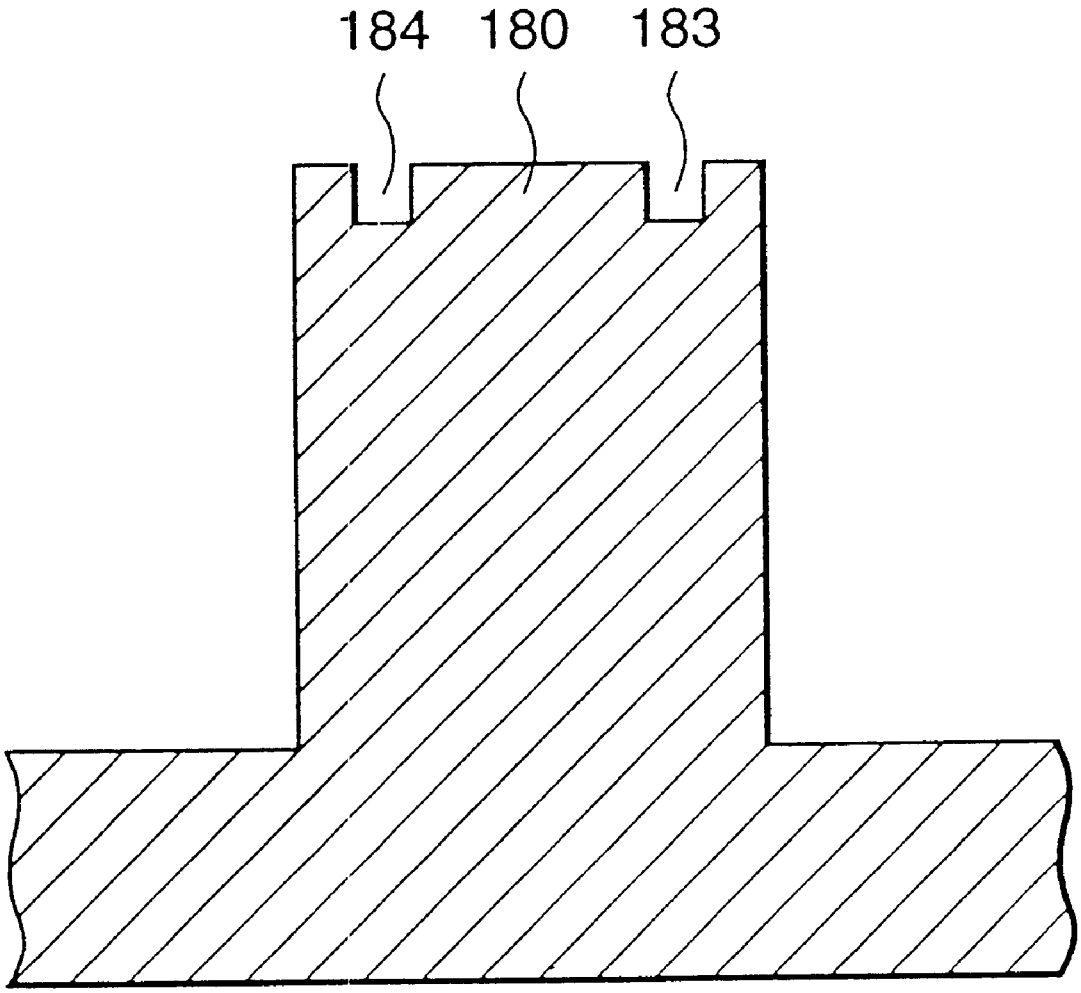
FIG. 26 is a cross-sectional view of the prism 180 cut along a line XXVI—XXVI in FIG. 25 and its peripheral portion.

Note that in the above-described embodiment, the ink introduction grooves are provided around the prism to improve water repellency on the slope of the prism, however, the present invention is not limited to this arrangement. For example, as shown in FIGS. 25 and 26, ink introduction grooves 183 and 184 may be provided on both ends of the two slopes of the prism 180. FIG. 25 is a cross-sectional view showing the bottom of the ink tank 7, cut along the line XXII—XXII in FIG. 21. FIG. 26 is a cross-sectional view of the prism 180 cut along a line XXVI—XXVI in FIG. 25 and its peripheral portion.

By providing these grooves, ink remaining on the slopes of the prism 180 is absorbed into the ink introduction grooves 183 and 184 on the both ends by capillarity of these ink introduction grooves, the ink remaining at the central portion of the slopes of the prism 180 can be extremely reduced.

Figure 27:
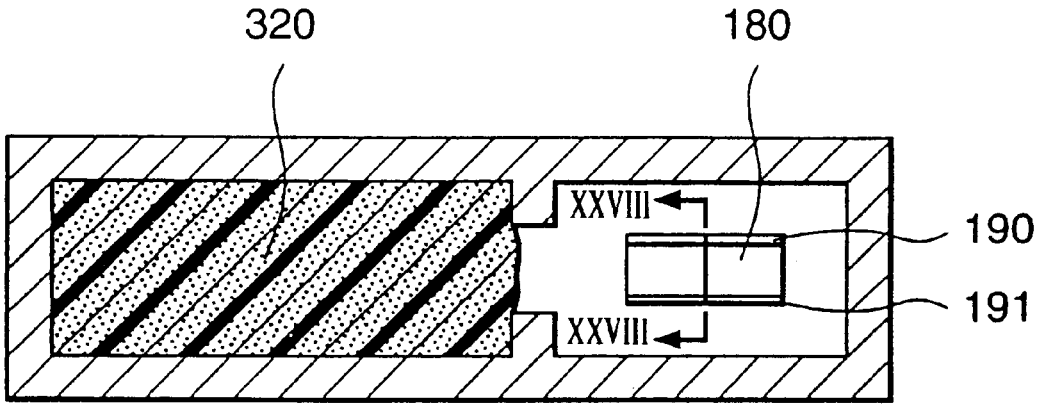
FIG. 27 is a cross-sectional view showing the bottom of the ink tank 7, having the prism according to another modification of the second embodiment, cut along the line XXII—XXII in FIG. 21.
Figure 28:
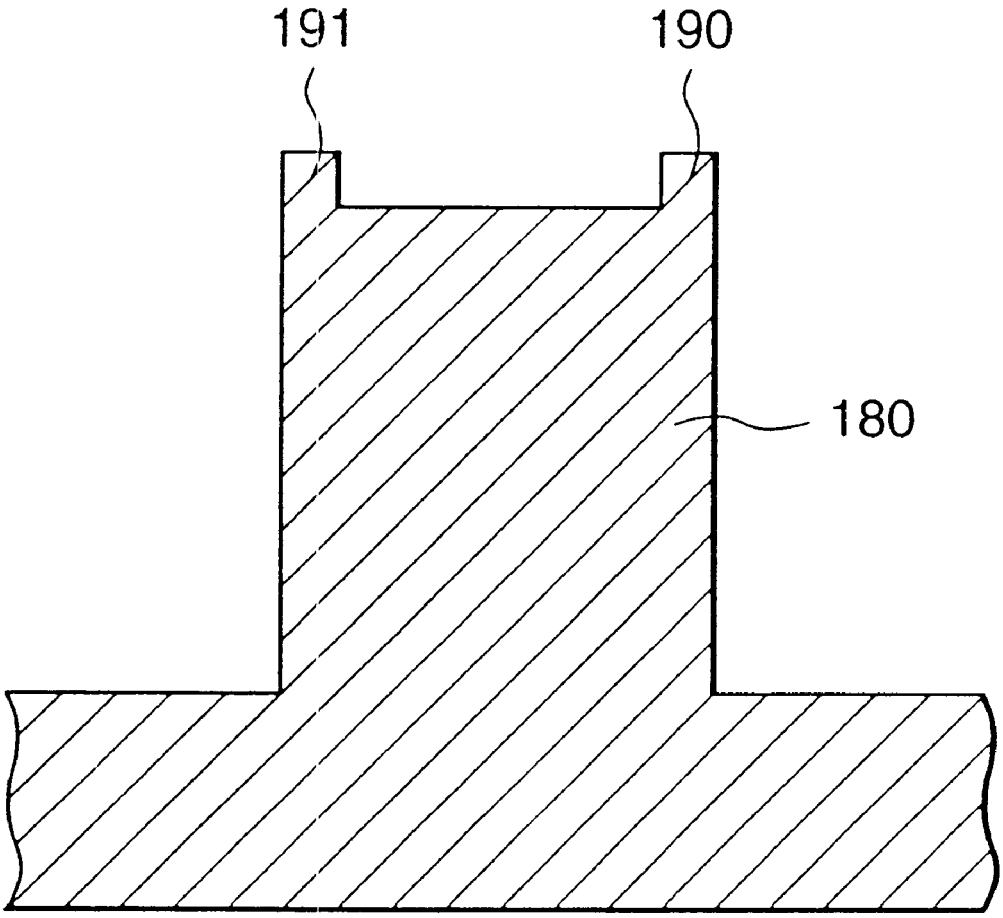
FIG. 28 is a cross-sectional view of the prism 180 cut along a line XXVIII—XXVIII in FIG. 27 and its peripheral portion.

Further, as shown in FIGS. 27 and 28, ridges 190 and 191 may be provided on both ends of the slope of the prism 180. FIG. 27 is a cross-sectional view showing the bottom of the ink tank 7, cut along the line XXII—XXII in FIG. 21. FIG. 28 is a cross-sectional view of the prism 180 cut along a line XXVIII—XXVIII in FIG. 27 and its peripheral portion.

In this manner, by providing the ridges on the both ends of the slope of the prism 180, ink remaining on the slope of the prism 180 is absorbed into the both ends by capillarity of corners of the ridges 190 and 191. Thus, the ink remaining at the central portion of the slope of the prism can be extremely reduced.

<Third Embodiment>

In this embodiment, two head cartridges of different types, for example, can be mounted on the carriage of the printing apparatus as shown in FIG. 1A or FIG. 1B. These head cartridges include a head cartridge for photographic printing, holding an ink tank containing low-concentration (thin) magenta ink, an ink tank containing cyan ink, and an ink tank containing black ink, and a head cartridge for color printing, holding an ink tank containing yellow ink, an ink tank containing high-concentration (thick) magenta ink and high-concentration (thin) cyan ink. By combination of these ink tanks, the printing apparatus can perform printing with ink of six colors, and prints a photographic image in high image quality. Otherwise, the head cartridge for photographic printing may be exchanged with a head cartridge for monochrome printing having only an ink tank containing black ink, for printing a text image at a high speed or printing a business-purpose color image at a high speed.

Figure 29:
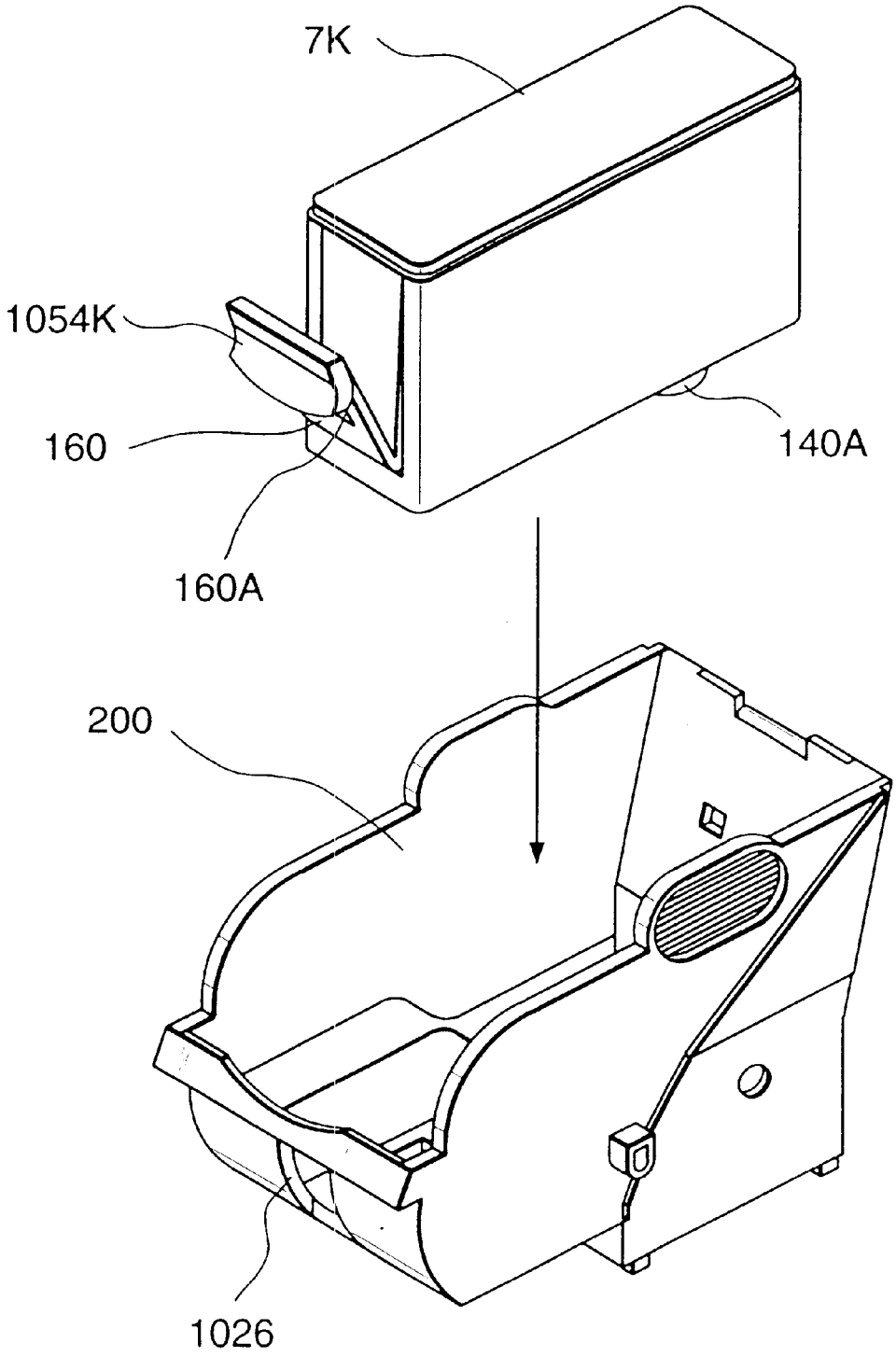
FIG. 29 is a front-side perspective view of an ink tank and a tank holder constituting a black-ink head cartridge according to a third embodiment.
Figure 30:
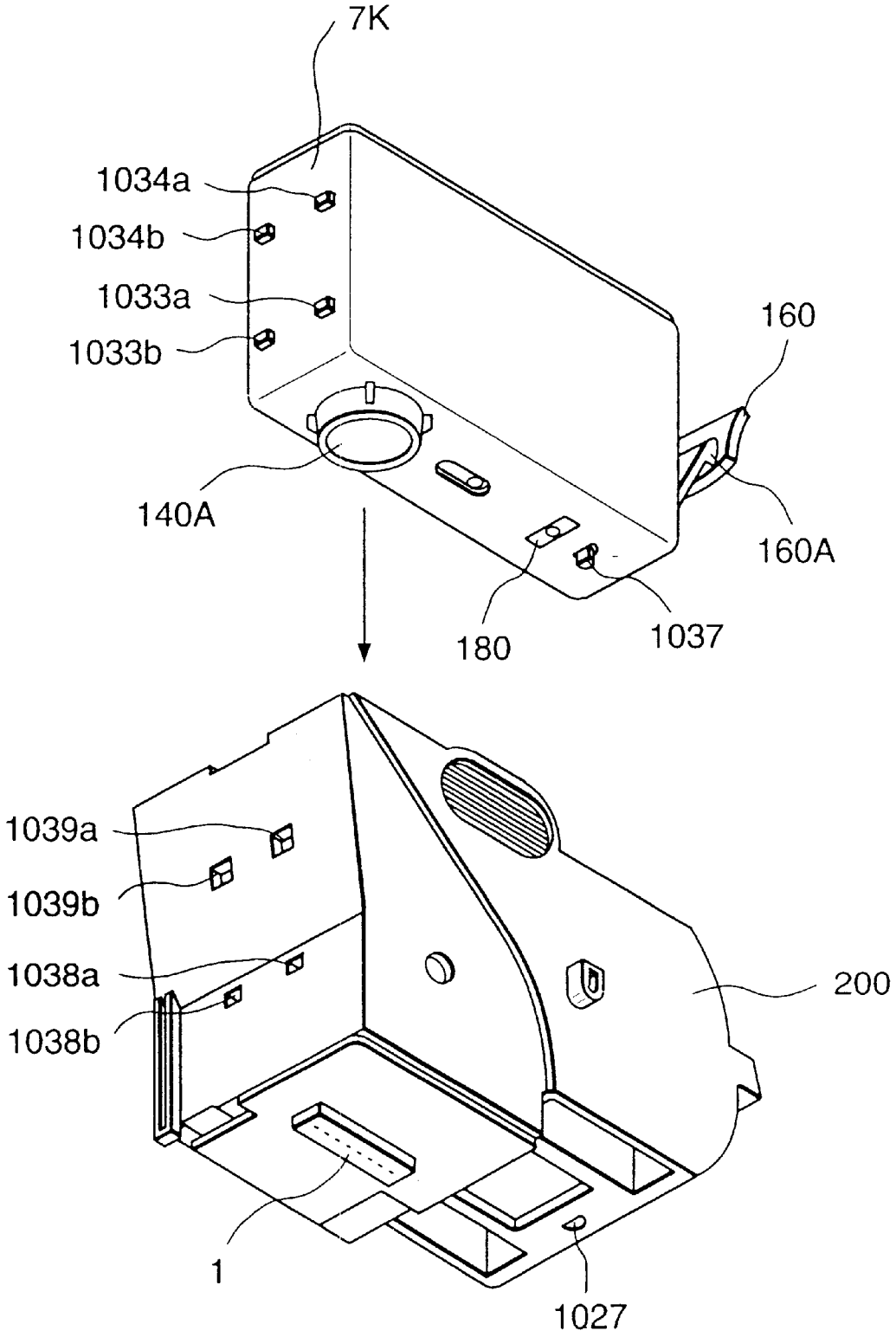
FIG. 30 is a rear-side perspective view of the ink tank and the tank holder constituting the black-ink head cartridge according to the third embodiment.

FIG. 29 is a perspective view of a black-ink head cartridge according to the third embodiment, viewed from a front diagonally-upper right position. FIG. 30 is a perspective view of the black-ink head cartridge, viewed from a front diagonally-lower left position.

The black-ink head cartridge shown in FIGS. 29 and 30 comprises a large capacity ink tank 7K for black ink, the printhead 1, and the tank holder 200 for black ink detachably holding the ink tank 7K. The lever 160 having a knob 1054 and the engagement latch 160A is provided on one side surface of the ink tank 7K, and second latches 1033*a* and 1033*b* are provided on the other side surface of the ink tank 7K. Further, third latches 1034*a* and 1034*b* are provided in upper positions with respect to the second latches 1033*a* and 1033*b*.

The ink supply orifice 140A having a cylindrical shape projecting from the lower surface of the ink tank, a positioning pin 1037 for attachment of the ink tank 7K to the tank holder 200, and the prism 180 used for detecting residual ink in the ink tank, are provided on the lower surface of the ink tank 7K.

Further, the tank holder 200 has a first hole 1026 and second holes 1038*a* and 1038*b* which respectively engage with the engagement latch 160A and the second latches 1033*a* and 1033*b* when the ink tank 7K is attached to the tank holder 200. Further, the tank holder 200 has third holes 1039*a* and 1039*b* in which the third latches 1034*a* and 1034*b* are temporarily inserted for positioning upon attachment of the ink tank 7K to the tank holder 200. Further, the tank holder 200 has a positioning hole 1027 which engage with the positioning pin 1037 of the ink tank 7K, in a lower part of the tank holder 200.

Figure 31:
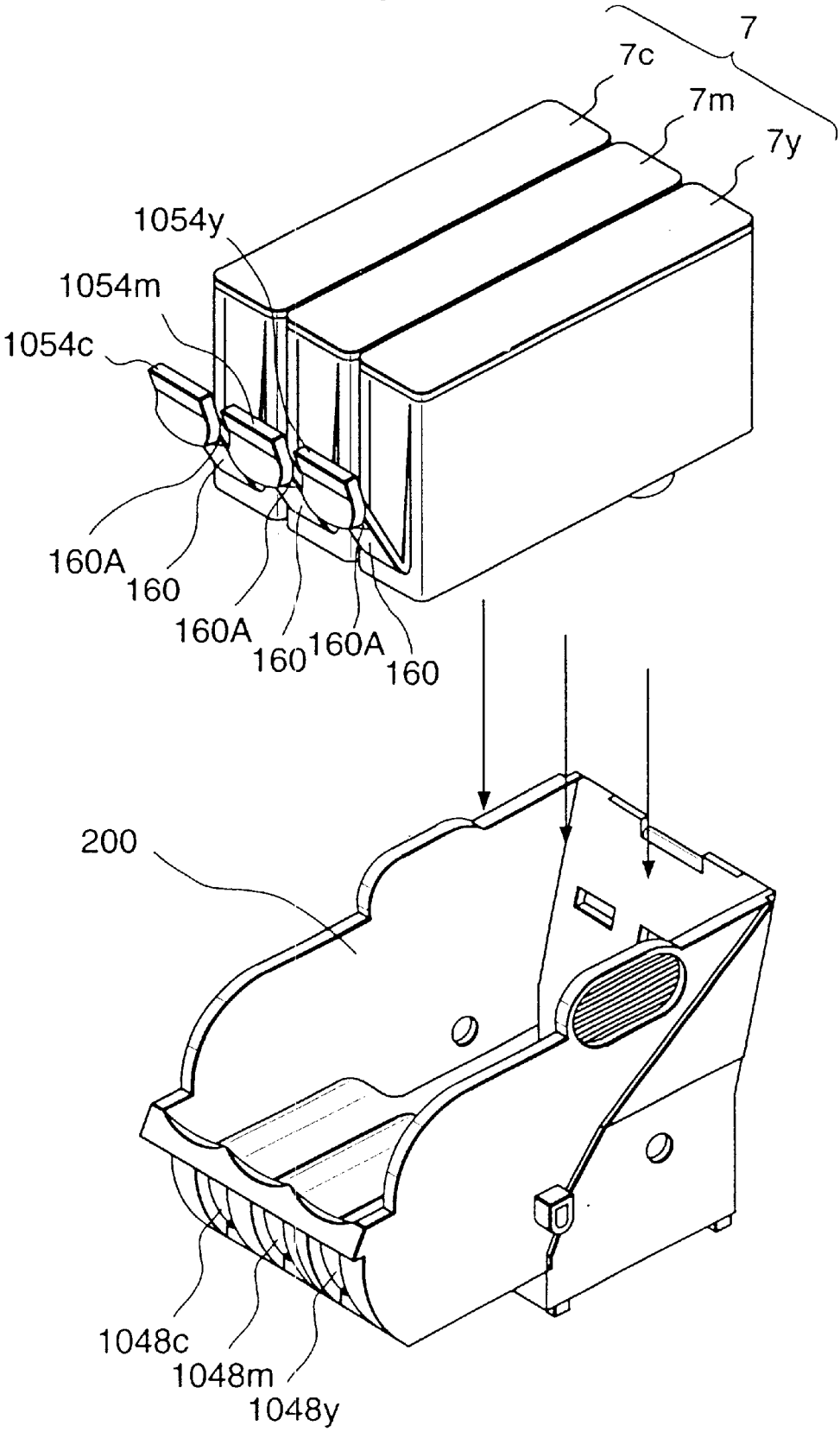
FIG. 31 is a front-side perspective view of an ink tank and a tank holder constituting a color-ink head cartridge according to the third embodiment.
Figure 32:
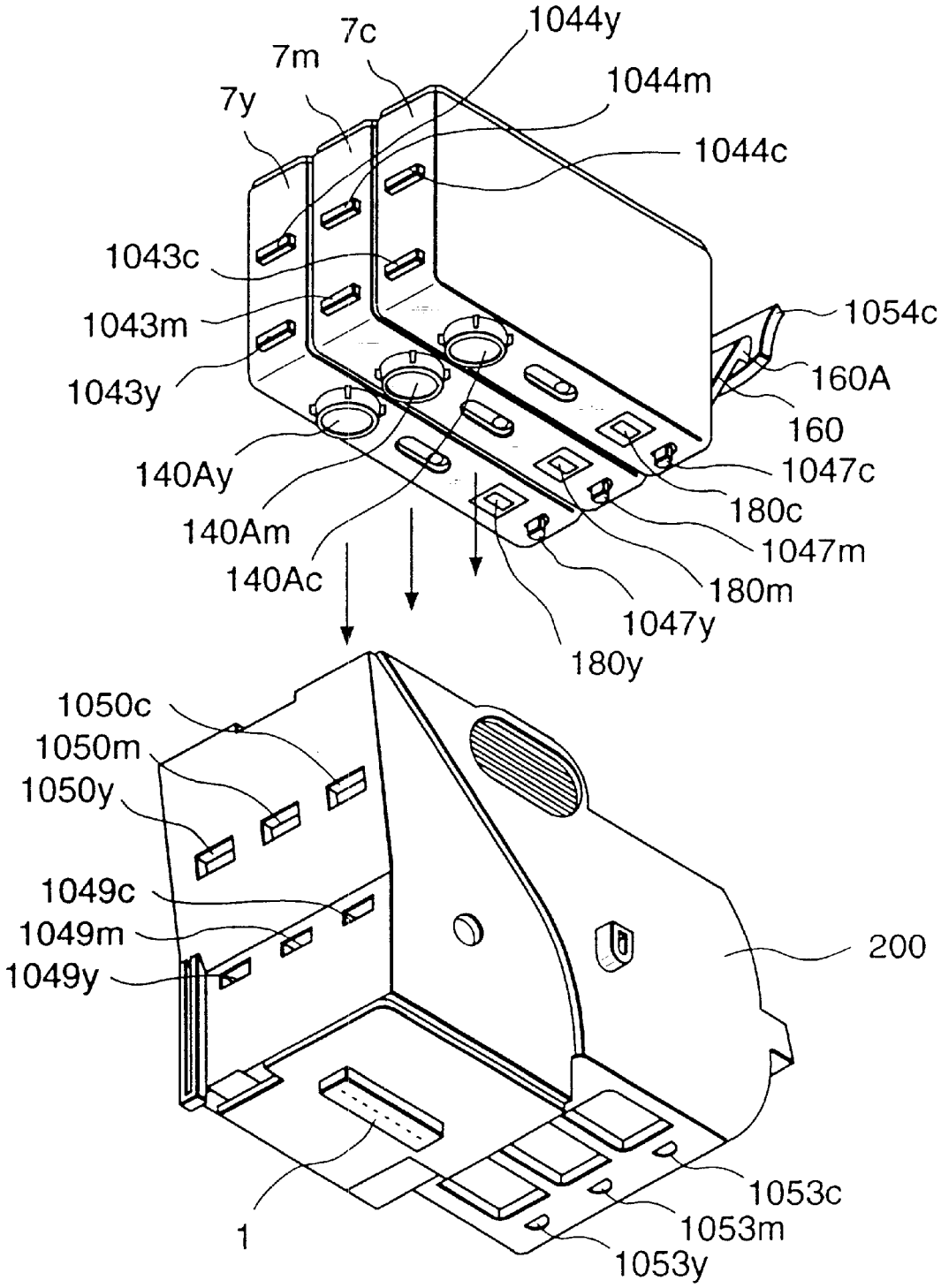
FIG. 32 is a rear-side perspective view of the ink tank and the tank holder constituting the color-ink head cartridge according to the third embodiment.

On the other hand, FIG. 31 is a perspective view of a color-ink head cartridge having approximately the same structure as that shown in FIGS. 4A and 4B, viewed from a front diagonally-upper right position. FIG. 32 is a perspective view of the color-ink head cartridge viewed from a rear diagonally-lower left position.

The color-ink head cartridge shown in FIGS. 31 and 32 comprises the ink tanks 7C, 7M and 7Y, the printhead 1, and the tank holder 200 detachably holding the ink tanks 7C, 7M and 7Y containing ink of respective cyan, magenta and yellow colors. Similar to the above-described black ink tank 7K, levers 160 are provided on one side surfaces of the ink tanks 7C, 7M and 7Y. The levers 160 have, respectively, knobs 1054*c*, 1054*m*, 1054*y*, and engagement latches 160A.

Further, second latches 1043*c*, 1043*m* and 1043*y* are respectively provided on the other side surfaces of the ink tanks 7C, 7M and 7Y for ink of respective colors. Further, third latches 1044*c*, 1044*m* and 1044*y* are provided in upper positions with respect to the second latches 1043*c*, 1043*m* and 1043*y* on the side surfaces of the ink tanks 7C, 7M and 7Y for ink of respective colors.

In lower parts of the ink tanks 7C, 7M and 7Y, ink supply orifices 140Ac, 140Am and 140Ay each having a cylindrical shape projecting from the lower surface, positioning pins 1047*c*, 1047*m* and 1047*y* for attachment of the ink tanks 7C, 7M and 7Y to the tank holder 200, and prisms 180*c*, 180*m* and 180*y*, are provided on the lower surfaces of the ink tanks.

Further, the tank holder 200 has first holes 1048*c*, 1048*m* and 1048*y* and second holes 1049*c*, 1049*m* and 1049*y* which engage with first latches 1042*c*, 1042*m* and 1042*y* and the second latches 1043*c*, 1043*m* and 1043*y* when the ink tanks 7C, 7M and 7Y are attached to the tank holder 200. Further, for positioning upon attachment of ink tanks to the tank holder 200, the tank holder 200 has third holes 1050*c*, 1050*m* and 1050*y* in which the third latches 1044*c*, 1044*m* and 1044*y* are temporarily inserted. Further, in a lower part of the tank holder 200, positioning holes 1053*c*, 1053*m* and 1053*y* which engage with the positioning pins 1047*c*, 1047*m* and 1047*y* of the ink tanks 7C, 7M and 7Y are provided.

Note that the head cartridge for photographic-printing has the same structure as that of the above-described color-ink head cartridge.

Further, in the present embodiment, the movable lever, engagement latches and prisms are integrally molded with the tank main bodies. Polypropylene having excellent ink proof characteristic, gas resistance and transparency, and further, which is low cost material, is employed as the material of these parts.

Next, a procedure of setting the ink tanks to the tank holder of the head cartridge will be described on a black ink-jet head cartridge as an example, with reference to FIGS. 33A to 33F.

Figure 33B:
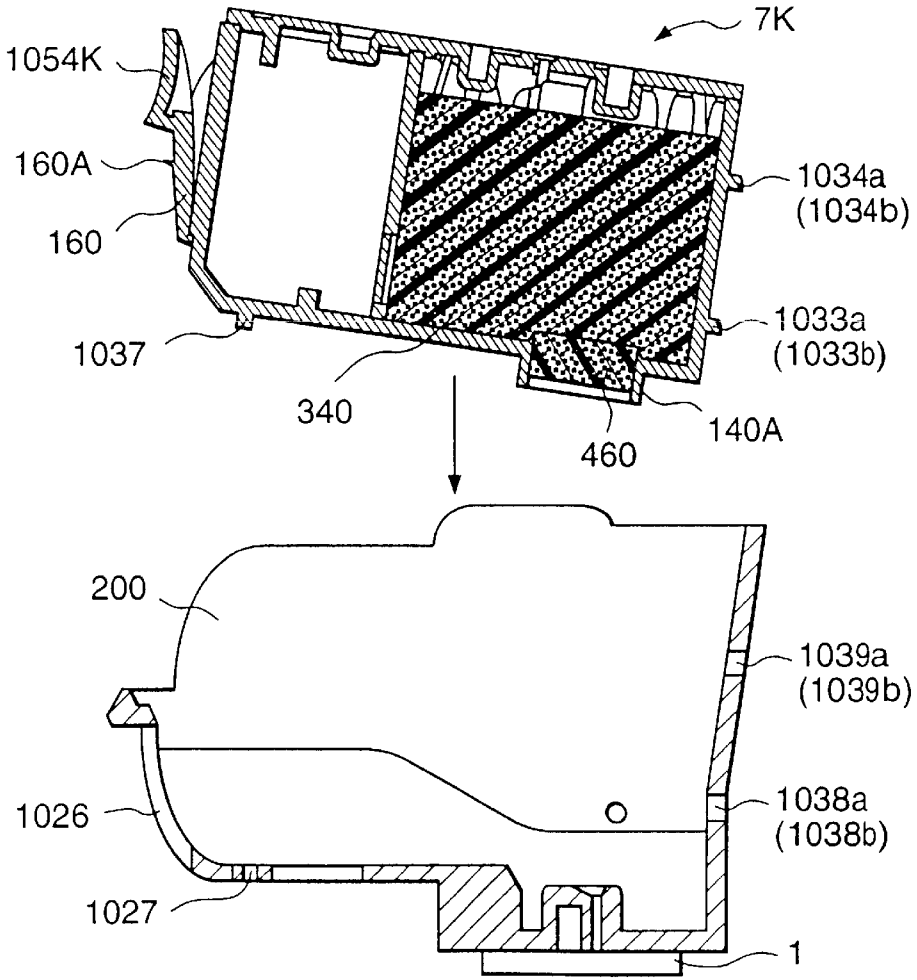
FIGS. 33A to 33F are explanatory views showing attachment of the ink tank to the tank holder in the black-ink head cartridge according to the third embodiment.
Figure 33A:
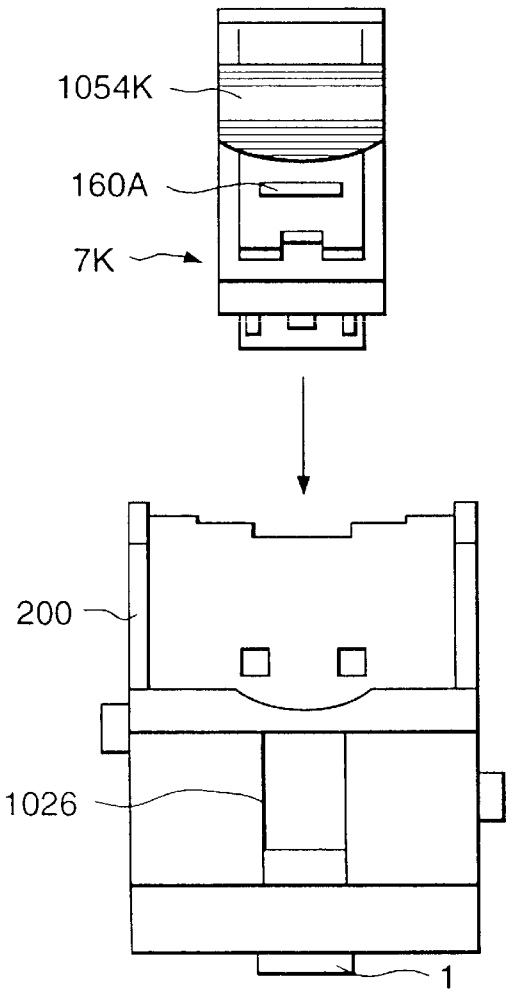

First, as shown in FIGS. 33A and 33B, the user turns the surface of the ink tank 7K having the ink supply orifice 140A toward the upper surface of the tank holder 200, and tilts the ink tank 7K downward such that the second latches 1033*a* and 1033*b* face the inner surface of the rear side of the tank holder 200, and then the user inserts the ink tank 7K into the tank holder 200.

Figure 33D:
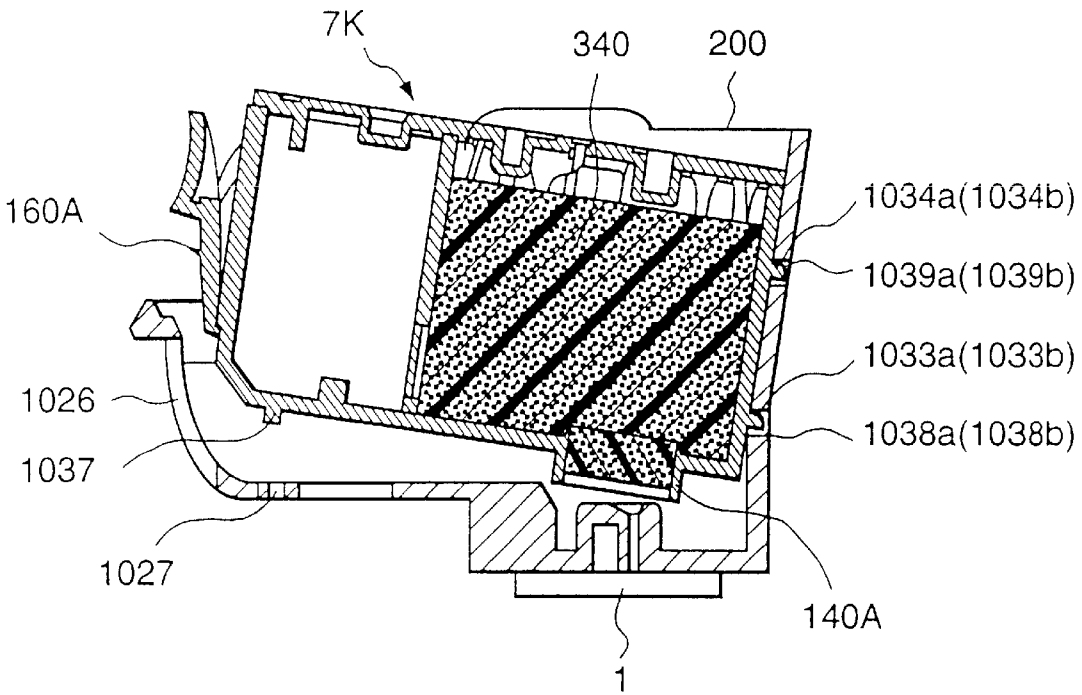
Figure 33C:
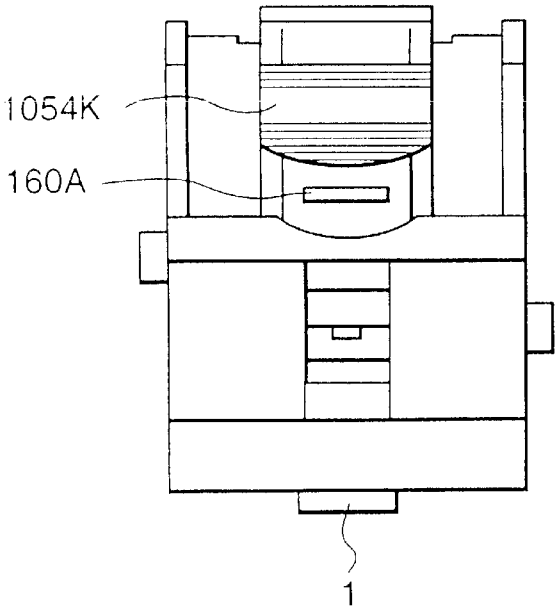

Next, as shown in FIGS. 33C to 33D, the user inserts the ink tank 7K along the slope of the tank holder 200 on the right hand in the figures, such that the second latches 1033*a* and 1033*b* of the ink tank 7K engage with the second holes 1038*a* and 1038*b* of the tank holder 200 and the third latches 1034*a* and 1034*b* of the ink tank 7K engage with the third holes 1039*a* and 1039*b* of the tank holder 200. At this time, the engagement between the third latches 1034*a* and 1034*b* and the third holes 1039*a* and 1039*b* serves as guidance for precise rotation of the ink tank 7K with respect to the positions of the second holes 1038*a* and 1038*b* as rotational centers.

Figure 33F:
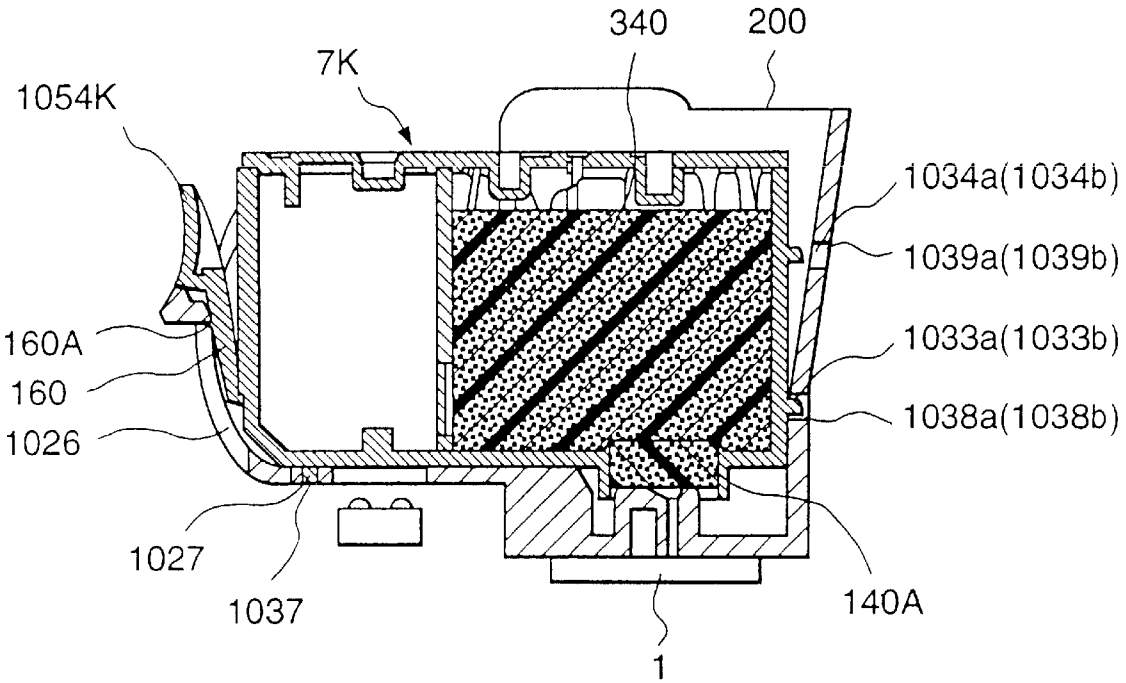
Figure 33E:
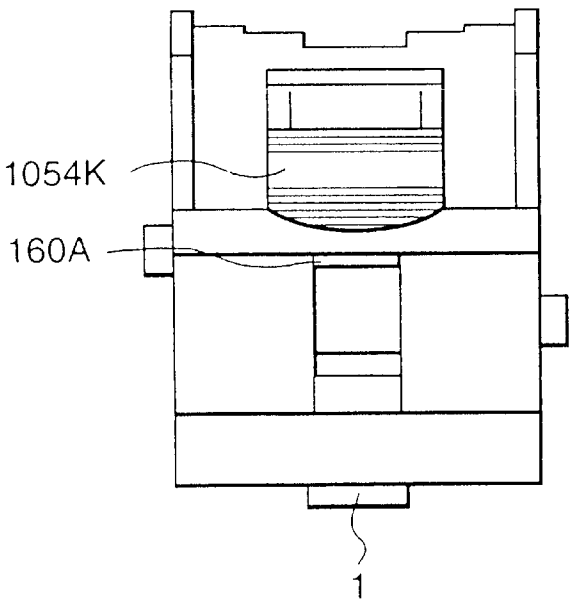

Then the user inserts the ink tank 7K while rotating the ink tank 7K on the second latches 1044*a* and 1033*b* engaged with the second holes 1038*a* and 1038*b* of the tank holders 200 as rotational centers. By this operation, as shown in FIGS. 33E and 33F, the lever 160 is distorted inwardly, then the engagement latch 160A engages with the first hole 1026 of the tank holder 200, and at the same time, the positioning pin 1037 of the ink tank 7K is inserted into the positioning hole 1027 of the tank holder 200. Thus, the ink tank 7K is fixed to the tank holder 200 with high precision.

In this state, ink held in the ink absorbent material 340 is introduced via the ink inducing element 460 of the ink supply orifice 140A to the printhead 1, and discharged from the discharge orifices (not shown) by energy generated by the electrothermal transducers (not shown) in the printhead 1.

Note that when the ink tank 7K is removed, the lever 160 is distorted inwardly to remove the engagement latch 160A from the first hole 1026 of the tank holder 200, then the knob 1054 of the lever 160 is pulled up. Thus, the ink tank 7K can be easily removed from the tank holder 200.

In this manner, the head cartridge having the above-described basic structure is attached to the tank holder. To attach the head cartridge to the tank holder with high positional precision, various modifications can be provided. Hereinbelow, one of these modifications will be described based on the drawings.

[(Modification)]

In this modification, a structure to attach the ink tank to the tank holder of a head cartridge with high positional precision will be described on the black-ink large-capacity ink tank 7K as an example.

Figure 34A:
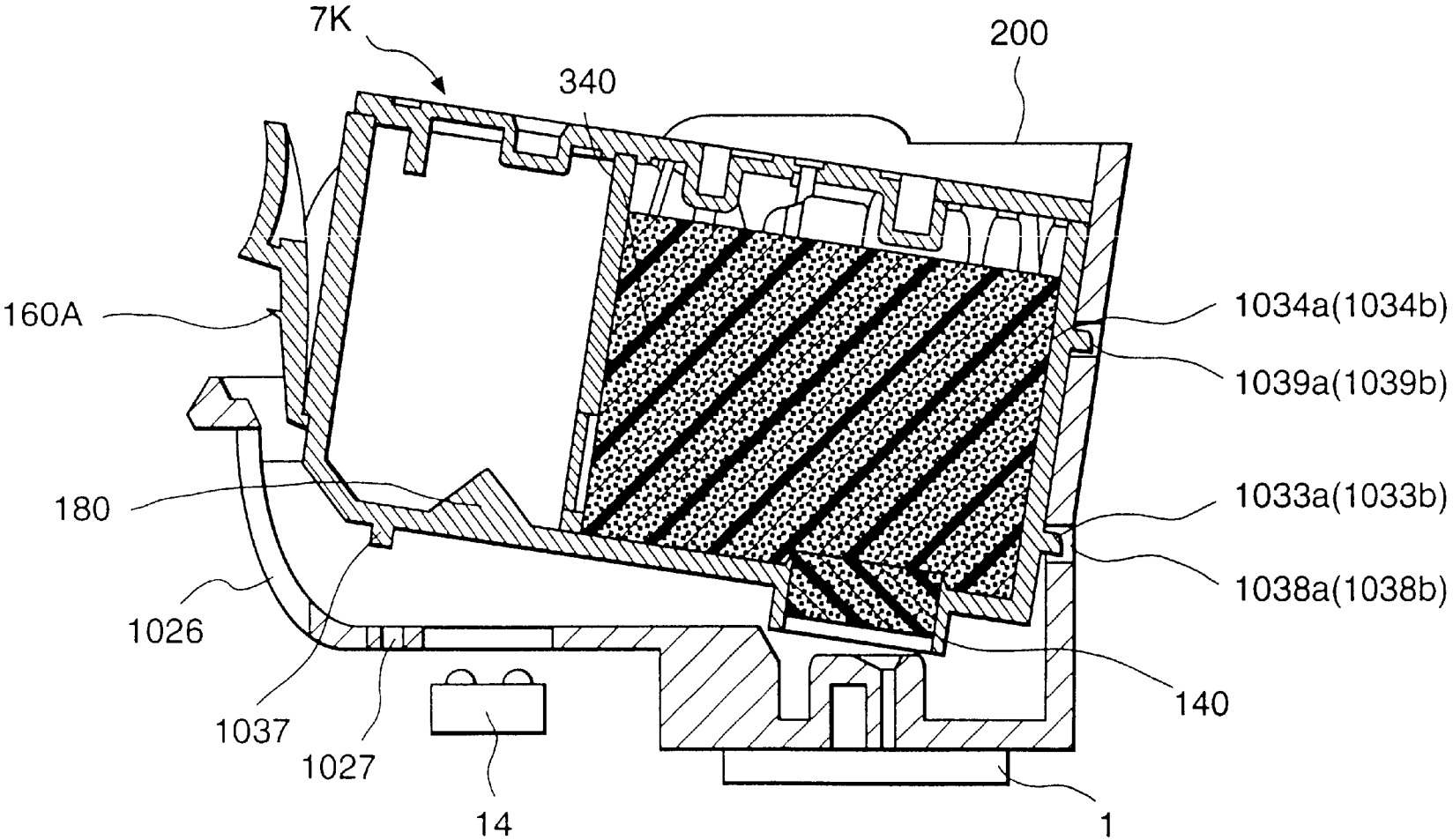
FIGS. 34A and 34B are cross-sectional views showing the positional relation between the prism on the bottom of the ink tank of the head cartridge according to a modification of the third embodiment and an optical unit outside the head cartridge.
Figure 34B:
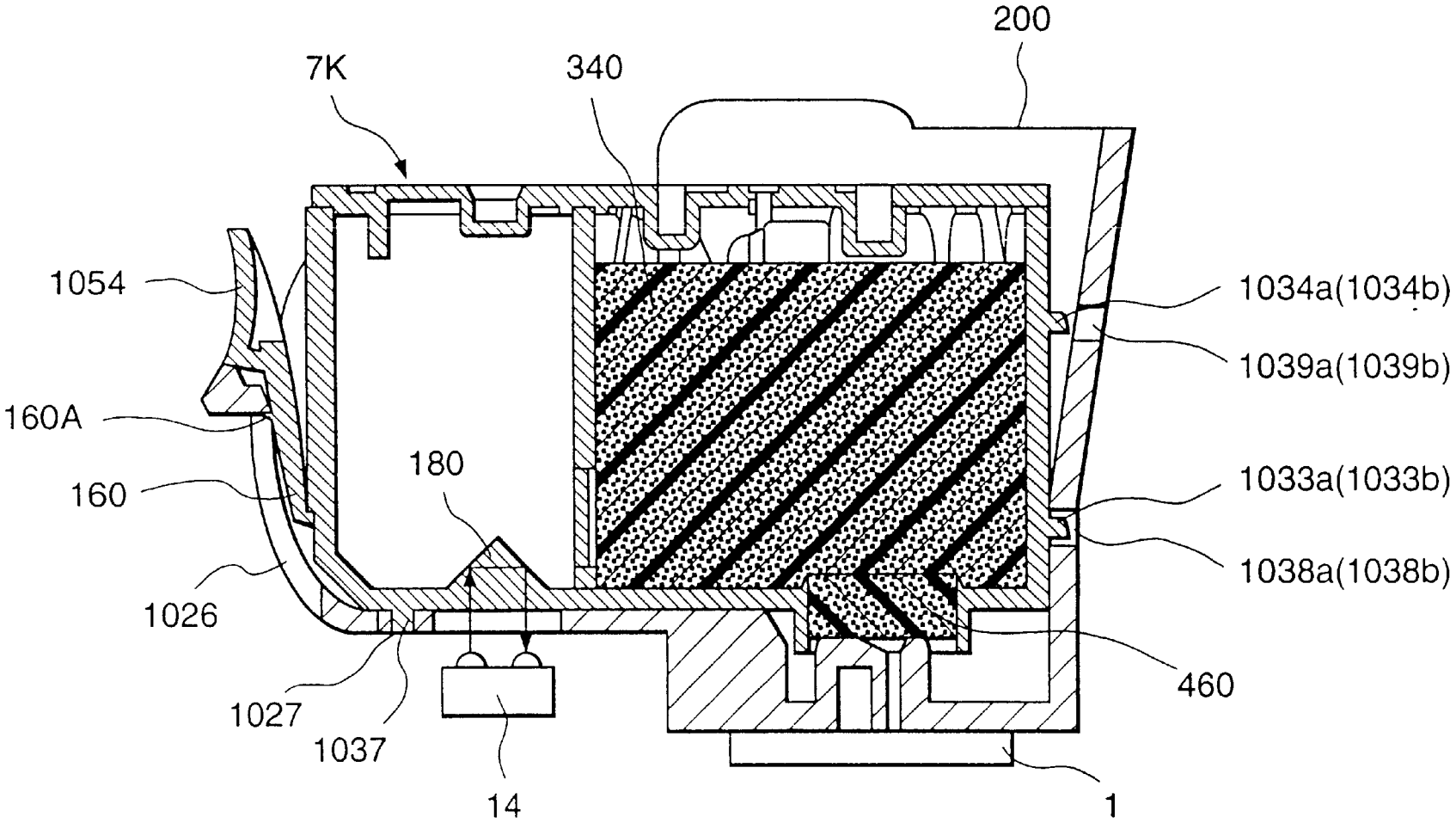

FIGS. 34A and 34B are cross-sectional views showing the positional relation between the prism 180 on the bottom of the ink tank of the head cartridge and an optical unit 14. FIG. 34A shows a state where the ink tank is being attached to the tank holder. FIG. 34B shows a state where the ink tank has been attached to the tank holder.

As descried in the above embodiment, the lever 160 having the engagement latch 160A is provided on one side surface of the ink tank 7K, and the second latches 1033*a* and 1033*b* are provided on the other side surface opposite to the side surface having the lever 160. In the ink tank 7K, the prism 180 used for residual ink detection is provided on the bottom surface of a chamber (ink chamber 360) containing only raw ink.

The tank holder 200 has the first holes 1026 which engages with the engagement latch 160A and the second holes 1038*a* and 1038*b* which engage with the second latches 1033*a* and 1033*b*.

Upon attachment of the ink tank 7K to the tank holder 200, the second latches 1033*a* and 1033*b* of the ink tank 7K are inserted into the second holes 1038*a* and 1038*b* of the tank holder 200, then the ink tank 7K is inserted into the tank holder while the ink tank is rotated on the second latches as rotational centers, so as to distort the lever 160 inwardly on the side surface of the tank holder 200. By utilizing resilience of the distorted lever 160, the engagement latch 160A of the lever 160 is engaged with the first hole 1026 of the tank holder 200, and the ink tank 7K, with the second latches 1033*a* and 1033*b* engaged with the second holes 1038*a* and 1038*b* of the tank holder 200, is pressed against the side surface having the second holes 1038*a* and 1038*b*. Thus, the ink tank 7K is firmly fixed to the tank holder 200.

Further, in this state of attachment, the prism 180 in the lower part of the ink tank 7K is positioned to be opposite to the optical unit 14 outside the head cartridge, to form an optical path to reflect light entered the tank from the light emitting device of the optical unit 14 by a first surface (slope of the prism 180, then, further reflect the light by a second surface (slope) of the prism 180, and introduce the reflected light into the photoreception device of the optical unit outside the ink tank.

At this time, a shift, if occurred in the optical path, influences the precision of residual ink detection, therefore, the present modification provides a positioning pin on the bottom surface of the ink tank and a positioning hole in the tank holder for receiving the positioning pin when the ink tank is attached to the tank holder. This increases the positional precision of the ink tank, and enables precise residual ink detection.

As shown in FIGS. 34A and 34B, to further increase the precision of residual ink detection, the positioning pin 1037 on the bottom surface of the ink tank 7K is provided near the prism 180. Further, the prism 180 is positioned between the second latches 1033*a* and 1033*b*, which serve as rotational centers upon attaching the ink tank, and the positioning pin 1037. In comparison with a case where the positions of the positioning pin 1037 and the prism 180 are opposite, the distance between the prism 180 and the second latches 1033*a* and 1033*b* is shorter. Thus, the positional precision of the prism 180 is improved in a horizontal rotational direction (the direction vertical to the sheets of FIGS. 34A and 34B) with the second holes 1033*a* and 1033*b* as rotational centers.

Further, when the ink tank 7K is attached to the tank holder 200, the ink tank 7K is pressed against the side surface of the tank holder 200 having the second holes 1038*a* and 1038*b* by the resilience of the lever 160. By this arrangement, a side surface of the positioning pin 1037 on the bottom surface of the ink tank is pressed against a side surface of the positioning hole 1027 of the tank holder 200.

In the present embodiment, the side surface of the positioning pin 1037 of the ink tank 7K facing the second latches 1033*a* and 1033*b* is formed flat as a thrust portion. Also, the side surface of the positioning hole 1027 of the tank holder has a flat portion to receive the thrust portion of the positioning pin 1037. As the positioning pin 1037 and the positioning hole 1027 are thrusted against each other in a plane or a point, the positional precision of the attached ink tank is further improved. Note that, although the flat portions are provided in a direction diagonal to a biasing direction by the lever of the ink tank, to further improve the precision, the flat portions are preferably provided in a direction orthogonal to the biasing direction.

Figure 35A:
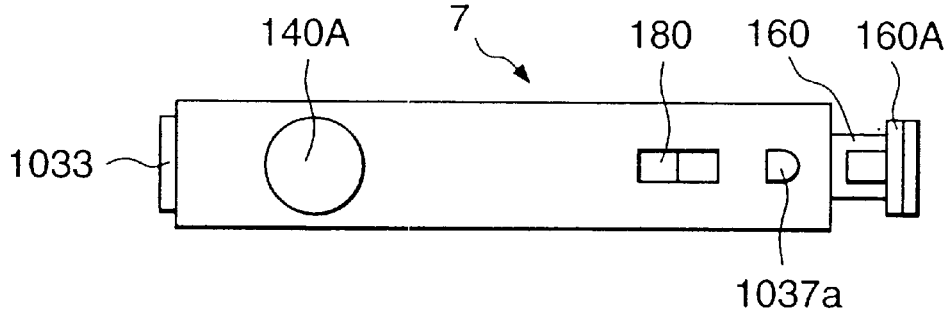
FIGS. 35A to 35C are bottom plan views showing the shapes of a positioning pin on the ink tank of the head cartridge according to the modification of the third embodiment.
Figure 35B:
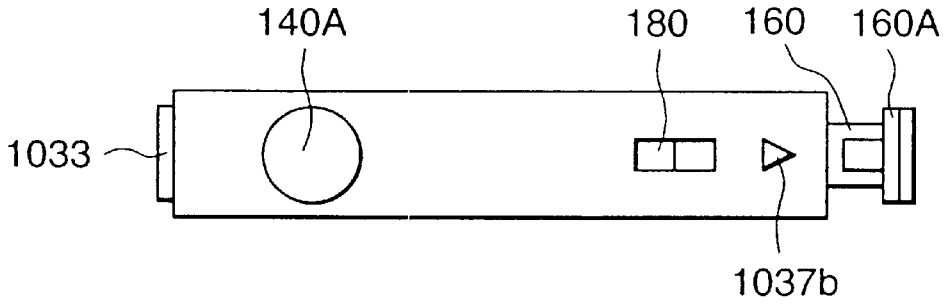
Figure 35C:
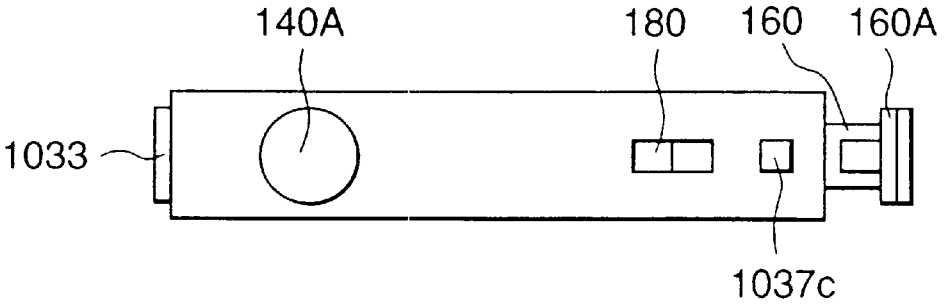
Figure 36:
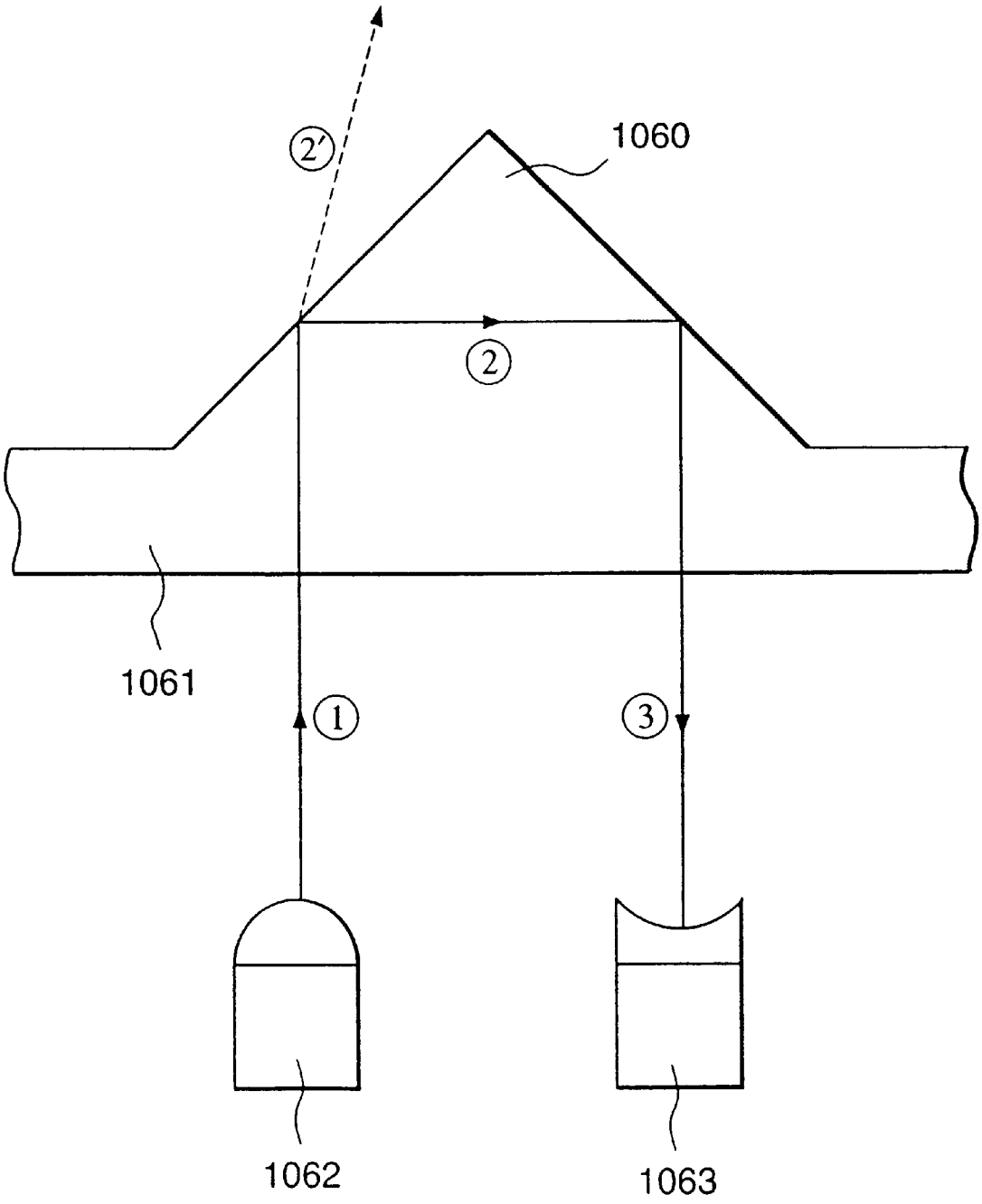
FIG. 36 PRIOR ART
FIG. 36 is an explanatory view showing the positional relation among the conventional light-transmitting type prism provided on the bottom of the ink tank, a light emitting device to emit light to the prism, and a photoreception device to receive the light.
Figure 37:
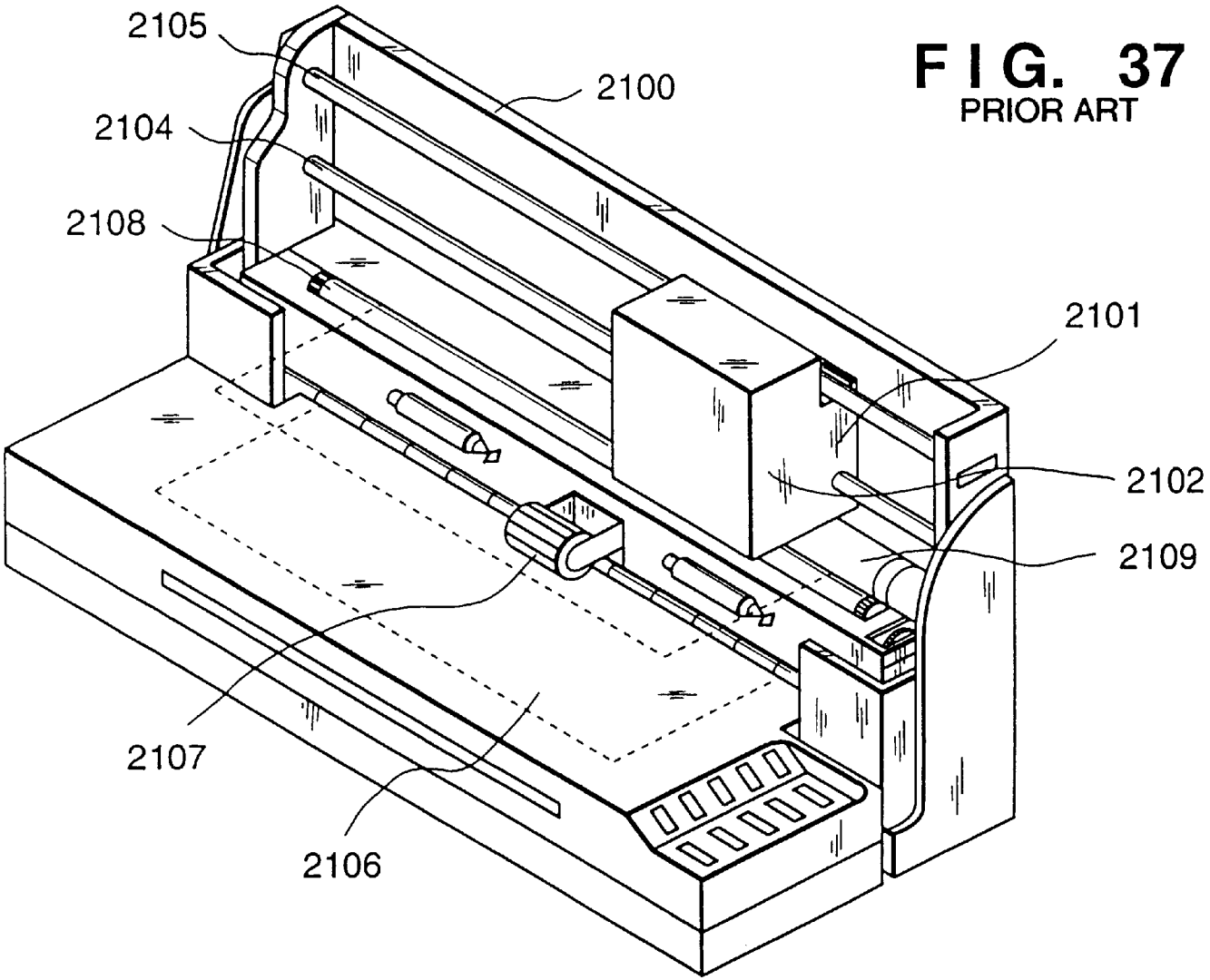
FIG. 37 PRIOR ART
FIG. 37 is a perspective view of the conventional generally known ink-jet printing apparatus.
Figure 38B:
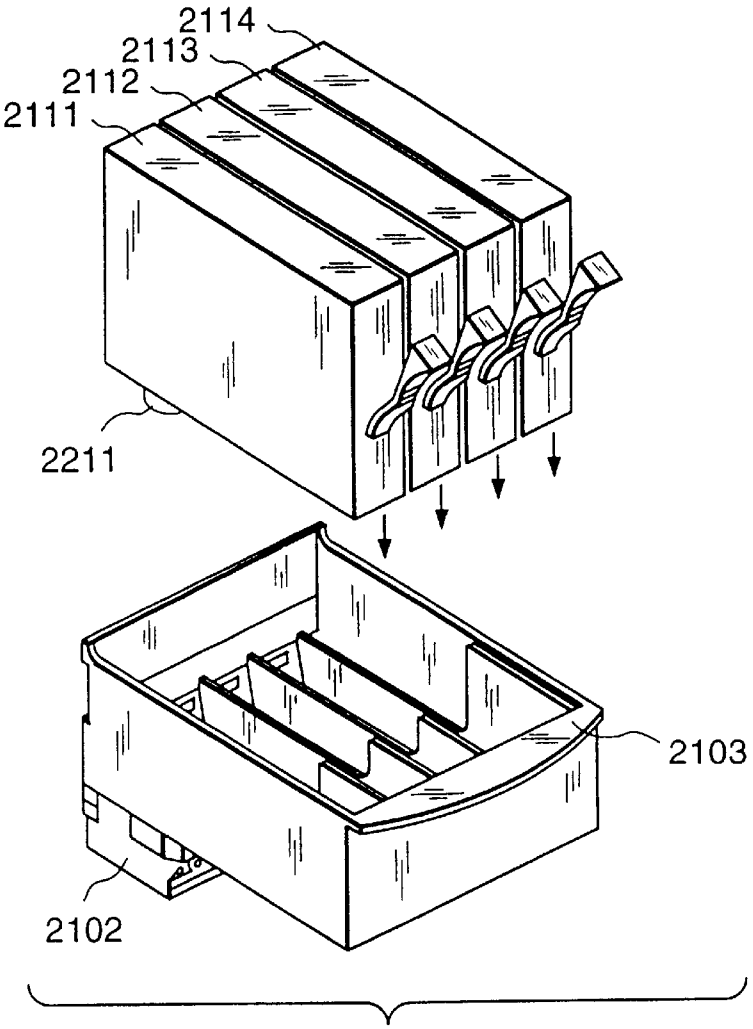
FIG. 38B PRIOR ART
FIGS. 38A and 38B are perspective views of the conventional head cartridge.
Figure 38A:
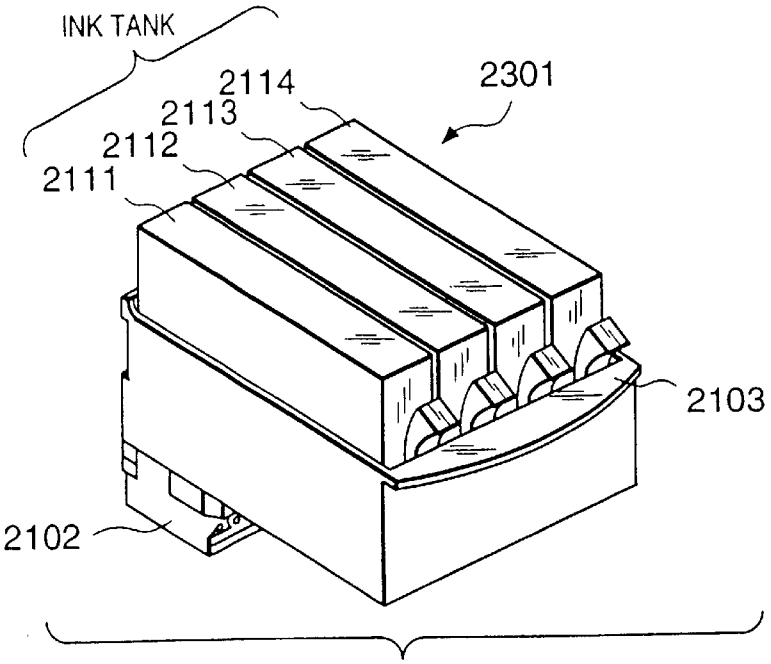
FIG. 38A PRIOR ART
Figure 39:
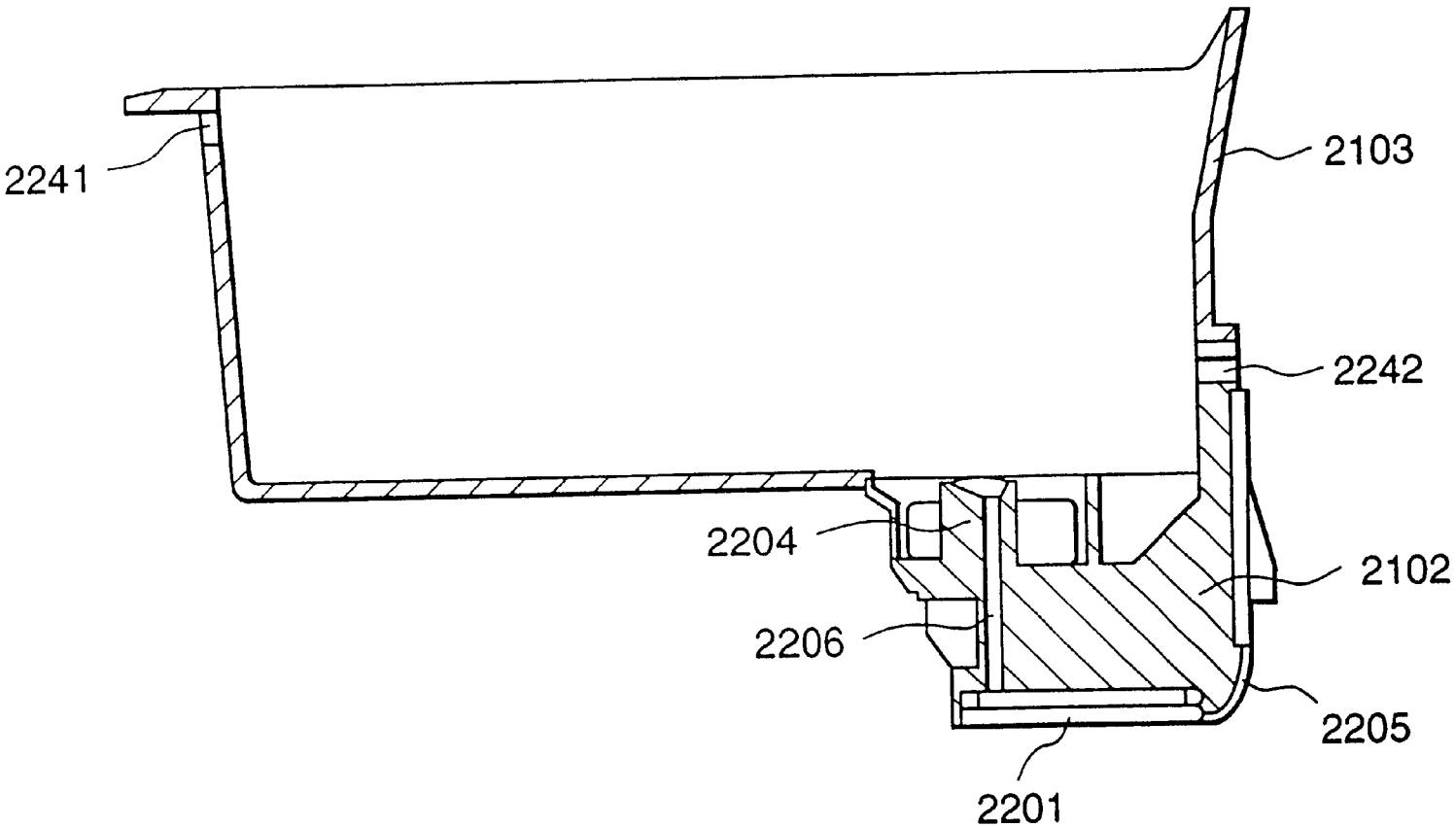
FIG. 39 PRIOR ART
FIG. 39 is a cross-sectional view of the conventional head cartridge.
Figure 40B:
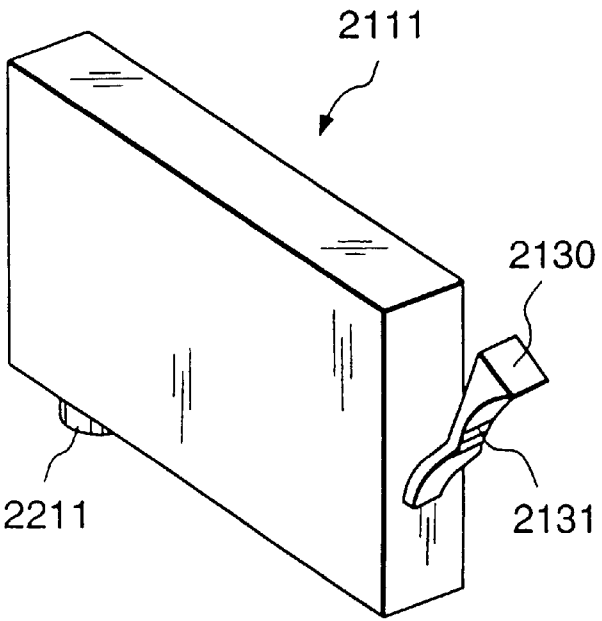
FIG. 40B PRIOR ART
FIGS. 40A to 40C are perspective views and a cross-sectional view showing in detail the ink tank of the head cartridge in FIG. 38.
Figure 40A:
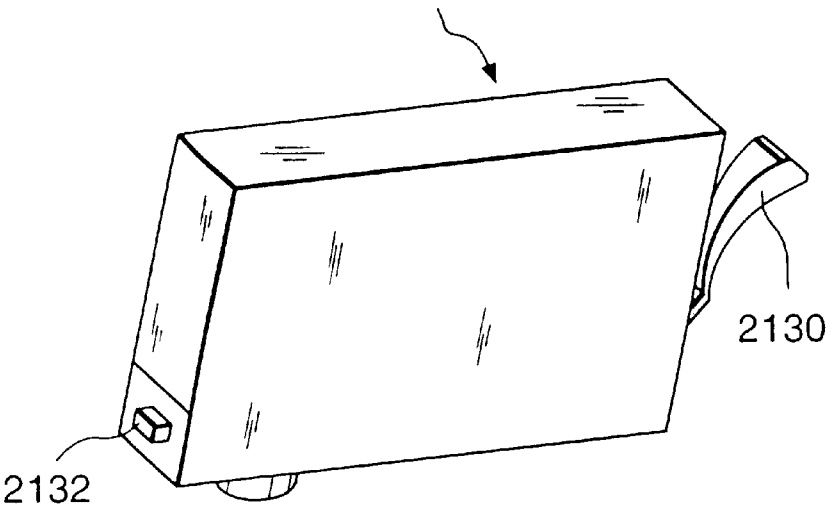
FIG. 40A PRIOR ART
Figure 40C:
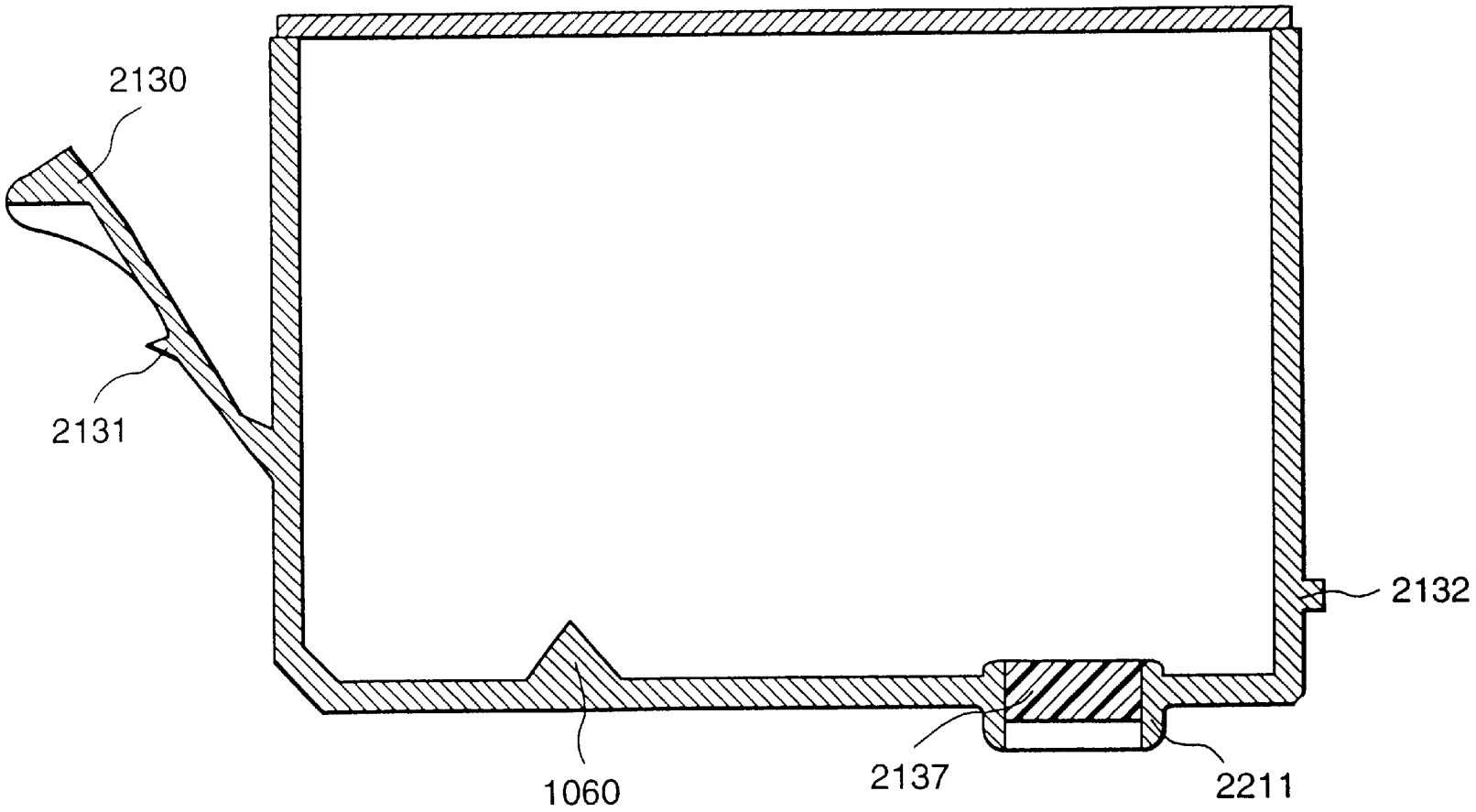
FIG. 40C PRIOR ART
Figure 41A:
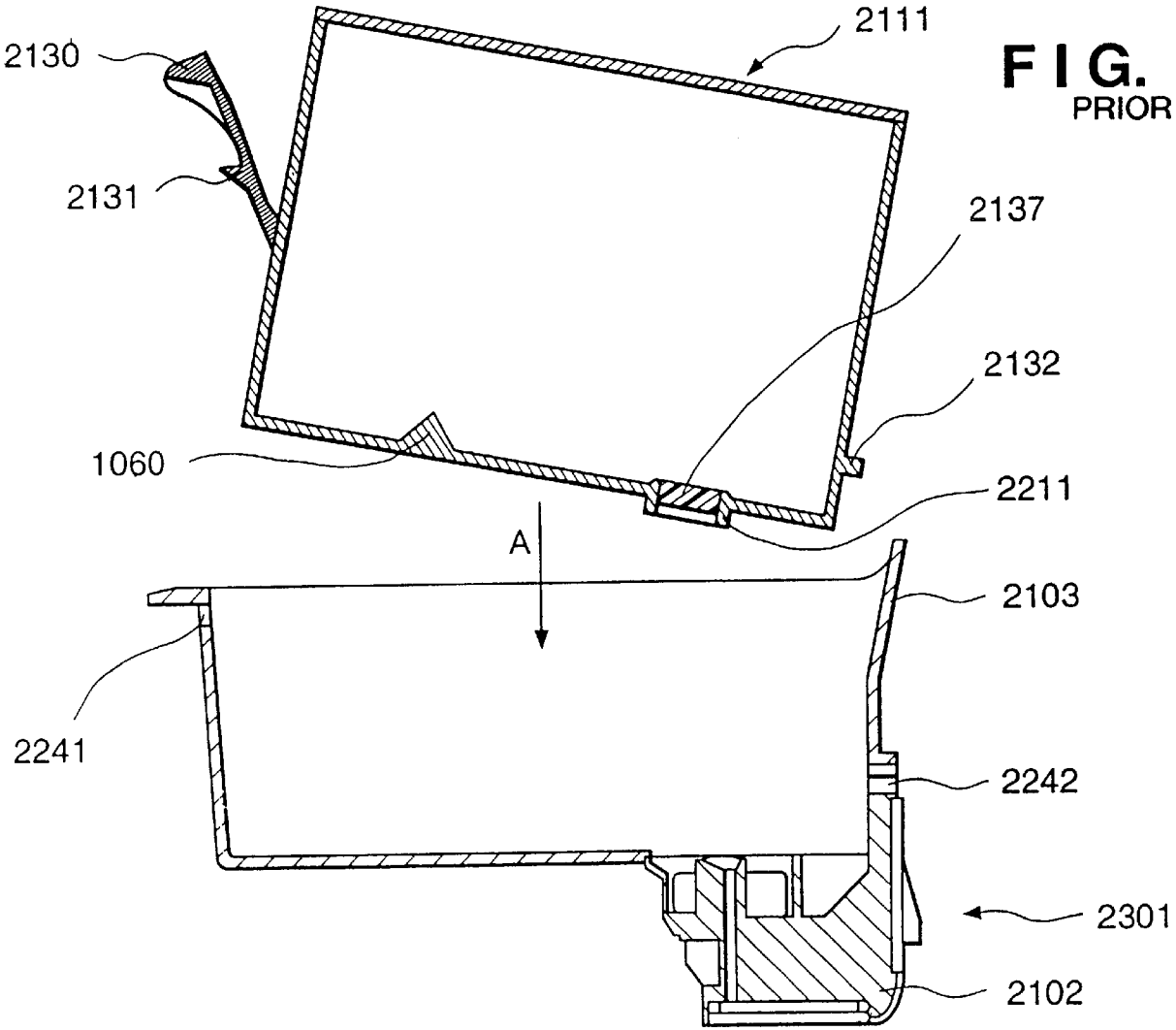
FIG. 41A PRIOR ART
FIGS. 41A to 41C are cross-sectional explanatory views showing the conventional ink-jet head cartridge in FIG. 38 where the ink tank is attached to the tank holder.
Figure 41B:
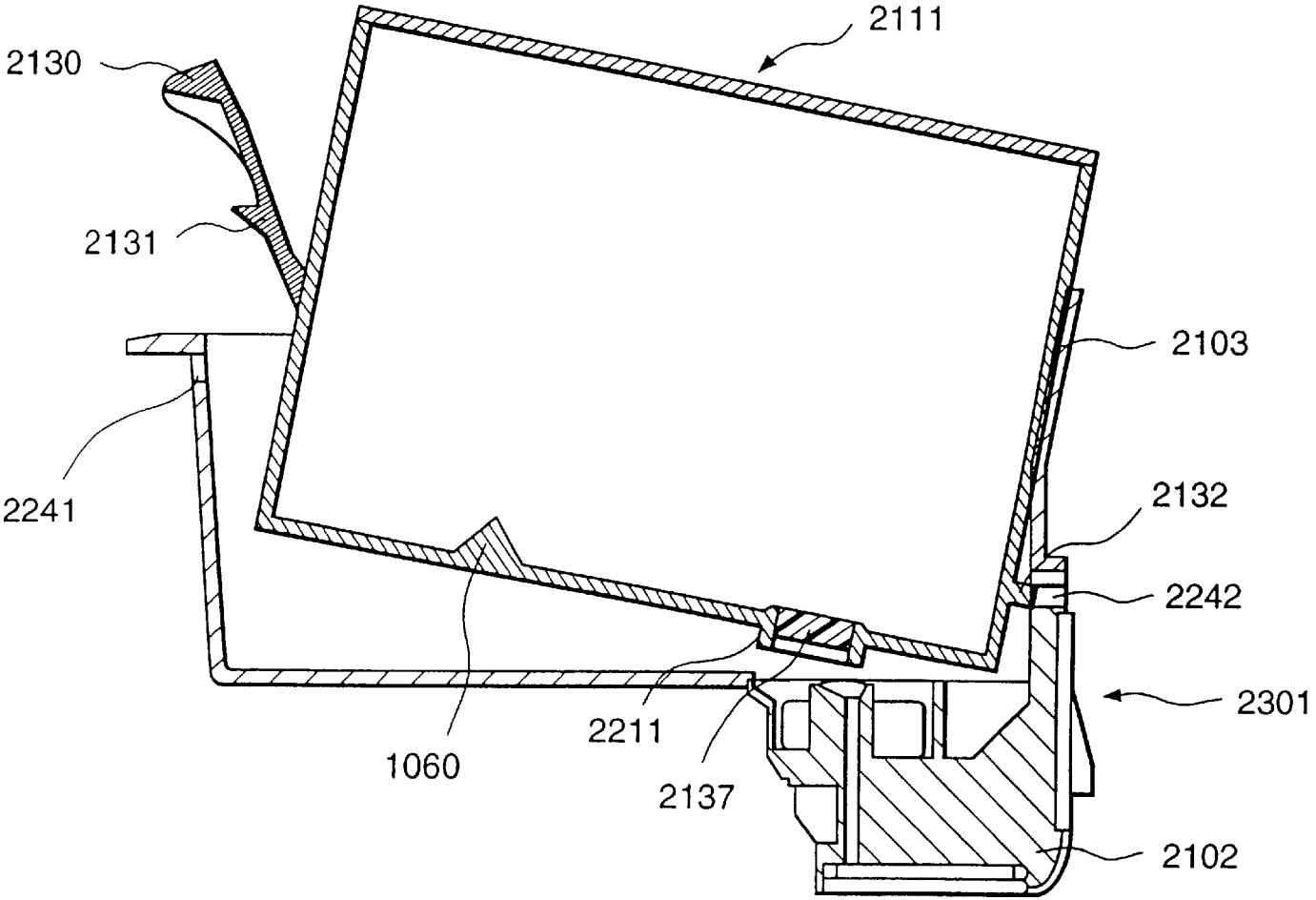
FIG. 41B PRIOR ART
Figure 41C:
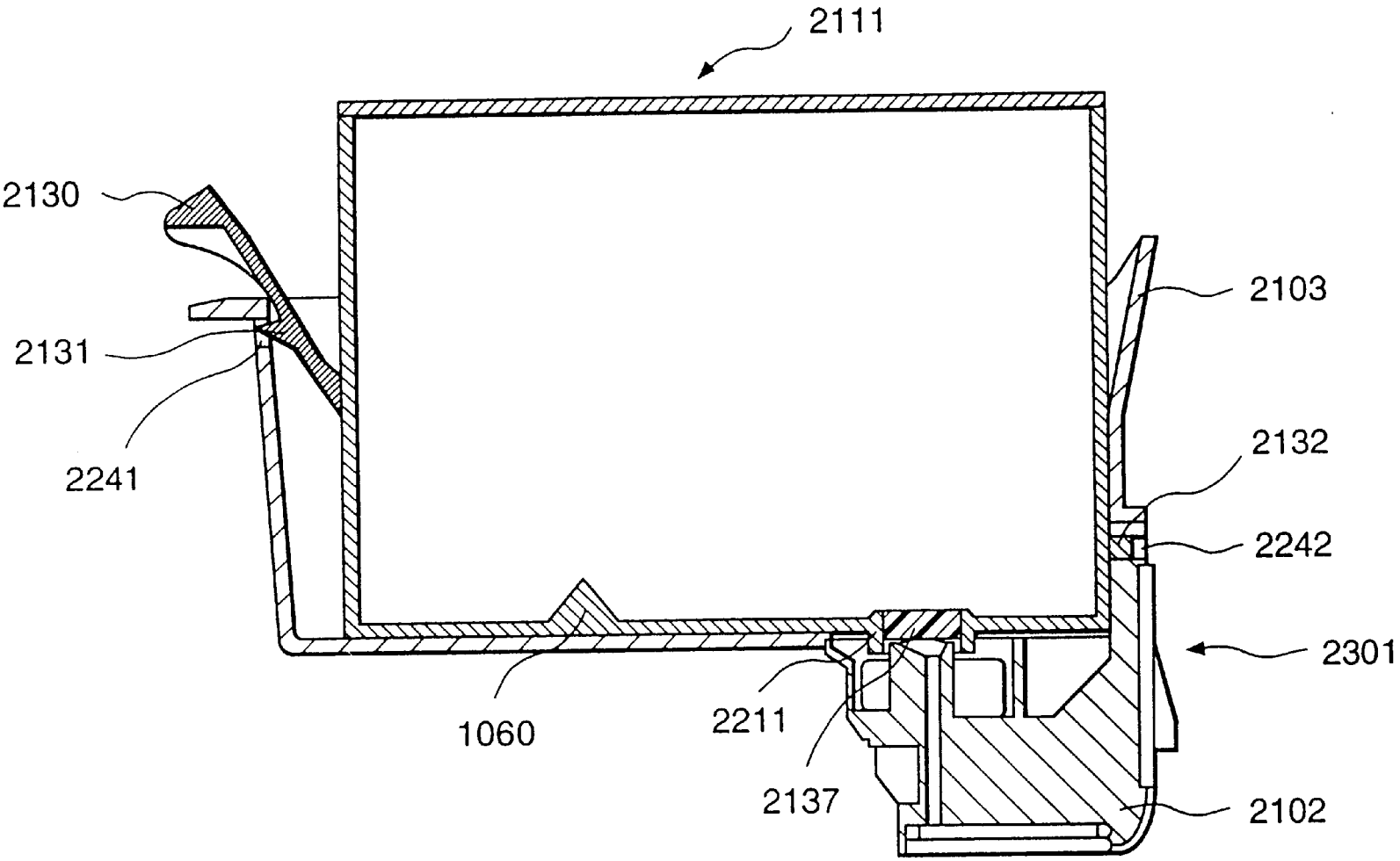
FIG. 41C PRIOR ART
Figure 42A:
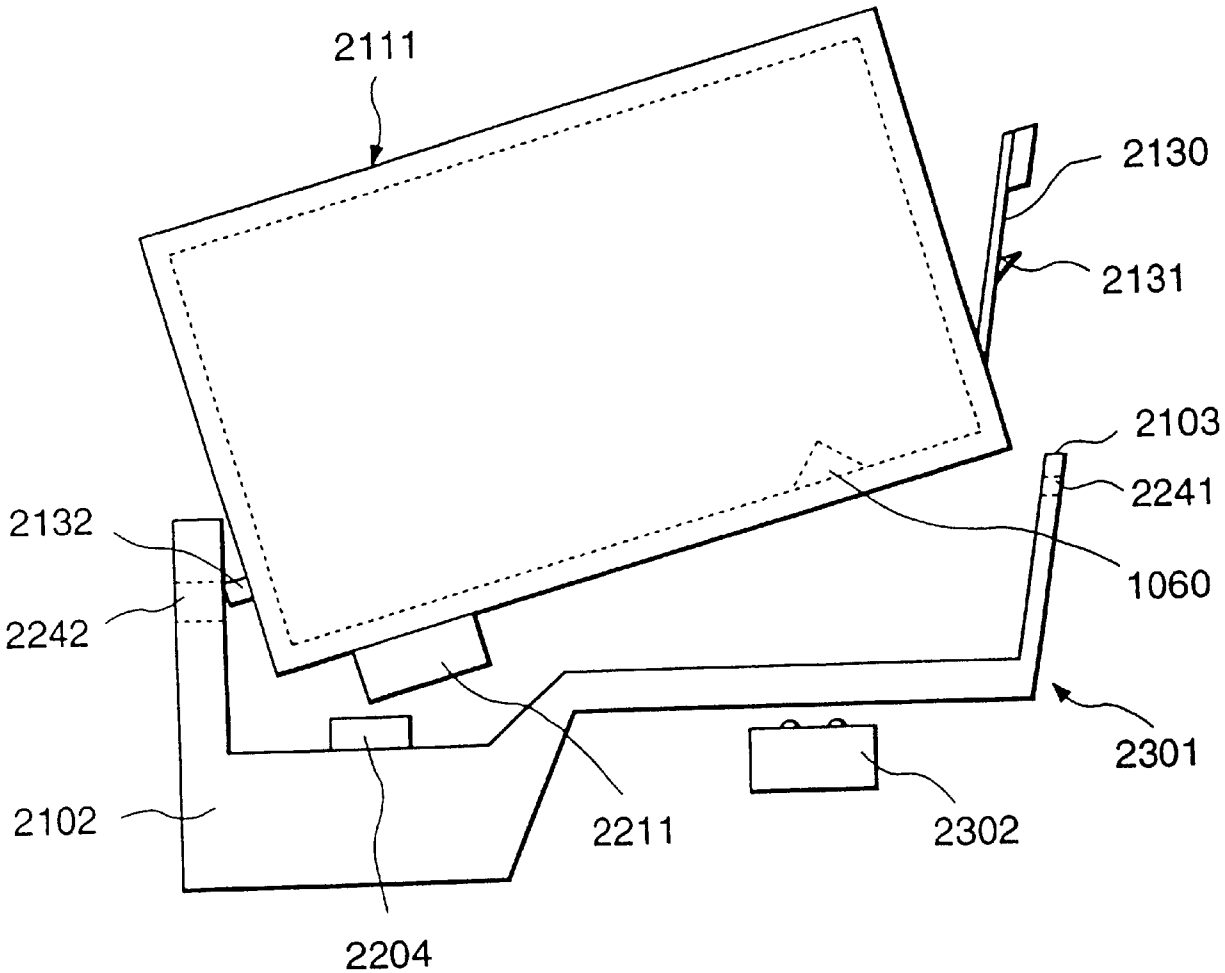
FIG. 42A PRIOR ART
FIGS. 42A and 42B are cross-sectional views showing the positional relation between the prism on the bottom of the ink tank in the conventional head cartridge and residual ink detection sensor outside the head cartridge.
Figure 42B:
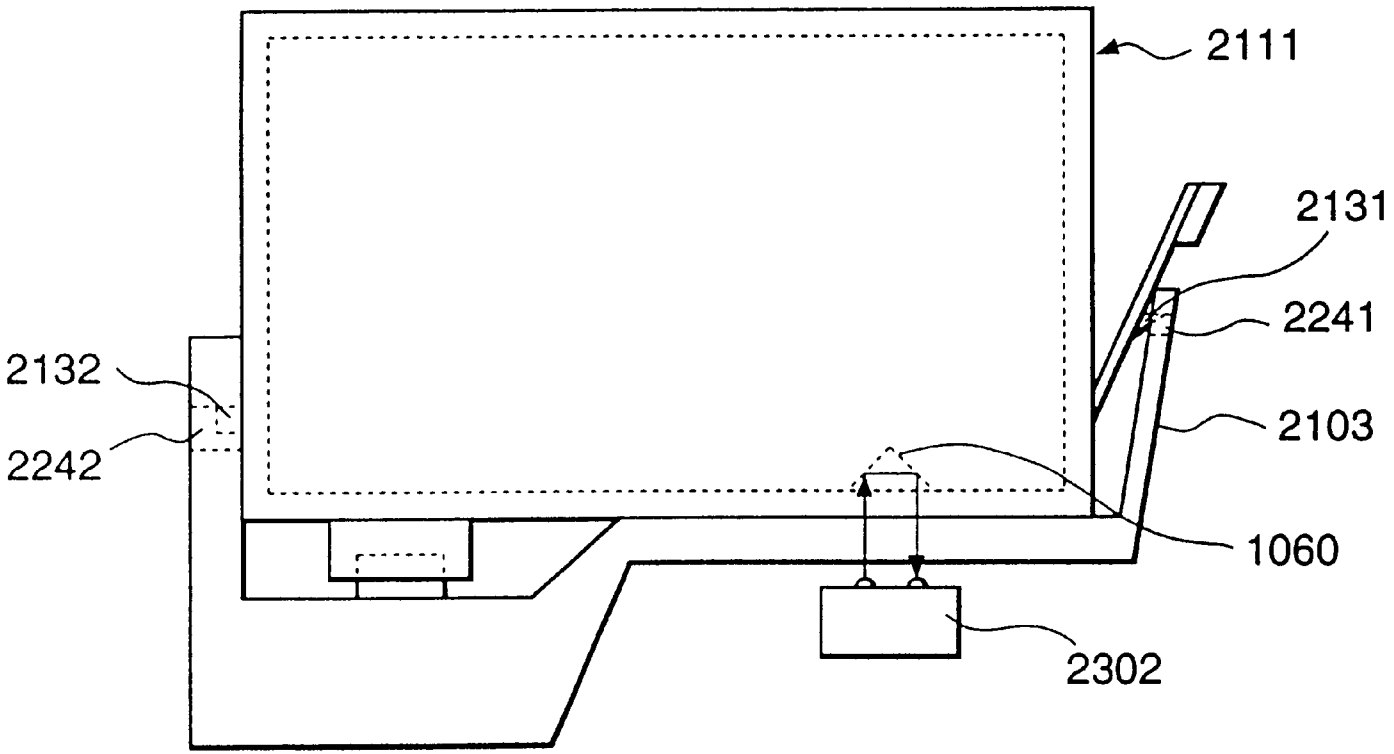
FIG. 42B PRIOR ART
Figure 43:
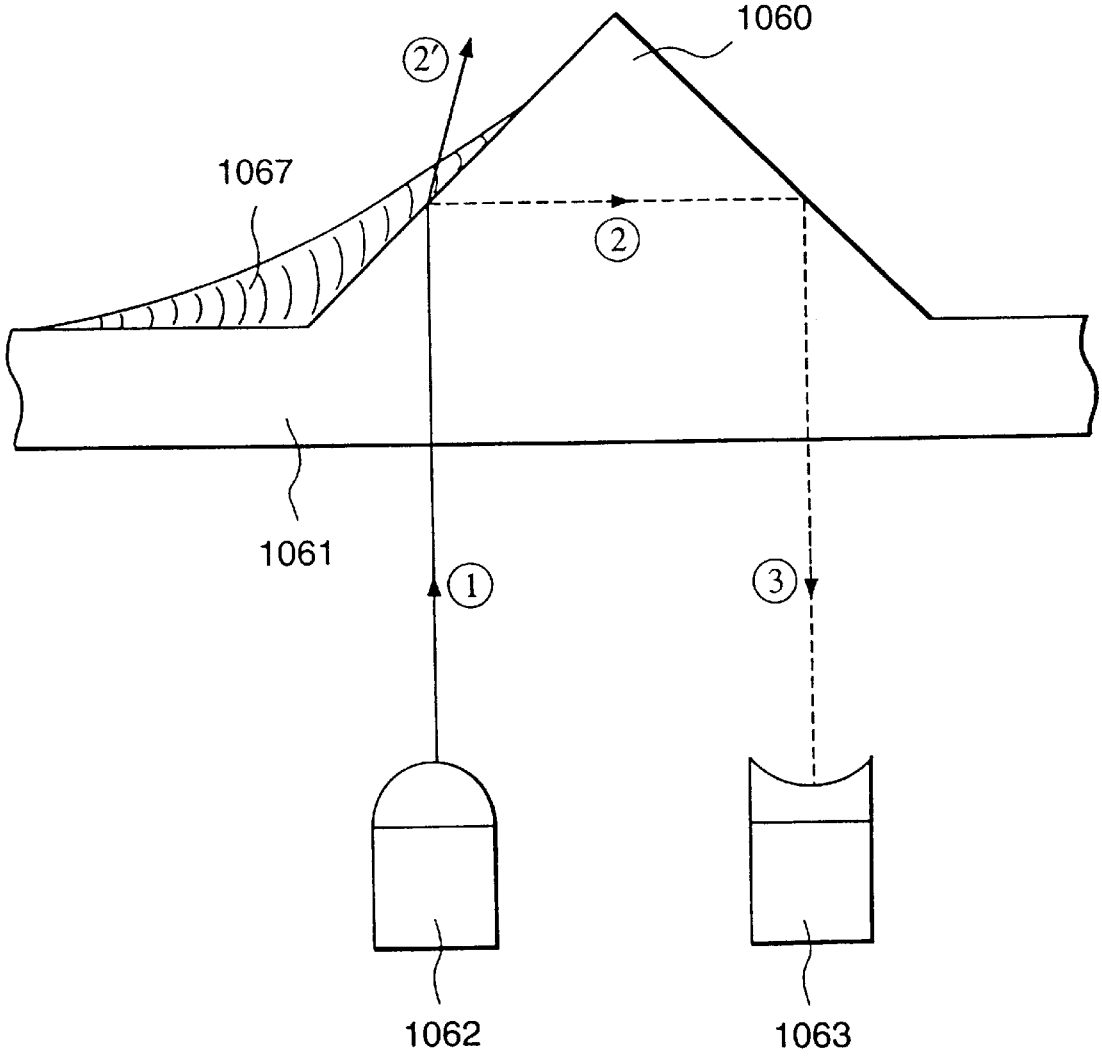
FIG. 43 PRIOR ART
FIG. 43 is an explanatory view showing an optical path when a slight amount of ink is attached to the prism.

FIGS. 35A to 35C are plan views showing the shapes of the positioning pin on the bottom of the ink tank. As shown in these figures, the above-described positioning pin has a D-shaped cross section (FIG. 35A) obtained by cutting a side surface of a cylindrical pin flat at an opposite side of the lever 160, a triangular cross section (FIG. 35B) obtained by arranging one side surface of a triangular prism pin opposite to the lever 160, or a rectangular cross section (FIG. 35C) obtained by arranging one side surface of a rectangular prism pin opposite to the lever 160. As for the shape of the positioning pin, in consideration of above-described attachment/detachment by rotation, it is preferable that the number of angular portions other than those forming the basic flat portion is small so as to reduce damage on the positioning pin upon attachment/detachment. Accordingly, the shape of the positioning pin having a D-shaped cross section as shown in FIG. 35A is especially preferably used in the ink tank of the present invention.

Note that the black-ink large-capacity ink tank has been used in the present embodiment, however, the above-described arrangement and shapes of the positioning pin can be applied to the color-ink small-capacity tanks 7 (7C, 7M and 7Y).

Note that in the above embodiments, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

Further, as the printing apparatus described in the above embodiments is capable of high-density and high-speed printing, the printing apparatus can be used as output means of an information processing system, e.g., a printer as an output terminal of a copying machine, a facsimile apparatus, an electronic typewriter, a word processor and a work station, or as a handy or portable printer installed-in a personal computer, an optical disk apparatus, a video apparatus and the like. In such case, the printing apparatus has a form corresponding to functions and form of use unique to each apparatus.

Accordingly, the purpose of the ink tank as a liquid container according to the present invention is not limited to the printing apparatus but various apparatuses such as a facsimile apparatus and a copying machine.

Further, the present invention can be applied to a system constituted by a plurality of devices (e.g., a host computer, an interface device, a reader and a printer), or to an apparatus comprising a single device (e.g., a copying machine or a facsimile apparatus).

As many apparently widely different embodiments of the present invention can be made without departing from the spirit and scope thereof, it is to be understood that the invention is not limited to the specific embodiments thereof except as defined in the appended claims.

What is claimed is:

1. An ink tank detachably held on a tank holder, having a movable lever with a first engagement latch to engage with a first engagement hole provided on a side wall of said tank holder and a second engagement latch to engage with a second engagement hole provided on another side wall of said tank holder opposite to the side wall having said first engagement hole, wherein said ink tank has a positioning pin on its bottom surface, and said tank holder has a positioning hole to receive the positioning pin upon attachment of said ink tank to said tank holder, and wherein a prism is provided on an inner bottom of said ink tank such that said prism is positioned opposite to the position of an optical sensor for residual ink detection provided outside of said ink tank when said ink tank is attached to said tank holder, further wherein said prism is provided in a position between the second engagement latch and the positioning pin, further wherein the positioning pin and the positioning hole have thrust portions to thrust upon each other, and the thrust portion of the positioning pin has a flat surface.

2. The ink tank according to claim 1, wherein the first engagement latch of the movable lever is engaged with the first engagement hole of said tank holder by utilizing resilience of the movable lever, and wherein said ink tank is attached and fixed to said tank holder by pressing said ink tank, with the second engagement latch engaged with the second engagement hole of said tank holder, against the side wall on which the second engagement hole is provide.

3. The ink tank according to claim 2, wherein said flat surface is diagonal to a direction in which said ink tank is pressed upon the side wall.

4. A tank holder which detachably holds an ink tank, having a first engagement hole to engage with a first engagement latch of a movable lever provided on one side surface of said ink tank and a second engagement hole to engage with a second engagement latch provided on another side surface of said ink tank opposite to the side surface having the movable lever, wherein said ink tank has a positioning pin on its bottom surface, and said tank holder has a positioning hole to receive the positioning pin upon attachment of said ink tank to said tank holder, and wherein a prism is provided on an inner bottom of said ink tank such that said prism is positioned opposite to the position of an optical sensor for residual ink detection provided outside of said ink tank when said ink tank is attached to said tank holder, further wherein said prism is provided in a position between the second engagement latch and the positioning pin, further wherein the positioning pin and the positioning hole have thrust portions to thrust upon each other, and the thrust portion of the positioning hole has a flat surface.

5. The tank holder according to claim 4, wherein the first engagement latch of the movable lever is engaged with the first engagement hole of the tank holder by utilizing resilience of the movable lever, and wherein said ink tank is attached and fixed to said tank holder by pressing said ink tank, with the second engagement latch engaged with the second engagement hole of said tank holder, against the side surface on which the second engagement hole is provided.

6. The tank holder according to claim 5, wherein the flat surface is diagonal to a direction in which said ink tank is pressed upon the side surface.

* * * * *